US010125446B2

(12) United States Patent
Mikkelsen et al.

(10) Patent No.: US 10,125,446 B2
(45) Date of Patent: Nov. 13, 2018

(54) LAUNDRY TREATING APPLIANCE

(71) Applicant: WHIRLPOOL CORPORATION, Benton Harbor, MI (US)

(72) Inventors: Douglas Mikkelsen, Saint Joseph, MI (US); Christoph J. Miller, Saint Joseph, MI (US); Eric J. Walsh, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 17 days.

(21) Appl. No.: 15/344,890

(22) Filed: Nov. 7, 2016

(65) Prior Publication Data

US 2017/0152625 A1 Jun. 1, 2017

Related U.S. Application Data

(60) Provisional application No. 62/261,515, filed on Dec. 1, 2015.

(51) Int. Cl.

| | |
|---|---|
| ***D06F 37/04*** | (2006.01) |
| ***D06F 37/20*** | (2006.01) |
| ***D06F 37/26*** | (2006.01) |
| ***D06F 37/30*** | (2006.01) |

(52) U.S. Cl.

CPC ..... *D06F 37/30* (2013.01); *D06F 37/04* (2013.01); *D06F 37/206* (2013.01); *D06F 37/263* (2013.01); *D06F 37/264* (2013.01); *D06F 37/269* (2013.01); *D06F 37/267* (2013.01)

(58) Field of Classification Search

CPC ..... D06F 37/04; D06F 37/206; D06F 37/263; D06F 37/264; D06F 37/267; D06F 37/269; D06F 37/30

USPC ..... 68/24, 139, 140, 142

See application file for complete search history.

(56) References Cited

U.S. PATENT DOCUMENTS

| | | | |
|---|---|---|---|
| 2,656,696 | A | 10/1953 | McDonald |
| 3,152,202 | A | 10/1964 | Murphy, Jr. |
| 4,949,557 | A | 8/1990 | Price |
| 5,989,466 | A | 11/1999 | Kato et al. |
| 6,050,113 | A | 4/2000 | Skrippek et al. |
| 6,655,177 | B2 | 12/2003 | Bierbach et al. |
| 7,533,548 | B2 | 5/2009 | Chang |
| 7,571,625 | B2 | 8/2009 | Chang |
| 7,765,838 | B2 | 8/2010 | Kim et al. |

(Continued)

FOREIGN PATENT DOCUMENTS

| | | | |
|---|---|---|---|
| CH | 346852 | A | 6/1960 |
| DE | 1610077 | A1 | 7/1971 |

(Continued)

OTHER PUBLICATIONS

European Search Report for Counterpart EP16201583.8, dated Apr. 6, 2017.

(Continued)

*Primary Examiner* — Levon J Shahinian

(57) ABSTRACT

A fabric treating appliance includes a chassis defining an interior. A tub is provided in the interior defining a liquid chamber. An exoskeleton is disposed within the liquid chamber and houses a drum defining a treating chamber for treating an article of laundry. A rear drive plate is provided at one end of the drum and at least partially defines the exoskeleton. One or more braces can couple to the rear drive plate to improve structural integrity of the exoskeleton housing the drum.

21 Claims, 44 Drawing Sheets

(56) References Cited

U.S. PATENT DOCUMENTS

| | | | |
|---|---|---|---|
| 7,820,995 | B2 | 10/2010 | Gadini et al. |
| 7,930,910 | B2 | 4/2011 | Chang |
| 7,976,111 | B2 | 7/2011 | Sans Rovira et al. |
| 8,156,770 | B2 | 4/2012 | Chang |
| 8,256,246 | B2 | 9/2012 | Hollenhorst et al. |
| 8,302,434 | B2 | 11/2012 | Chang |
| 8,322,170 | B2 | 12/2012 | Chang |
| 8,336,339 | B2 | 12/2012 | Chang |
| 8,336,340 | B2 | 12/2012 | Chang |
| 8,341,983 | B2 | 1/2013 | Chang |
| 8,387,421 | B2 | 3/2013 | Chang |
| 8,616,027 | B2 | 12/2013 | Chang |
| 8,646,190 | B2 | 2/2014 | Sartor |
| 8,646,292 | B2 | 2/2014 | Chang |
| 8,646,293 | B2 | 2/2014 | Chang |
| 8,763,618 | B2 | 7/2014 | Brambilla et al. |
| 2005/0028568 | A1 | 2/2005 | Koch et al. |
| 2009/0038349 | A1 | 2/2009 | Yoon |
| 2013/0031938 | A1 | 2/2013 | Cho et al. |
| 2013/0036774 | A1 | 2/2013 | Kim et al. |
| 2014/0150281 | A1 | 6/2014 | Sartor |
| 2015/0052953 | A1 | 2/2015 | Erickson et al. |
| 2015/0052954 | A1 | 2/2015 | Erickson et al. |
| 2015/0176166 | A1 | 6/2015 | Alexander et al. |
| 2016/0177487 | A1 | 6/2016 | Erickson et al. |

FOREIGN PATENT DOCUMENTS

| | | | |
|---|---|---|---|
| DE | 3817611 | A1 | 1/1989 |
| DE | 10252011 | A1 | 6/2004 |
| DE | 102010028437 | A1 | 11/2011 |
| EP | 0234243 | A1 | 9/1987 |
| EP | 0765963 | A1 | 4/1997 |
| EP | 1433890 | A2 | 6/2004 |
| EP | 1433891 | A2 | 6/2004 |
| EP | 1522624 | A2 | 4/2005 |
| EP | 1619286 | A2 | 1/2006 |
| EP | 1688531 | A1 | 8/2006 |
| EP | 1783266 | A1 | 5/2007 |
| EP | 1990462 | A2 | 11/2008 |
| EP | 2385163 | A1 | 11/2011 |
| EP | 2460924 | A2 | 6/2012 |
| ES | 2399674 | A2 | 4/2013 |
| ES | 2463168 | A1 | 5/2014 |
| ES | 2463315 | A2 | 5/2014 |
| ES | 2463487 | A1 | 5/2014 |
| ES | 2464242 | A2 | 5/2014 |
| FR | 1375530 | A | 10/1964 |
| FR | 1513957 | A | 2/1968 |
| GB | 1598210 | A | 9/1981 |
| GB | 2096649 | A | 10/1982 |
| GB | 2189511 | A | 10/1987 |
| IT | 1169242 | B | 5/1987 |
| IT | 1205674 | B | 3/1989 |
| WO | 2008102396 | A2 | 8/2008 |
| WO | 2009030688 | A1 | 3/2009 |

OTHER PUBLICATIONS

European Search Report for Counterpart EP162015812, dated Apr. 6, 2017.

European Search Report for Counterpart EP16201584.6, dated Apr. 6, 2017.

European Search Report for Counterpart EP16201585.3, dated Apr. 6, 2017.

European Search Report for Counterpart EP16201586.1, dated Apr. 11, 2017.

LAUNDRY TREATING APPLIANCE

CROSS-REFERENCE TO RELATED APPLICATIONS

This application claims the benefit of U.S. Provisional Patent Application No. 62/261,515, filed Dec. 1, 2015, which is incorporated by reference in its entirety.

BACKGROUND

Laundry treating appliances, such as clothes washers, refreshers, and non-aqueous systems, can have a configuration based on a cabinet within which is housed the components of the appliance, including a liquid container, typically in the form of a tub. The tub typically houses a laundry container defining a treating chamber in which laundry items are placed for treating, which is a perforated drum rotating about a generally horizontal axis for a "front loader" or "horizontal axis" clothes washer. A bearing assembly mounted in a rear wall of the tub typically rotatably mounts the drum within the tub. The tub is dimensioned to accommodate tub movement within the cabinet, movement of the drum within the tub, and to support forces generated by the weight and rotation of the drum.

A suspension system typically connects the tub to the cabinet to support the movement of the tub and the drum within the cabinet, dampening any movement or vibrational transmission from the tub or the drum therein. Supporting the movement of the tub within the cabinet limits the capacity of the tub, thus limiting the capacity of the drum within the tub and the volume of the treating chamber directly limiting the volume of laundry that can be treated within the treating chamber.

BRIEF SUMMARY

In one aspect, the disclosure relates to a drive hub assembly for a fabric treating appliance including a front plate having a first central opening. A rear plate in confronting relationship with and coupled to the front plate to define an internal cavity between the front and rear plates, the rear plate having a second central opening aligned with and spaced from the first central opening. A bearing carrier is provided in the first and second central openings to collectively defined a drive opening.

In another aspect, the disclosure relates to a fabric treating appliance for treating a laundry article according to a cycle of operation including a chassis defining an interior. A tub is located within the interior and mounted to the chassis, with the tub defining a liquid chamber. A rotatable drum having a rear opening is disposed within the tub at least partially defining a treating chamber. A drive hub assembly mounts to the drum to close the rear opening including a front plate coupled in spaced relationship to a rear plate to define an interior cavity and has a bearing carrier including bearings and provided on each of the front and rear plates to define a drive opening in the center of the drive hub assembly. A drive shaft extends through the drive opening, rotatable along the bearings, and couples to the drum to rotate the drum according to the cycle of operation.

In yet another aspect, the disclosure relates to a method of forming a drive hub assembly for a fabric treating appliance. The method includes coupling a first plate to a second plate and mounting a bearing carrier in an opening in the first and second plates.

DETAILED DESCRIPTION

Figure 1:
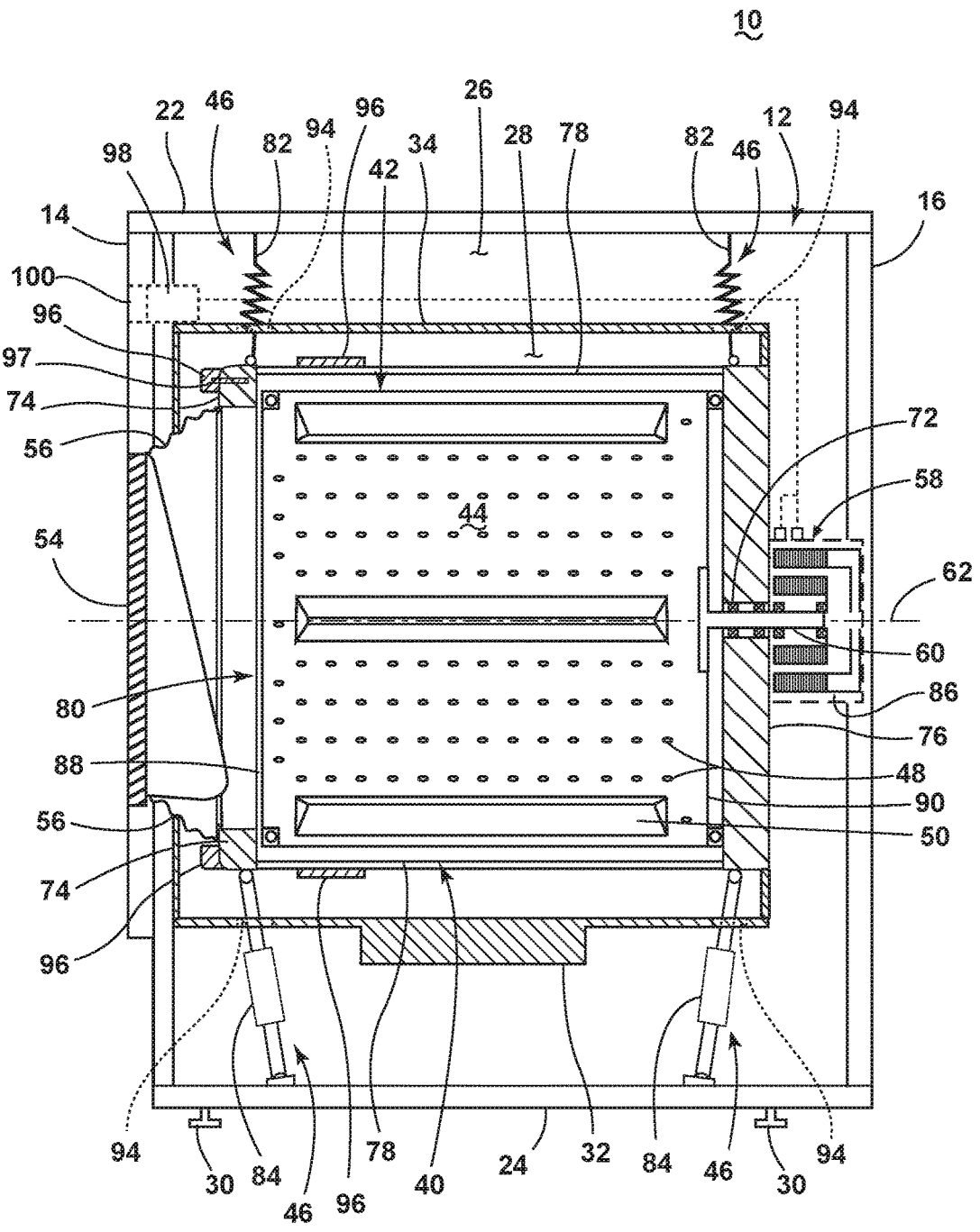
FIG. 1 is a schematic, sectional view of a laundry treating appliance in the form of a horizontal axis washing machine with a static tub and a dynamic exoskeleton housing a drum.

FIG. 1 is a schematic view of a laundry treating appliance. The laundry treating appliance can be any appliance, which performs a cycle of operation to clean, or otherwise treat items placed therein, non-limiting examples of which include a horizontal axis clothes washer; a clothes dryer; a combination washer and dryer; a tumbling or stationary refreshing/revitalizing machine; an extractor; a non-aqueous washing apparatus; and a revitalizing machine.

As used herein, the "horizontal axis" washing machine refers to a washing machine having a rotatable drum, perforated or imperforate, that holds fabric items and washes the fabric items by the fabric items rubbing against one another as the drum rotates. In some horizontal axis washing machines, the drum rotates about a horizontal axis generally parallel to a surface that supports the washing machine. However, the rotational axis need not be horizontal. The drum can rotate about an axis inclined or declined relative to the horizontal axis. In horizontal axis washing machines, the clothes are lifted by the rotating drum and then fall in response to gravity to form a tumbling action. Mechanical energy is imparted to the clothes by the tumbling action formed by the repeated lifting and dropping of the clothes.

Additionally, as used herein, the term "dynamic," when referring to a tub or an exoskeleton, means that movement of the tub, exoskeleton, or both, as the case may be, is permitted relative to the other structures to which it mounts. Such movement can further be dampened by a suspension coupled to the "dynamic" structure.

Furthermore, as used herein, the term "static," when referring to a tub or an exoskeleton, means that the tub or exoskeleton is fixed to the tub, exoskeleton, chassis, or otherwise as the case may be, and that the movement of the tub or exoskeleton is resisted such that the tub or exoskeleton is not free to dynamically move during a cycle of operation.

In FIG. 1, the laundry treating appliance is illustrated as a washing machine 10, which can include a structural support system comprising a chassis 12 in the form of a frame that can be used to support additional components of the washing machine 10. For example, the chassis 12 can be coupled or integrally formed with panels comprising a front wall 14, a rear wall 16, opposing sidewalls (not shown), an upper wall 22, and a bottom wall 24, which together can form a cabinet enclosing the internal components of the washing machine 10. The bottom wall 24 can further comprise feet 30 supporting the chassis 12 on an underneath surface such as the floor. The panel walls 14, 16, 22, and 24 can be coupled with the chassis 12 using any suitable mechanical or non-mechanical fastener or combination of fasteners, non-limiting examples of which include bolts, screws, snap-fit fasteners, clips, clamps, adhesives, or welds. If the washing machine 10 is a built-in appliance such that cabinetry, walls, paneling or furniture at the installation site encompasses one or more sides of the washing machine 10, one or more of the walls 14, 16, 22, and 24 can be excluded. The chassis 12, and optionally the panel walls 14, 16, 22, and 24, can define an interior 26 enclosing components typically found in a conventional washing machine, such as motors, pumps, fluid lines, controls, sensors, transducers, and the like.

A liquid container in the form of a tub 34 with a sump assembly 32 is disposed within the chassis 12. The tub 34 is imperforate and comprises a three-dimensional container with top, bottom, front, rear, and sidewalls to define a liquid chamber 28, with the tub 34 being supported by and statically mounted to the chassis 12. Alternatively, the tub 34 can be at least partially mounted to the front wall 14 and the opposing sidewalls or can be integrally formed with the opposing sidewalls. By statically mounted, it is meant that the tub 34 is not suspended from the chassis 12 with a suspension system typical to common tub implementations. The tub 34 is, thus, statically located relative to the chassis 12. Such a mount configuration provides for the tub 34 to be mounted directly to the chassis 12 and/or the walls. In addition, portions of the chassis 12 and walls can function as part of the tub 34. A statically mounted tub 34 provides for the tub to have a maximum size permitted for the space available within the chassis 12 as there is no need to provide space between the chassis 12 and tub 34 for a suspension system. The tub 34 can further include one or more apertures defining suspension openings 94 between the interior 26 and the liquid chamber 28.

A laundry holding assembly is disposed at least partially within the liquid chamber 28 and is defined by an exoskeleton 40, a drum 42 provided within the exoskeleton 40, and a laundry treating chamber 44 at least partially defined by the drum 42. The exoskeleton 40 physically supports the drum 42. A suspension 46 extends between the exoskeleton 40 and the chassis 12 and dynamically suspends the exoskeleton 40 to the chassis 12. As the drum 42 is mounted to the exoskeleton 40, the suspension 46 indirectly provides suspension for the drum 42. The suspension 46 is configured to reduce the movement and vibration of the laundry holding assembly during a cycle of operation.

The exoskeleton 40 further comprises a front support 74, a rear drive plate 76, and at least two braces 78 extending between the front support 74 and rear drive plate 76. The front support 74 includes a body forming a substantially annular ring having a central opening 80 to provide access to the drum 42. The rear drive plate 76 forms a substantially annular disc and can have a bearing mount 72 defining a shaft passage for receiving a drive shaft 60 and a motor mount 86 formed on the rear side of the rear drive plate 76. The braces 78 comprise an elongated structure that forms a cross support between the front support 74 and rear drive plate 76 to rigidly connect the front support 74 to the rear drive plate 76. The braces 78 can be attached to the front support 74 and rear drive plate 76 by commonly known fastening devices or fastening methods well known in the art including but not limited to screws, rivets, clamps, and welds. Alternatively, the front support 74, rear drive plate 76, and braces 78 can be integrally formed. The front support 74 provides a load path between the braces and provides for mounting provisions such as the braces, as well as suspension, dampers, front bellows, or counterweights, as described herein. As such, the front support 74 enables modularity in the exoskeleton design, as well as provisions for attachment within a tub system utilizing the static, fixed tub.

The drum 42 is mounted within the exoskeleton 40 such that the front support 74 is located adjacent to a front drum wall 88 and at least a portion of the front support 74 is axially in front of an open front of the drum 42 on the front drum wall 88. The rear drive plate 76 is located adjacent a rear drum wall 90 wherein at least a portion of the rear drive plate 76 is axially behind of the rear drum wall 90. The drum 42 can be rotatably mounted to the rear drive plate 76 through the bearing mount 72, which can comprise a friction-reducing surface or friction reducing devices such as ball bearings, for example, and is configured to aid in rotation of the drive shaft 60 by reducing friction between the drive shaft 60 and the rear drive plate 76. The braces 78 extend between the front support 74 and rear drive plate 76 and are located around the drum 42, exterior to the treating chamber 44.

The drum 42 can include a plurality of perforations 48 such that liquid can flow between the tub 34 and the drum 42 through the perforations 48. A plurality of lifters 50 can be disposed on an inner surface of the drum 42 to lift the laundry load received in the treating chamber 44 while the drum 42 rotates.

The suspension 46 can comprise at least two springs 82 and at least two struts or dampers 84 attached to the front support 74 at a spring mount and rear drive plate 76 of the exoskeleton 40. As illustrated, two springs 82 are attached to the upper portion of both the front support 74 and rear drive plate 76 and two dampers 84 attached to the lower portion of both the front support 74, at a damper mount, and rear drive plate 76, however as many as four springs 82 and six dampers 84 can be utilized. Alternatively, the springs 82 and dampers 84 can attach to the braces 78 or a combination of the front support 74, rear drive plate 76 and braces 78. The suspension openings 94 are aligned with the suspension system 46 such that the springs 82 and dampers 84 pass through the suspension openings 94 to couple the exoskeleton 40 to the chassis 12.

The laundry holding assembly can further include a door 54 that can be movably mounted to the chassis 12 to selectively close the drum 42 or access the laundry treating chamber 44. A bellows 56 can couple a front opening in the exoskeleton 40 with the chassis 12, with the door 54 sealing against the bellows 56 when the door 54 closes the drum 42.

The washing machine 10 can include a drive system for rotating the drum 42. The drive system can include an electric motor 58, physically supported by the rear drive plate 76, coupled with the drum 42 through the drive shaft 60 to rotate the drum 42 about a longitudinal axis of rotation 62 during a cycle of operation. The motor 58 can rotate the drum 42 at various speeds in either rotational direction. The motor 58 can be a brushless permanent magnet (BPM) motor having a stator and a rotor. Alternately, the motor 58 can be coupled to the drum 42 through a belt and a drive shaft to rotate the drum 42, as is known in the art. Other motors, such as an induction motor or a permanent split capacitor (PSC) motor, can also be used.

The washing machine 10 can also include at least one counterweight 96 provided on the exoskeleton 40. The counterweight 96 can be coupled with the front support 74 or can be integrally formed with the front support 74. Additionally, the front support 74 can include a feature for coupling the counterweight 96, such as an extension rod 97 for inserting the counterweight 96. Furthermore, the counterweights 96 can be disposed between or among the braces 78. The density of the front support 74 or braces can also be configured such that the components function as a counterweight 96.

The washing machine 10 can further comprise a controller 98. The controller 98 can be communicatively coupled to one or more elements within the washing machine 10 such that the controller 98 can selectively operate those elements. The controller 98 can be coupled to a user interface 100 allowing a user to select a cycle of operation.

The washing machine 10 disclosed herein provides a plurality of benefits including that the size of the drum 42 can be maximized to increase washing capacity of the treating chamber 44 within the drum 42 without increasing a size of the chassis 12 or cabinet. This is achieved by statically mounting the tub 34 while dynamically supporting the drum 42 via the exoskeleton 40 and allowing the suspension 46 to extend through the tub between the exoskeleton 40 and the chassis 12. Statically mounting the tub 34 to the chassis 12 eliminates the clearance needed between the traditional dynamic tubs that are suspended to the chassis 12. Extending the suspension 46 through the tub 34 minimizes the space needed between the tub 34 and the chassis 12 to house the suspension 46. Supporting the drum-generated forces with the exoskeleton 40 allows the tub 34 to function solely as a liquid retainer and not as a structural support for the drum 42, which also allows the tub 34 wall thickness to be reduced. Eliminating clearances needed between the tub 34 and the chassis 12 minimizes interior space needed to house the suspension 46, and reducing the tub 34 wall thickness allow for a larger drum 42 with increase washing capacity without increasing a size of the chassis 12 or cabinet.

Figure 2:
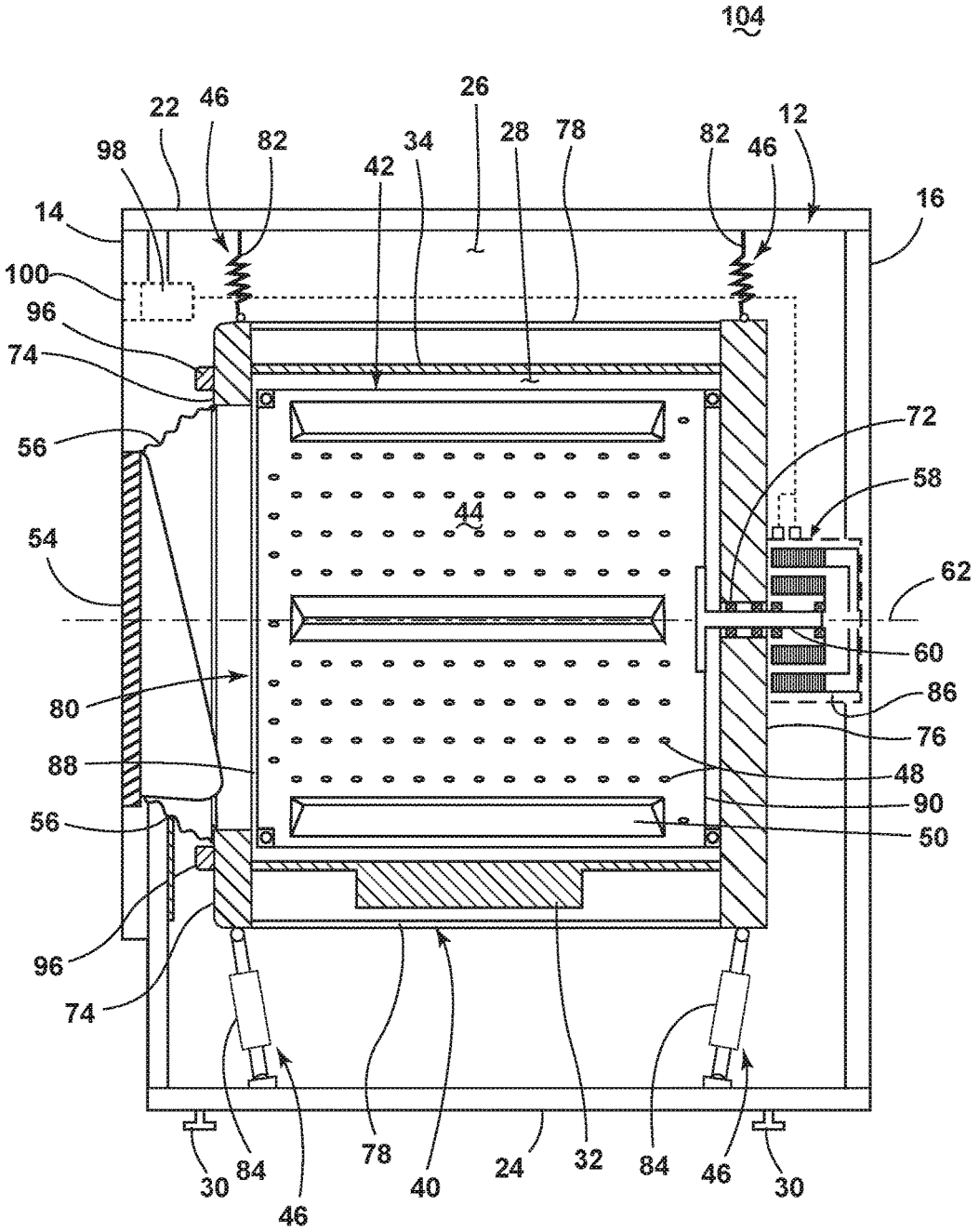
FIG. 2 is a schematic, sectional view of the laundry treating appliance comprising a dynamic tub with an exoskeleton mounted to the dynamic tub.

Turning now to FIG. 2, a washing machine 104 comprises substantially similar elements to the washing machine 10 of FIG. 1, and like elements will be referred to with similar numerals. The washing machine 104 differs from that of FIG. 1 in that the tub 34 is dynamically, not statically, mounted to the chassis 12. In this configuration, the tub 34 mounts to the exoskeleton 40. The springs 82 suspend the tub 34 from the chassis 12 at the exoskeleton 40, while the dampers 84 extend between a bottom of the exoskeleton 40 and the chassis 12. Alternatively, the tub 34 can be suspended from the chassis 12 directly, coupling to the springs 82 and the dampers 84. As such, the tub is dynamically suspended from the chassis 12 either directly or via the exoskeleton 40. The exoskeleton 40 supports the tub 34 and provides for increased structural integrity for the dynamic tub.

The washing machine of FIG. 2 provides a plurality of benefits including that the size of the drum 42 can be maximized to increase washing capacity. The capacity can be maximized by utilizing the exoskeleton 40 to provide increase structural integrity to the tub 34, allowing for the use of a thinner-wall tub 34 or a single structure tub 34, as compared to typical two-part tubs. Additionally, the weld flange common to typical 2-part tubs is eliminated, increasing clearance space between the tub 40 and the chassis 12 or exoskeleton 40, permitting increased tub capacity.

FIGS. 3-41 include aspects of the invention that can be implemented with the tub 34 and exoskeleton 40 structures of the washing machines of FIG. 1 or 2 described above. As such, similar numerals can be used throughout to describe similar elements.

Figure 3:
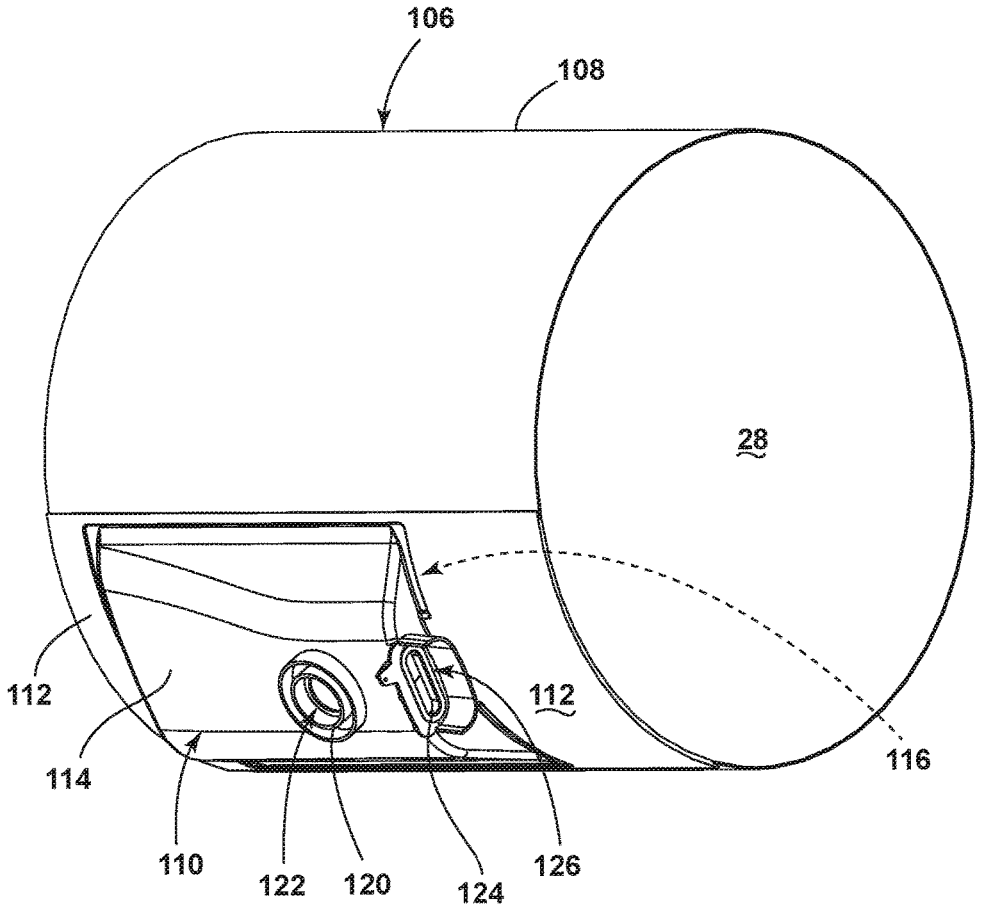
FIG. 3 is a perspective view of a tub comprising a rolled, extruded sheet in combination with a pre-formed sump assembly.

Turning to FIG. 3, a tub 106 is shown formed from an extruded sheet 108. The extruded sheet 108 can be folded or rolled into an annular shape to comprise at least a portion of the tub 106. Such an annular length of material, for example can form a cylinder. However, it should be understood that the annular length can include any rounded shape, such as having a circular profile, an elliptical profile, an egg-shaped profile, a racetrack-shaped profile, or any combination thereof in non-limiting examples. The egg-shaped profile can include an elliptical shape with one end including a larger radius of curvature than the other, or with one end including a larger radius than the next. The racetrack-shaped profile can include equivalently shaped rounded edges spaced by straight portions of sidewalls of the profile of the annular shape. The final rolled form can partially form a complete cylinder, leaving remaining space for the insertion of a sump assembly 110. The extruded sheet 108 can be formed by any extrusion process known in the art, and can be cut to length per the particular washing machine. The sump assembly 110, comprising a sump wall 112 and a sump recess 114, further forms the remaining annular portion of the tub 106, coupling to the extruded sheet 108 such that the combination of the extruded sheet 108 and the sump assembly 110 collectively define the liquid chamber 28. The sump recess 114 defines a drain space 116 for accepting liquid from the liquid chamber 28. A drain conduit 120 defining a drain opening 122 and a heater conduit 124 defining a heater opening 126 extend from the sump recess 114. The drain conduit 120 provides for both draining and recirculation of liquid from the treating chamber 44, while the heater conduit 124 can be used to provide a heater for heating liquid within the tub 106 or washing machine.

Figure 4A:
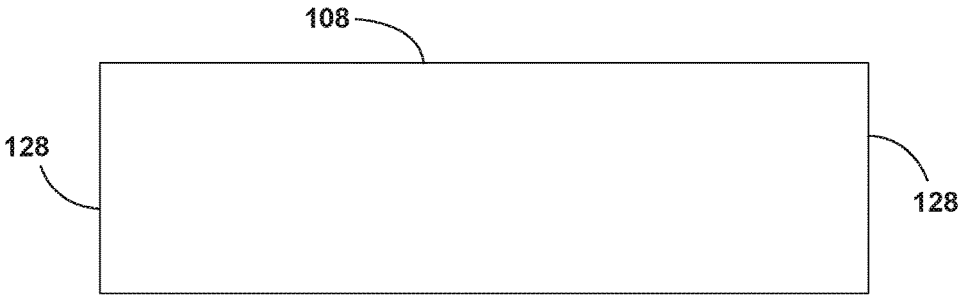
FIG. 4A is a top view of the extruded sheet of FIG. 3 prior to rolling into the tub.
Figure 4B:
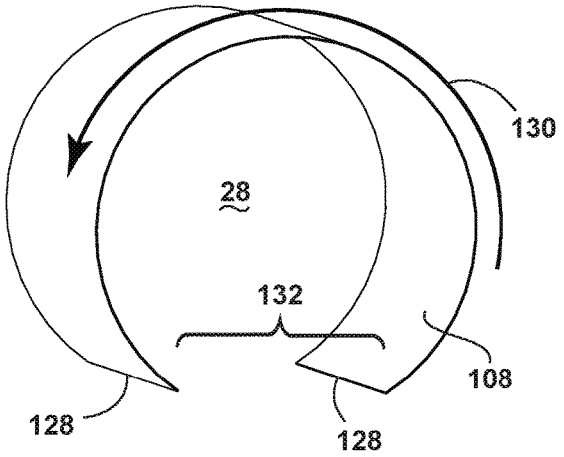
FIG. 4B is a perspective view of the rolling of the extruded sheet of FIG. 4A defining a gap between the ends.
Figure 4C:
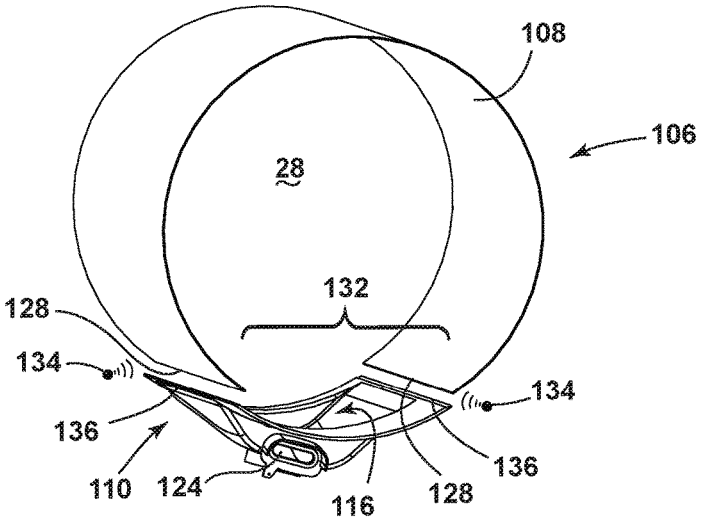
FIG. 4C is a front view of the rolled extruded sheet with a sump assembly being installed into the gap of FIG. 4B.

Turning to FIGS. 4A-4C, the method of forming the tub 106 utilizing an extruded sheet 108 is described. In FIG. 4A, the extruded sheet 108 can be manufactured such that the extruded sheet 108 can be easily cut to a desired size, such that the cut defines opposing sheet ends 128. The extruded sheet 108 can comprise any standard extrusion material, such as plastics, polymers, or metals in non-limiting examples and can be made by any extrusion process such as, but not limited to, direct extrusion.

In FIG. 4B, the extruded sheet 108 is folded or rolled as illustrated by a rolling direction 130, forming a portion of a cylinder to partially define the liquid chamber 28, while leaving a sheet gap 132 between the sheet ends 128. In one example, the extruded sheet 108 can be placed on a mandrel and wrapped around the mandrel to form the desired cylindrical shape, while any shaping process is contemplated.

In FIG. 4C, the sump assembly 110, further comprising sump sides 136, attaches to the sheet ends 128 at the sump sides 136 within the sheet gap 132. A sonic welder 134 can be utilized to sonically weld the sump sides 136 to the extruded sheet 108, while any standard method of attachment, such as heat welding, ultrasonic welding, hot plate welding, infra-red welding, vibration welding, fastening, adhesives, or otherwise can be used in non-limiting examples. In the example utilizing a mandrel, the sump assembly 110 can be attached to the bottom of the mandrel where it can be welded, or otherwise attached, to the extruded sheet 108 at the sheet ends 128 as the extruded sheet 108 is rolled.

Alternatively, the extruded sheet 108 can be rolled or folded to comprise a full cylinder, attaching the sheet ends 128 together. The sheet ends 128 can be welded at the top of the tub 106, to prevent any possible water leakage at the weld seam from liquid flowing toward the bottom of the liquid chamber 28 if the weld seam were alternatively located toward the bottom. The sump assembly 110 can then be thermoformed into the cylinder. Alternatively, the sump assembly 110 can be thermoformed prior to rolling of the extruded sheet 108.

Utilizing an extruded sheet 108 to form a tub 106 increases capacity for the washing machine over the traditional injection molded tub. An extruded sheet 108 eliminates the tub weld flange and draft angles required in standard injection-molded, two-part, vertical-seam tub configurations, gaining a potential eight to fourteen millimeters (mm) of radial space, which can be added to the radial capacity of the drum 42. Furthermore, extruded sheets 108 can be easily manufactured and are inexpensive, reducing the overall cost of the washing machine while increasing capacity. Further still, the tub 106 formed from the extruded sheet 108 can comprise a decreased thickness, providing for additional tub capacity permitting increased drum capacity.

Furthermore, the extruded sheet 108 can be wrapped to form a complete cylinder shape. A hole can be punched in the cylinder or the extruded sheet 108 prior to wrapping, and then the sump assembly 110 can be welded into the punched out space.

Figure 5:
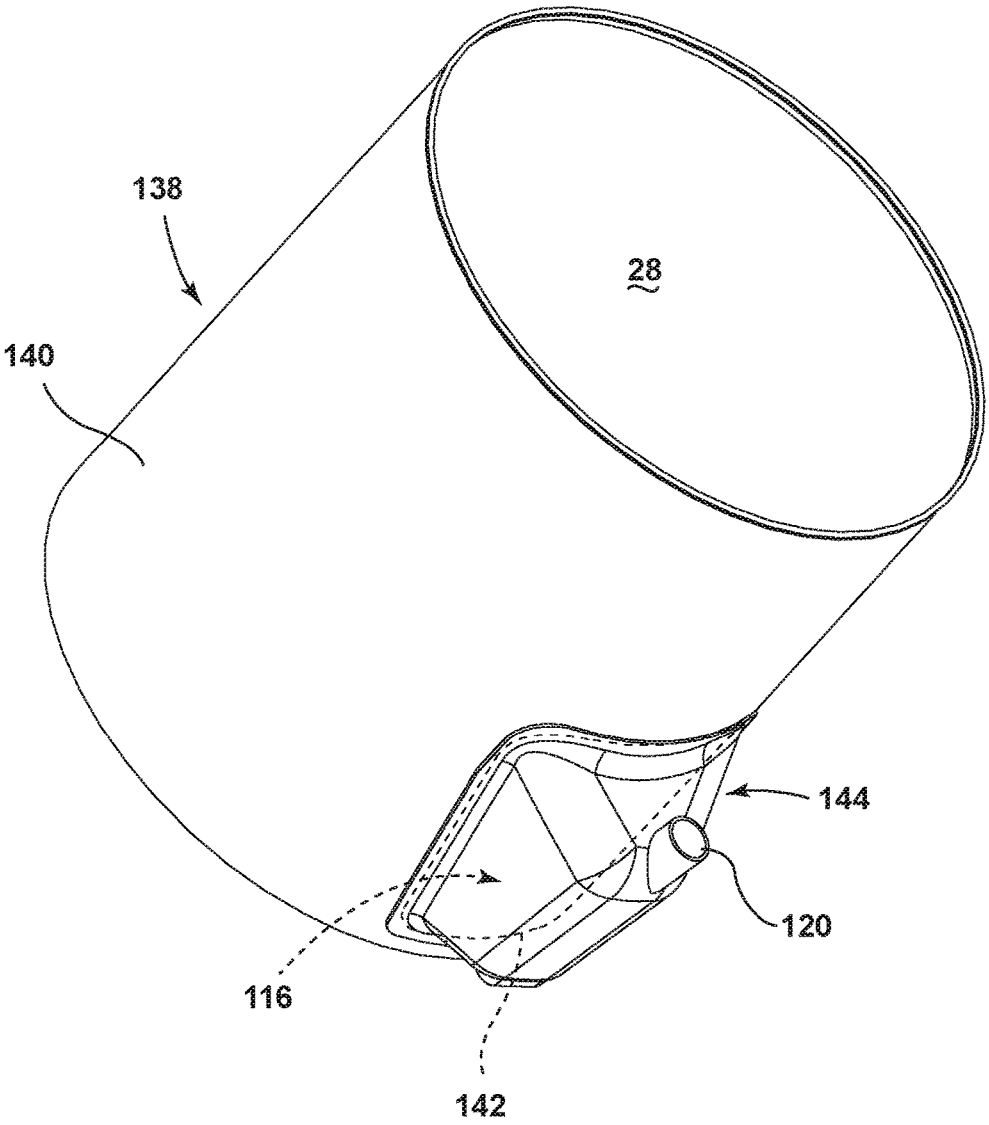
FIG. 5 is a perspective view of an extruded cylinder, as compared to an extruded sheet of FIGS. 4A-4C, with an installed sump assembly to form a tub.

Turning now to FIG. 5, a tub 138 is shown comprising an extruded cylinder 140 defining the liquid chamber 28. The extruded cylinder 140 can comprise a sump aperture 142 within the side of the extruded cylinder 140 with a sump assembly 144 mounted within the sump aperture 142. The sump assembly 144 can comprise standard sump elements such as a drain space 116 and a drain conduit 120. The extruded cylinder can be formed by any extrusion method, such as but not limited to, direct extrusion, and can comprise common extrusion materials such as plastics, polymers, or metals in non-limiting examples.

Figure 6A:
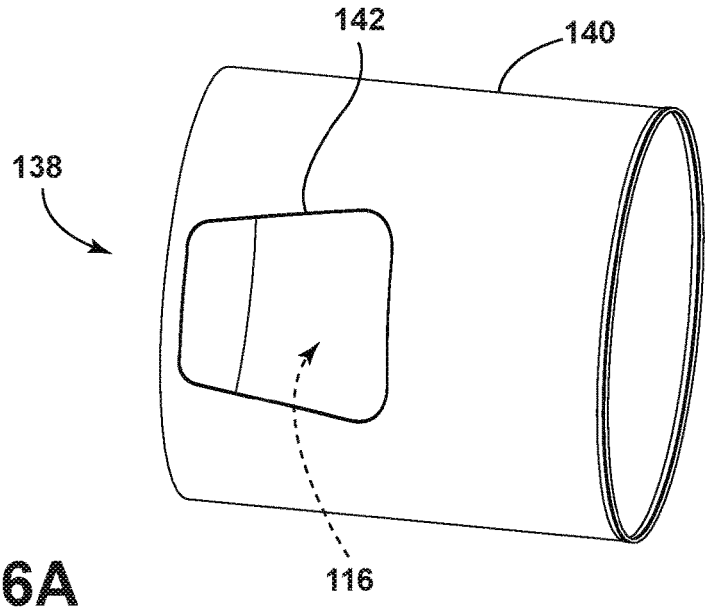
FIG. 6A is a bottom perspective view of the extruded cylinder of FIG. 5 with a sump aperture punched in the side of the cylinder.
Figure 6B:
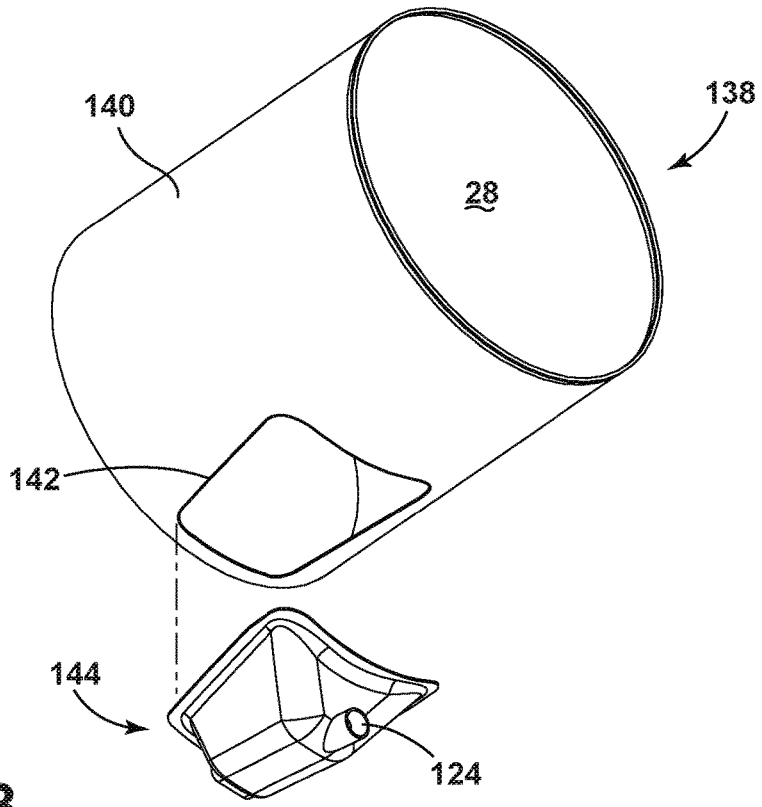
FIG. 6B is a front perspective view of the sump assembly being installed in the sump aperture of the cylinder of FIG. 6A.

Turning to FIGS. 6A-6B, the method of assembling the tub 138 comprising the extruded cylinder 140 is described. In FIG. 6A, the extruded cylinder 140 can be cut to a desired length as appropriate for the particular washing machine. The drain space 116 can be punched, cut, or machine stamped, as is known in the art, creating the sump aperture 142 in the extruded cylinder 140. In FIG. 6B the sump assembly 144 can be welded into the sump aperture 142, or any other attachment method such as fastening, sealing the liquid chamber 28 at the sump aperture 142.

Alternatively, the sump assembly 144 can be formed within the extruded cylinder 140, for example, by thermoforming. As such, the need to cut the sump aperture 142 within the extruded cylinder 140 is eliminated. Furthermore, the sump weld flange can be made on the outer surface of the extruded cylinder 140. Welding on the outer surface prevents a ledge or lip, which can form within the tub, such that water or debris within the tub does not have to travel over the lip before removal through the sump assembly 144.

As can be appreciated, utilizing an extruded cylinder 140 to form a tub 138 increases capacity for the washing machine. An extruded cylinder 140 eliminates the tub weld flange and draft angles utilized in standard two-part, vertical-seam tub configurations, gaining a potential eight to fourteen mm, or more, of radial space, similar to that of the extruded sheet 108 in FIGS. 3 and 4A-4C. Additionally, the extruded cylinder 140 eliminates the seam created from attaching the ends together or to a sump assembly 144, as with the extruded sheet 108. Furthermore, the extruded cylinder 140 can comprise walls having a reduced thickness, creating increased tub capacity permitting increased drum capacity.

Figure 7:
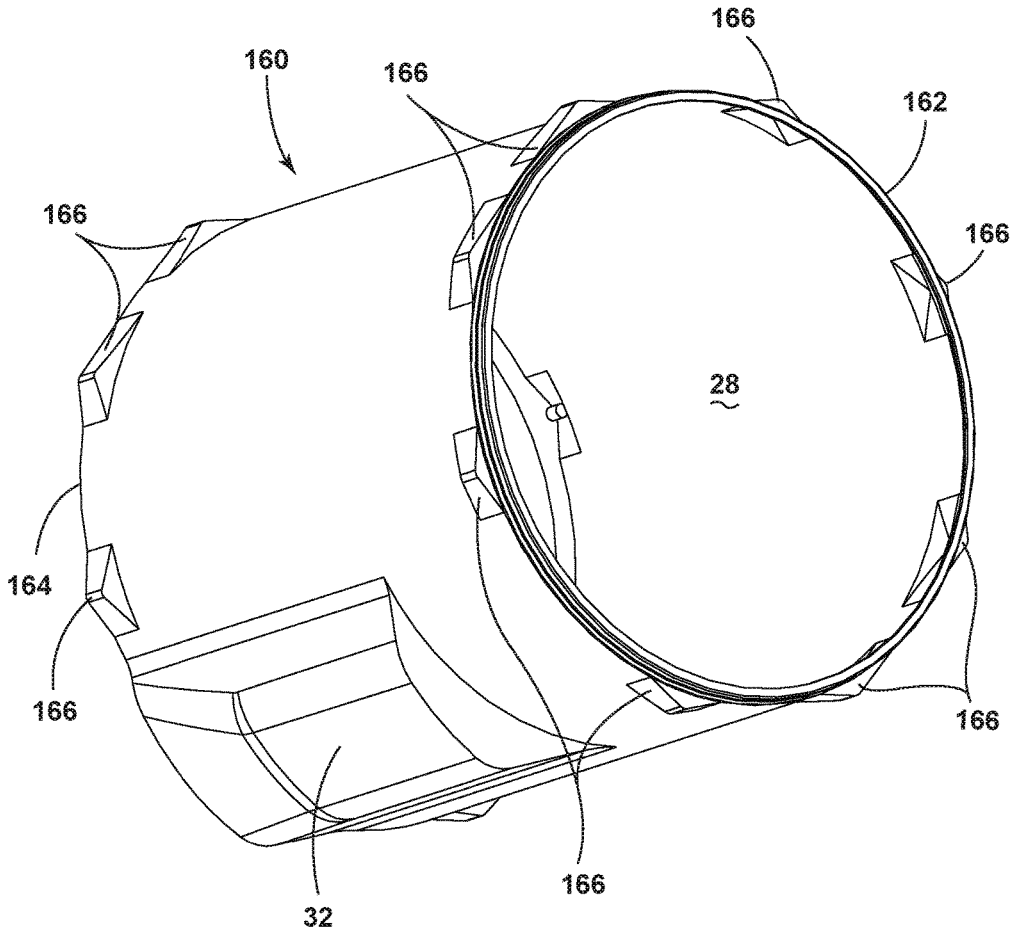
FIG. 7 is a perspective view of a blow-molded tub having a sump assembly and a plurality of fastener locations.

In FIG. 7, a blow-molded tub 160 is shown. The blow-molded tub 160 can be made from either glass-filled or non-glass filled polypropylene, or any other suitable material. The blow-molded tub 160 is formed with an open front end 162 and a closed rear end 164, and a sump assembly 32, which can comprise any sump assembly 32 known in the art or disclosed herein. The blow-molded tub 160 further comprises a plurality of fastener locations 166 molded at the front and rear ends 162, 164, and can be disposed at a tangent line of a tub radius, defined from a longitudinal axis from the front end 162 to the rear end 164. The fastener locations 166 are shown as having a triangular profile, however any shape can be implemented. The fastener locations 166 can comprise additional structures for mounting components, such as one or more braces, drives, supports, suspensions, the drive shaft 60, the exoskeleton 40, the chassis 12, the drum 42, or any other structure that can mount to the blow-molded tub 160, in non-limiting examples.

Figure 8A:
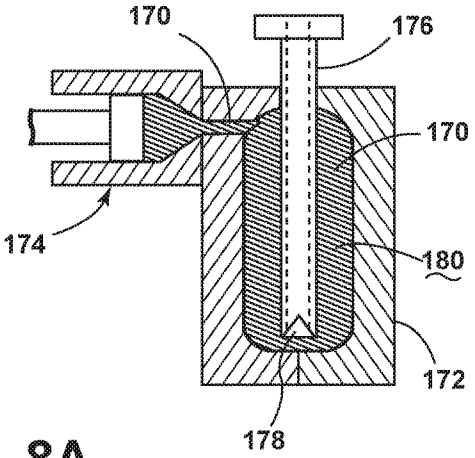
FIGS. 8A-8D are four steps of blow molding the blow-molded tub of FIG. 7.
Figure 8B:
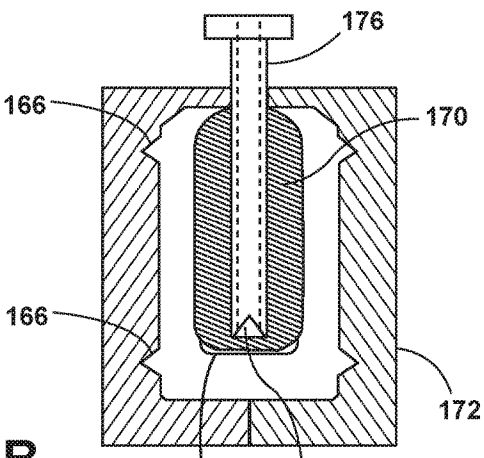

FIGS. 8A-8D show the schematics of one blow molding method utilizing injection blow-molding to form the blow-molded tub 160. In FIG. 8A, a softened forming material 170, such as polypropylene, can be injected into an injection mold 172 by an injection unit 174. A blowing rod 176 is inserted into the injection mold 172 with a one-way valve 178 at the bottom, defining an injection area 180 between the injection mold 172 and the blowing rod 176. After a sufficient volume of forming material 170 is injected into the injection area 180. Alternatively, a preform can be installed around the blowing rod 176 rather than injecting the forming material 170, eliminating the need for an injection unit 174. The injection mold 172 is removed and replaced by a blow mold 182, best seen in FIG. 8B. As can be appreciated, the blow mold 182 is shaped to create the blow-molded tub 160 comprising the fastener locations 166 as well as the sump assembly 32.

Figure 8C:
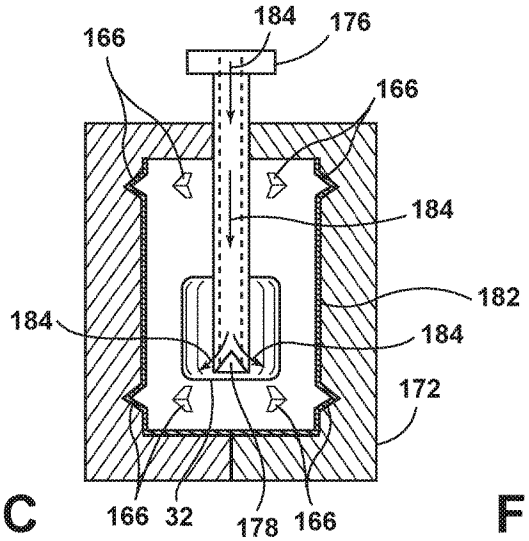
Figure 8D:
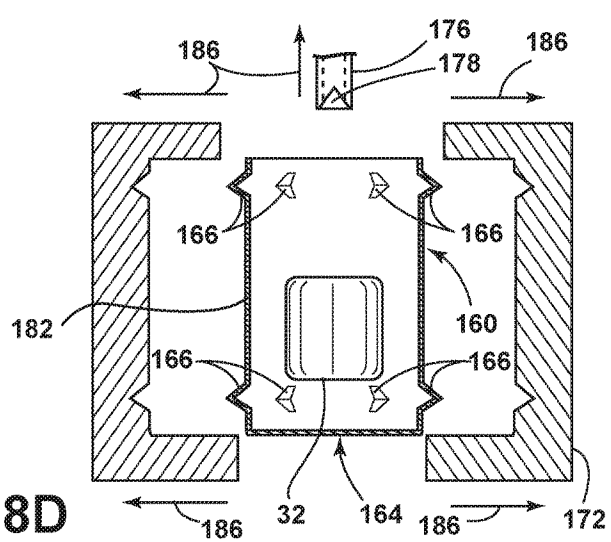

At FIG. 8C, air is blown through the blowing rod 176 and out through the one-way valve 178, as illustrated by an airflow 184. The forming material 170, still softened, expands with the blown air until it contacts the blow mold 182, forming the shape of the blow-molded tub 160, including the fastener locations 166 and the sump assembly 32. At FIG. 8D, the blow mold 182 is opened and the blowing rod 176 is removed as shown by removal arrows 186. The completed blow-molded tub 160 can be removed and utilized.

In an alternative method, an extrusion blow molding method utilizing a tube die and blow pin assembly, the preform, or any other blow molding process known in the art can form the blow-molded tub 160.

As can be appreciated, a blow-molded tub 160 can be used in creating a one-piece tub to gain capacity. This eliminates the welding flange and draft angles used in a standard injection-molded, two-piece, vertical-seam tub, increasing capacity potential. Additionally, the blow-molded tub 160 provides increased water protection to the drive, which permits the use of a less expensive drive without worry for the life of the drive through potential water damage. Additionally, the sump assembly 32 is formed as part of the blow-molded tub 160, preventing any possible water from leaking around the sump assembly 32 where a welded sump assembly 32 in traditional dynamic tubs can leak.

Figure 9A:
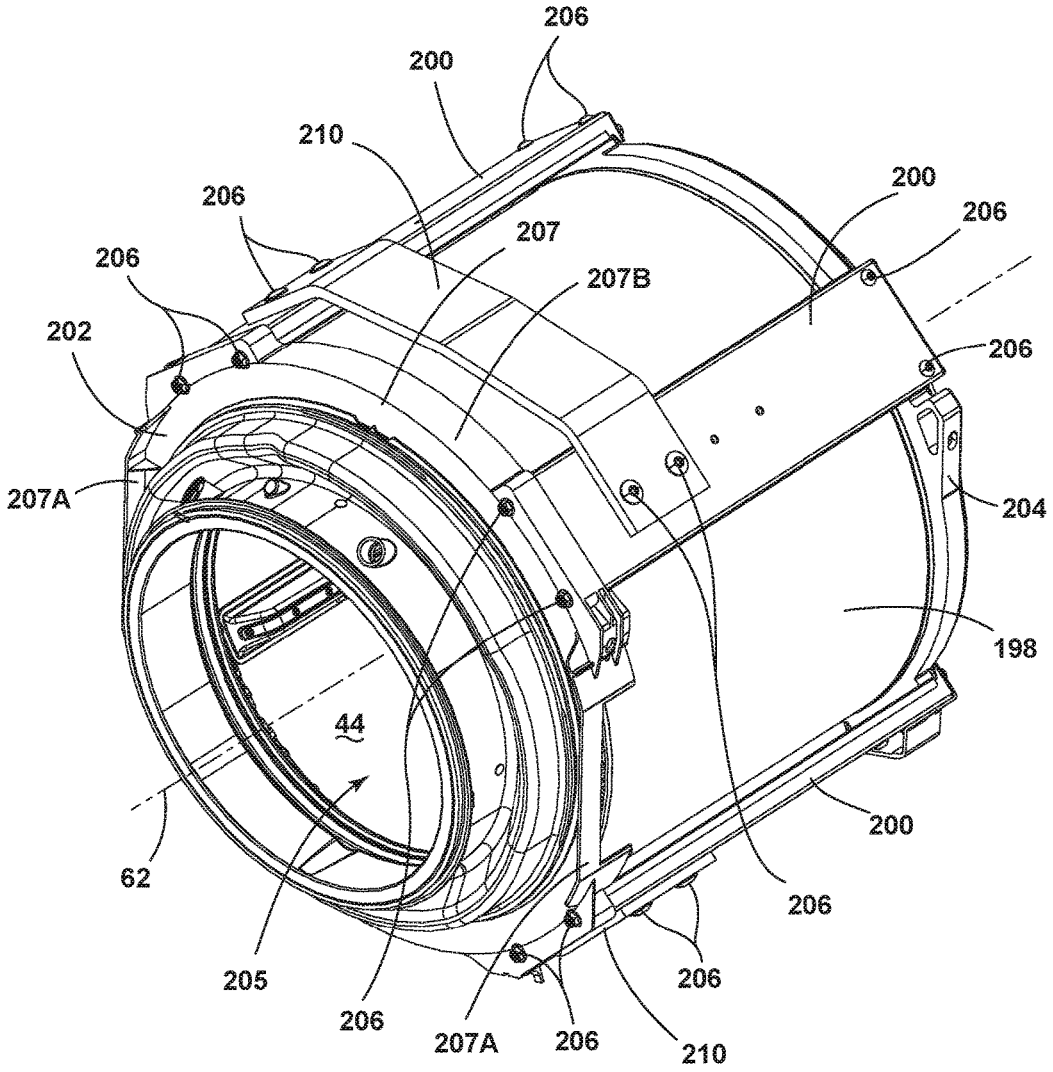
FIG. 9A is a side perspective view of a plurality of braces mounted to the rear drive plate and a front support.
Figure 9B:
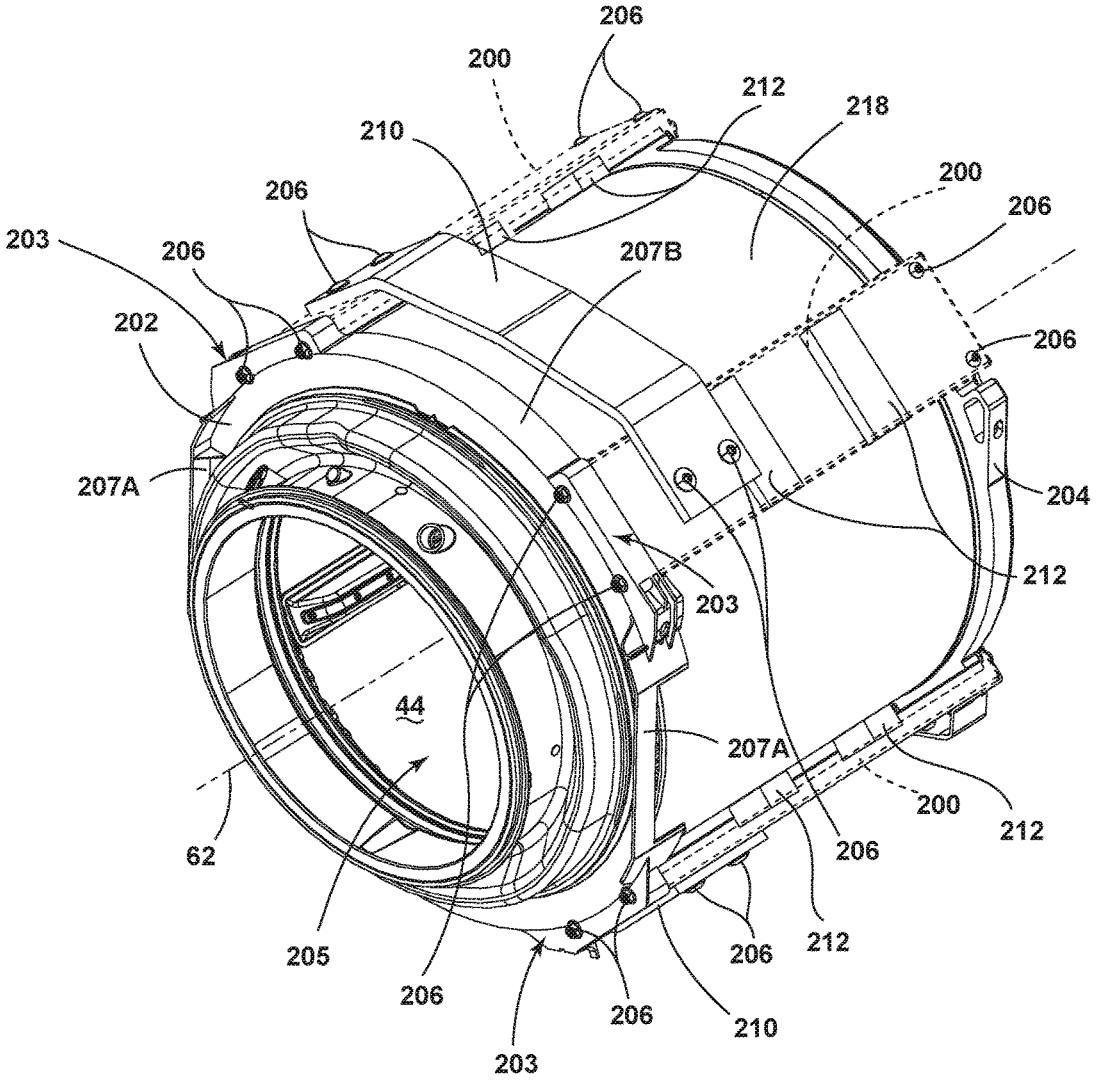
FIG. 9B is a perspective view of FIG. 9A having a plurality of fins disposed between the braces and a tub.
Figure 9C:
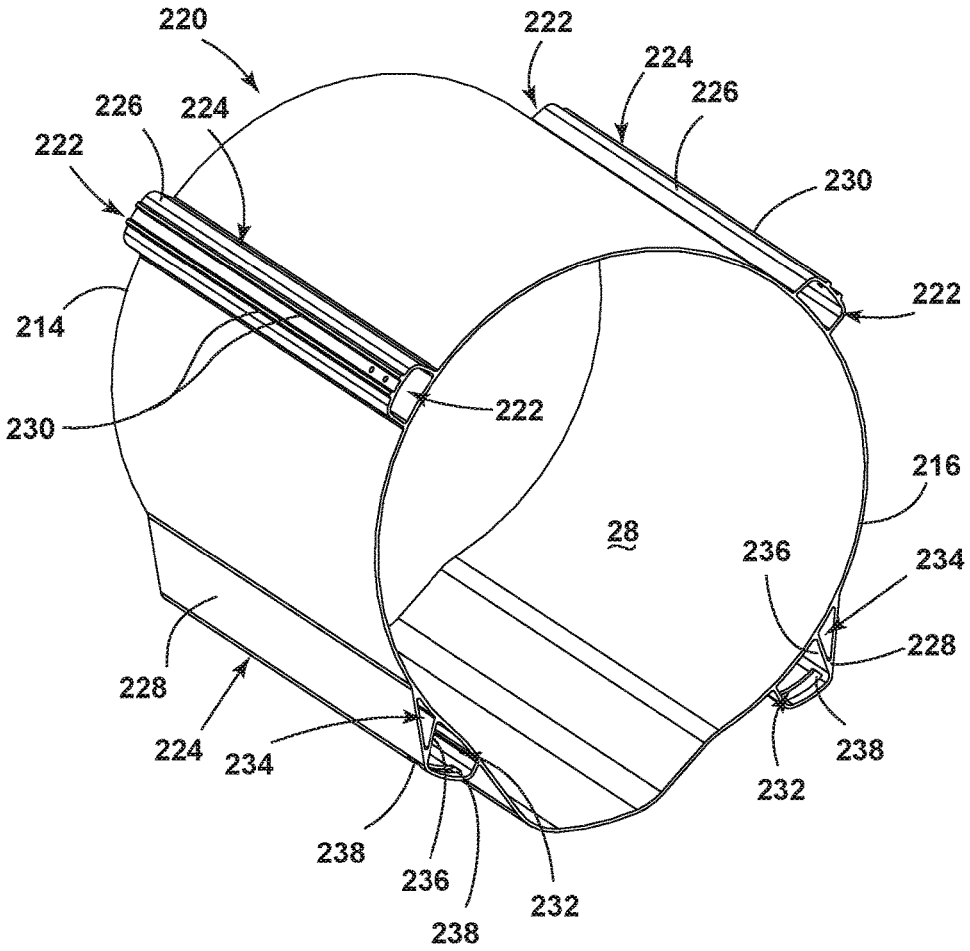
FIG. 9C is a perspective view of the tub having a plurality of channels providing a mounting surface for the braces.

FIGS. 9A-9C show three separate methods in which a plurality of braces 200, which can comprise the braces 78 of FIGS. 1 and 2, are mounted to the exoskeleton 40. In FIG. 9A, the braces 200 can mount to a front support 202, and an annular rear drive plate 204, which can comprise the rear drive plate 76 of FIGS. 1 and 2. A container 198, which can comprise a tub or drum as illustrated in FIGS. 1 and 2 respectively, is mounted to the front support 202, such as the front support 74 of FIG. 1 or 2, and the rear drive plate 204 radially within the confines of the braces 200 and spaced from the container 198. The front support 202, which can be part of the exoskeleton as described herein, includes brace mounts 203, which are nested in the corners of the front support 202, or arranged to nest in the direction of the corners of the chassis surrounding the washing machine. Such arrangement or nesting can minimize capacity consumption by the braces 200, minimizing adverse effects on capacity. The front support 202 defines an opening 205 providing access to the interior of the container 198. The braces 200 mount to the front support 202, utilizing one or more fasteners 206, such that the fasteners 206 extend through the front support 202 and into the end of the brace 200 in a direction substantially parallel to the longitudinal direction of the brace 200. Opposite of the front support 202, the braces 200 mount to the drive plate 204. The fasteners 206 extend radially through the brace 200 and into the rear drive plate 204 in a direction perpendicular to, parallel to, or both, with regard to the longitudinal axis of rotation 62. The fasteners 206 as shown are exemplary and can be any suitable type of fastener. The fasteners 206 can couple the braces 200 to the drive plate 204 or the front support 202 in any manner or direction, whether longitudinally, axially, laterally, or otherwise relative to the longitudinal direction of the braces 200. The front support 202 includes a frame 207 including a flat portion 207A and an arcuate portion 207B. The frame 207 can include a cross-sectional thickness. The cross-sectional thickness of the arcuate portion 207B is greater than the cross-sectional thickness of the flat portions 207A. The flat portions 207A can be positioned to the sides of the front support 202, relative to a surface upon which the washing machine rests. Additionally, the arcuate portions 207B can be positioned relative to the upper and lower portions of the drum. The braces 200 can couple to the arcuate portions 207B. The flat portions 207A minimize the radial extend of the front support 202 near the sides of the tub, extending in a direction substantially perpendicular to the axis of rotation 62. The flat portion 207A can extend partially or fully between the brace mounts 203, for example. The flat portion 207A provides for increased potential capacity for the treating chamber 44 while providing the front support for the exoskeleton. As such, the front support 202 can be adapted to the exoskeleton structure around the drum 218 while maximizing the capacity of the treating chamber 44. It should be understood that while the front support 202 is used at the front of the washing machine, typically coupling to a rear drive plate via the exoskeleton, it is contemplated that the front support 202 can also be provided at the rear of the drum, or both the front and the rear of the drum. Additionally, a counterweight 210, which can comprise the counterweight 96 of FIG. 1, can mount between two or more braces 200.

In variations of the first method of mounting the braces 200, the braces 200 can comprise any shape, having differing profiles, such as circles, triangles, or quadrilaterals in non-limiting examples. Furthermore, the braces 200 can alternatively mount to the container 198, the front support 202, or the rear drive plate 204, or any combination thereof. Further still, the braces 200 can comprise any of the braces of FIGS. 11-21, discussed later in this description.

FIG. 9B, according to a second method of mounting braces 200, shows an internal structure 218, such as the drum of FIG. 1 or the tub of FIG. 2, having a plurality of fins 212 disposed between the outer surface of the internal structure 218 and the braces 200, the braces 200 being shown in phantom. The fins 212 can be mounted in-between the internal structure 218 and can mount to one or more of the internal structure 218 and the braces 200. Alternatively, the fins 212 can be integrally formed within the internal structure 218 or the braces 200. The internal structure 218 is shown as having two fins 212 disposed with each brace 200, however, any number of fins 212 can be disposed within the braces 200, or different numbers of fins 212 can be used with different braces 200 as is desired.

In an example where the internal structure 218 is a tub, the fins 212 can abut or mount to the tub, providing increased support for the internal structure 218 along the axial length of the internal structure 218 where the braces 200 can otherwise be spaced. In another example where the internal structure 218 is a drum, the fins 212 can be mounted to the braces 200, being spaced from the drum such that the drum is permitted to rotate during a cycle of operation and a frictional force is only imparted to the drum to minimize dynamic movement of the drum such as during an off-balance condition.

It should be appreciated that the fins 212 provide for increased structural integrity between the exoskeleton and the particular interior structure such as the tub. Additionally, the fins 212 can provide a dampening effect between the exoskeleton structure and the interior structure.

FIG. 9C shows a channeled tub 220 comprising a plurality of channels 222 defined by a plurality of channel members 224 for receiving the brace 200 inserted therein or mounting the brace 200 thereon. The channel members 224 can be formed integrally with the channeled tub 220, or can be mounted to the channeled tub 220, for example, by welding. While four channel members 224 are shown, any number of channels members 224 are contemplated. The channel members 224 can further comprise upper channel members 226 and lower channel members 228, disposed along the top and bottom of the channeled tub 220, respectively. The upper channel members 226 can comprise one or more ridges 230 disposed longitudinally along the upper channel members 226. The lower channel members 228 are formed as dual channels 222, comprising a main channel 232 and a secondary channel 234 such that the main and secondary channels 232, 234 are integral, having a shared wall 236 separating the channels 232, 234.

Additionally, the channels 222 can comprise one or more slots 238. The slots 238 comprise apertures, having any shape, used for mounting or snapping one or more braces 200 thereto, as well as decreasing channel member 224 weight while maintaining structural integrity. The slots 238 can be disposed longitudinally or laterally in relation to the longitudinal direction of the channel member 224, or in a diagonal orientation.

The channel members 224 can further comprise an elongated, substantially curvilinear cubic shape, such that a cross-section comprises a curvilinear rectangle, however, the channel members 224 can be any shape such that a cross-section comprises any shape such as a circle, square, triangle, unique, or any other shape or variation thereof.

Figure 10:
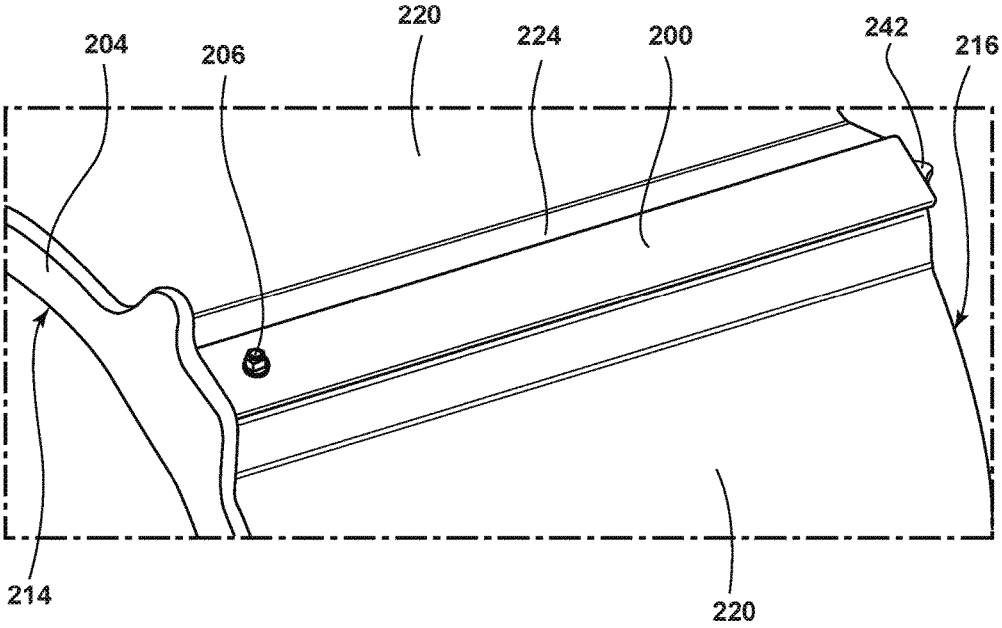
FIG. 10 is a close-up view of one brace mounted on the channel of FIG. 9C utilizing a snap member.

The braces 200 can be attached to a tub by multiple alternative methods, such as welding or mounting with fasteners in non-limiting examples. Additionally, the braces 200 can snap onto or slide into the channel 222 of the tub 220 of FIG. 9C. FIG. 10 shows one example in which a flat brace 200 can couple to the tub 220 utilizing a snap-fit. The brace 200 snaps to the front of the channel member 224 with a snap member 242 that hooks on to the end of the channel member 224 adjacent the front end 216. At the rear end 214 of the tub 220, one or more fasteners 206 can mount the brace 200 to the channel member 224 or the rear drive plate 204. Additionally, the end of the brace 200 adjacent to the rear end 214 can comprise a second snap member 242 attaching adjacent to the end of the channel member 224 opposite of the first snap member 242.

The channel members 224 or methods for mounting braces 200 are useful in increasing structural integrity of a tub. The tub implementation utilizing an exoskeleton 40 can utilize a thinner, lighter-weight tub, which can require additional stiffness to support the movement or vibrations of the washing machine when the drum rotational speed excites the washing machine natural frequency. As can be appreciated, utilizing braces 200 or channels members 224 with the tub can increase stiffness and structural integrity without affecting capacity.

In FIGS. 11-21, four braces are illustrated, which can be used to provide structural integrity to the exoskeleton 40 or the tub 34, are shown. As can be appreciated, the braces can be utilized with any of the tubs 34 or can mount to or comprise the exoskeleton braces 78 surrounding the drum 42. The braces can be utilized with both the fixed tub of FIG. 1 and the dynamic tub of FIG. 2. Therefore, the braces are contemplated in providing additional structural support to any implementation of a tub as described herein. The braces can be disposed between the front support 74, rear drive plate 76, or any combination thereof. The suspension 46 can further mount to the braces, or a combination of the braces and the other elements comprising the exoskeleton structure, as well as the tub. Additionally, the braces can attach to a rear drive plate, such as the two-part drive plate of FIGS. 27-32, described later herein. As the braces in FIGS. 11-21 are substantially similar, similar numerals will be used to describe similar elements among the braces.

Figure 11:
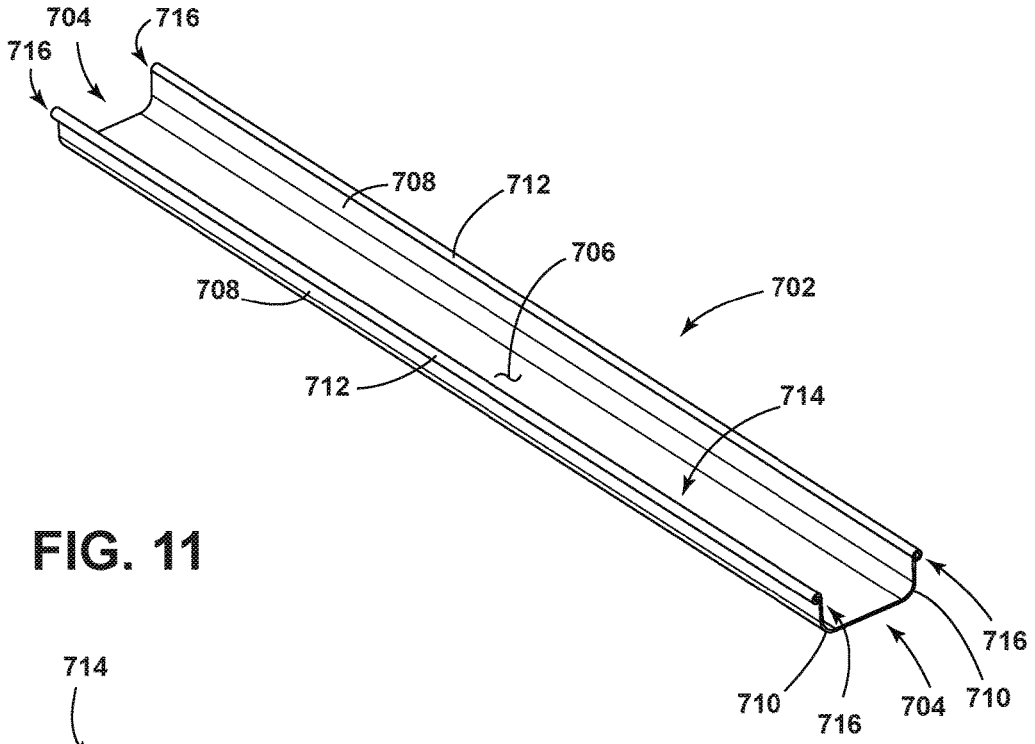
FIG. 11 is a top perspective view of a rolled U-channel brace.

In FIG. 11, a brace comprising a rolled U-channel brace 702 having an opened end 704 further comprises a bottom wall 706 attached to two sidewalls 708 at a curvilinear corner 710. The sidewalls 708, opposite of the bottom wall 706, terminate in a rolled edge 712. The rolled edge 712 is rolled outwardly from a brace channel 714 defined by the sidewalls 708 and the bottom wall 706. The rolled edges 712 roll around until they terminate against the outside surface of the sidewalls 708 relative to the brace channel 714. The rolled edges 712 further define a tunnel 716 extending longitudinally within the edges 712. Alternatively, the rolled edges 712 can be folded or hemmed edges rather than rolled.

Figure 12:
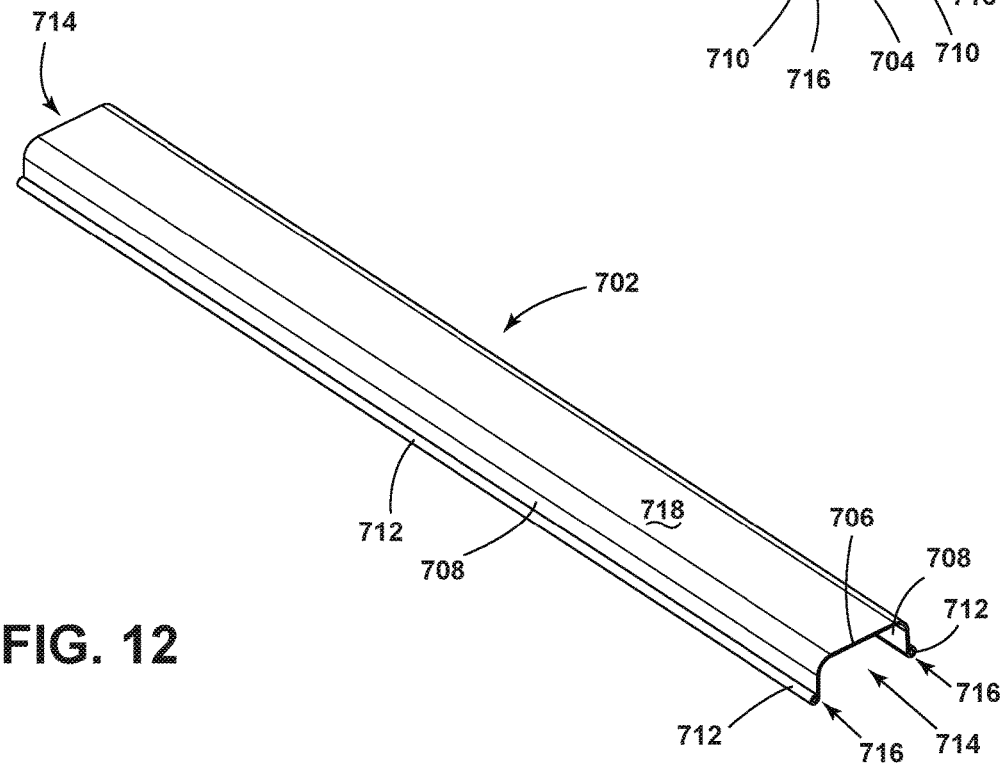
FIG. 12 is a bottom perspective view of the rolled U-channel brace of FIG. 11.

Turning to FIG. 12, a bottom perspective view of the rolled U-channel brace 702 is shown, best depicting the bottom surface 718 of the brace 702. The bottom surface 718 and the bottom wall 706 are flat, such that the brace 702 can rest on the body of the tub or spaced therefrom, or be inverted, defining a bracing surface comprising the bottom surface 718 for mounting additional elements, such as but not limited to additional lateral braces or counterweights between the braces 702 or the suspension 46.

The rolled U-channel braces 702 of FIGS. 11-12, can be comprised of steel utilizing a steel rolling process. Utilizing this process enables the rolled U-channel braces 702 to be made quickly and inexpensively. The braces 702 can be easily cut to custom length dimensions for use with alternate washing machines 10 having differing needs based upon capacity, functionality, or otherwise. The brace 702 can be installed within the exoskeleton 40 by welding, adhesives, or with fasteners to mount to the exoskeleton 40, tub 34, or otherwise.

Figure 13:
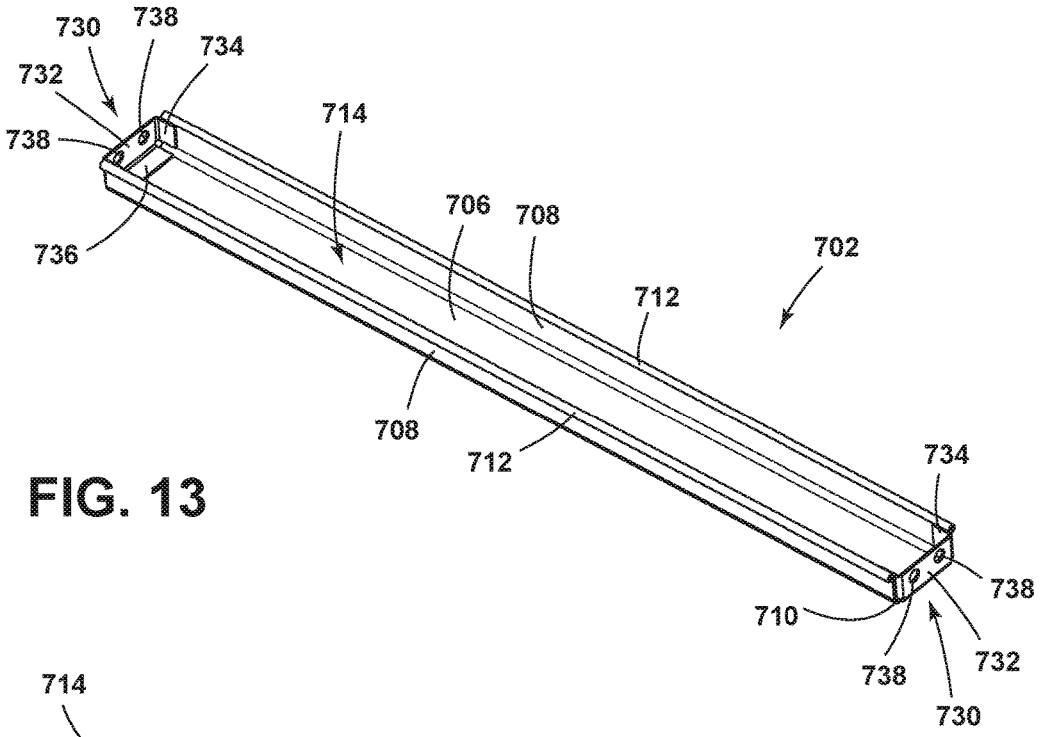
FIG. 13 is a top perspective view of the rolled U-channel brace of FIG. 11 comprising a mounted end wall.

Turning now to FIG. 13, a rolled U-channel brace 702 with a welded end bracket 730 is shown. The rolled U-channel brace 702 can be the same brace 702 as shown in FIGS. 11-12. Each end bracket 730, disposed on both opened ends 704 of the rolled U-channel brace 702, comprises a front wall 732, two sidewalls 734, and a bottom wall 736. The front wall 732 can have one or more apertures 738 used to accept fasteners, such as screws or bolts, for coupling the end bracket 730 to the exoskeleton 40.

The sidewalls 734 and the bottom wall 736 extend partially over the sidewalls 708 and bottom wall 706 of the U-channel brace, respectively, providing a surface, which can be used to weld the end bracket 730 to the U-channel brace 702. Alternatively, the end bracket 730 can be disposed with only one or both sidewalls 734 and without the bottom wall 736, or with only the bottom wall 736 and without the sidewalls 734. Furthermore, the end bracket can be mounted to the rolled U-channel brace 702 by means other than welding such as adhesives or fasteners in non-limiting examples.

It should be understood that the walls as illustrated are exemplary and some walls can be optional. For example, the brace could include just the sidewalls 734 and the front wall 732 without a bottom wall 736, or a bottom wall 736 with only the sidewalls 734 without the need for the front wall 732.

Figure 14:
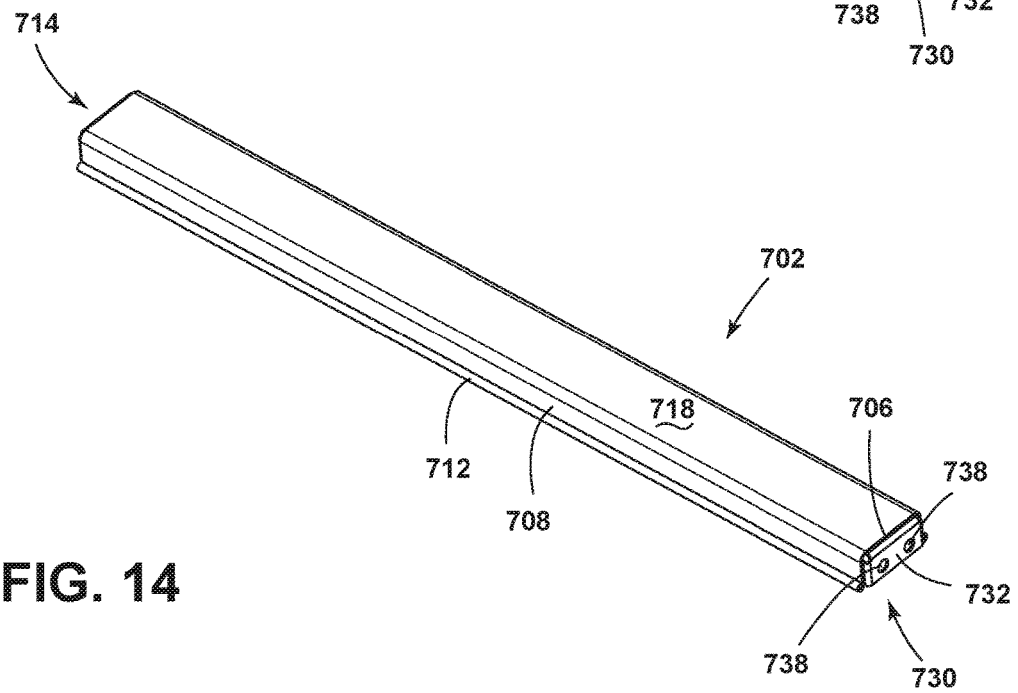
FIG. 14 is a bottom perspective view of the rolled U-channel brace with the end wall of FIG. 13.

Turning to FIG. 14, the bottom of the rolled U-channel brace 702 with a welded end bracket 730 is best seen. The front wall 732 of the end bracket 730 is in-line with the end of the U-channel brace 702 such that a surface across the end 704 of the U-channel brace 702 is defined for a flat surface used for mounting the brace 702 to the exoskeleton 40, or the front support 74 or rear drive plate 76 thereof.

In FIGS. 13 and 14, the rolled U-channel brace 702 can be quickly and inexpensively made with a steel rolling process and cut to a custom length accommodating alternative washing machines 10. The addition of the welded bracket 730 increases the structural integrity of the brace 702, while providing a mounting surface at the end of the brace 702. Additionally, a welded end bracket 730 can be thicker than the U-channel brace 702, where the thicker end bracket 730 can absorb a higher stress load at the apertures 738 than the U-channel brace 702.

Figure 15:
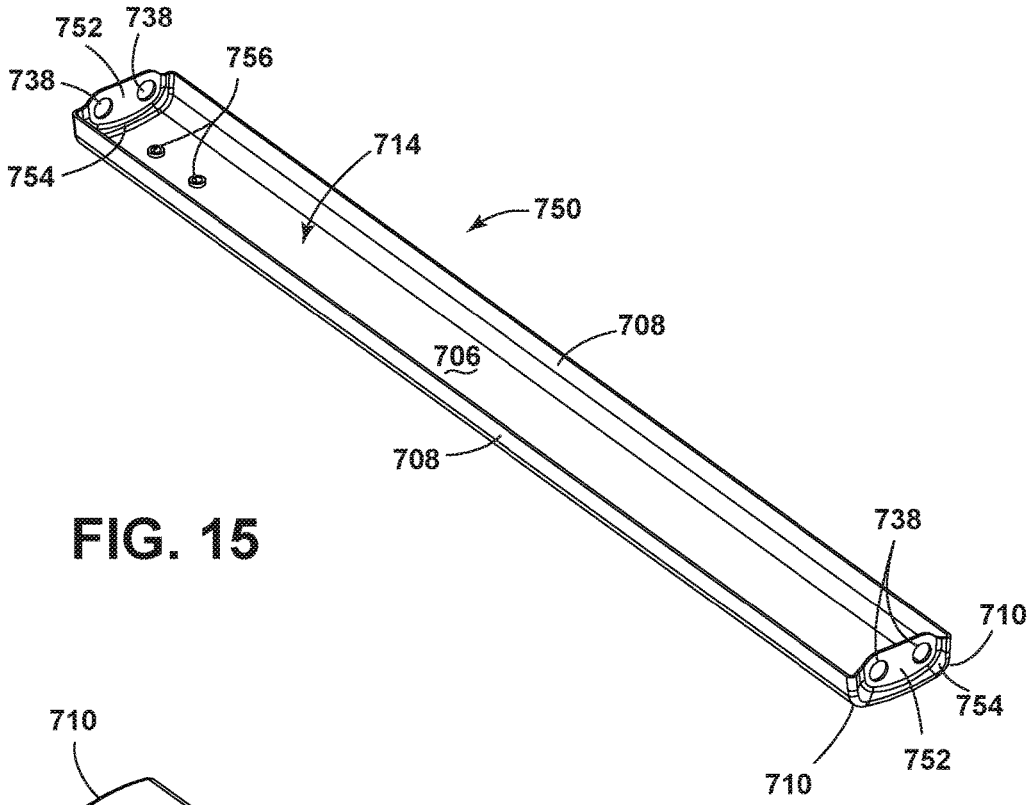
FIG. 15 is a top perspective view of a drawn brace.

In FIG. 15, a brace is shown as a drawn brace 750. The drawn brace 750 comprises two end walls 752, integrally formed at the ends of the sidewalls 708 and the bottom wall 706. The end walls 752, bottom wall 706 and the sidewalls 708 define the closed brace channel 714 extending the longitudinal length of the drawn brace 750. The end walls 752 taper inwardly towards the brace channel 714 at an end taper 754. The end surface can comprise apertures 738 for accepting fasteners for mounting the drawn brace 750 to the exoskeleton 40, or the front support 74 or rear drive plate 76 thereof.

The drawn brace 750 can further comprise channel apertures 756 disposed within the bottom wall 706. The channel apertures 756 can be used to accept additional fasteners for coupling components to the drawn brace 750, such as the suspension 46 or additional lateral structure members such as additional braces or counterweights.

Figure 16:
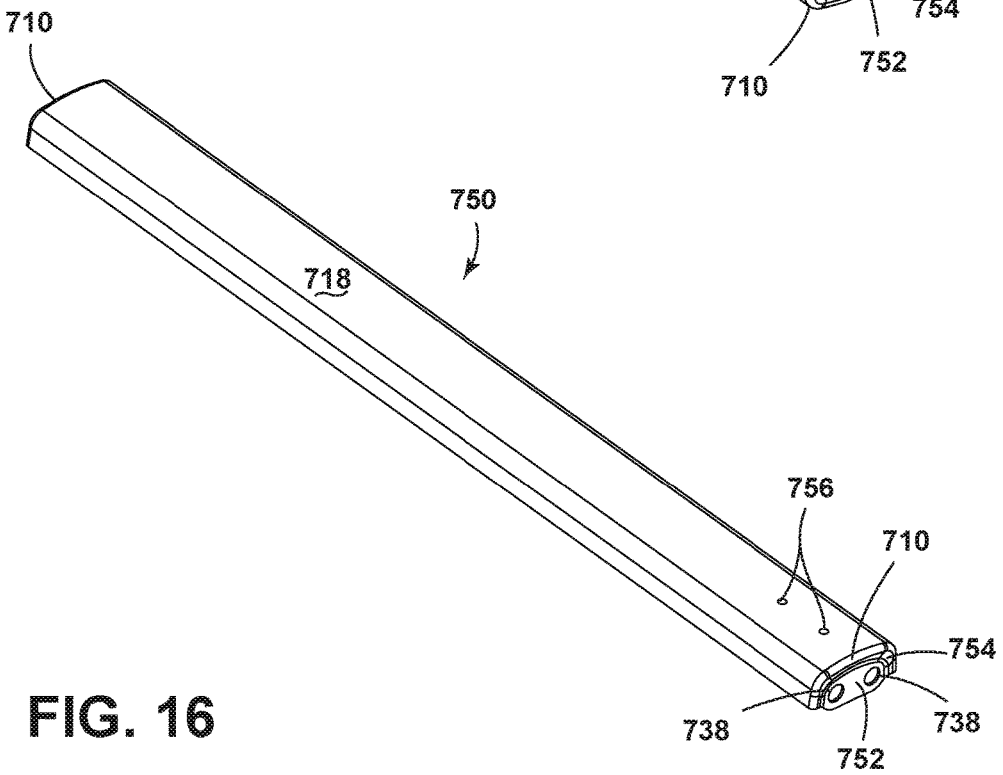
FIG. 16 is a bottom perspective view of the drawn brace of FIG. 15.

Turning to FIG. 16, the bottom surface 718 drawn brace 750 is best seen. The bottom wall 706 is slightly curved, laterally, with respect to the longitudinal brace channel 714, which can alternatively comprise a flat surface.

Figure 17:
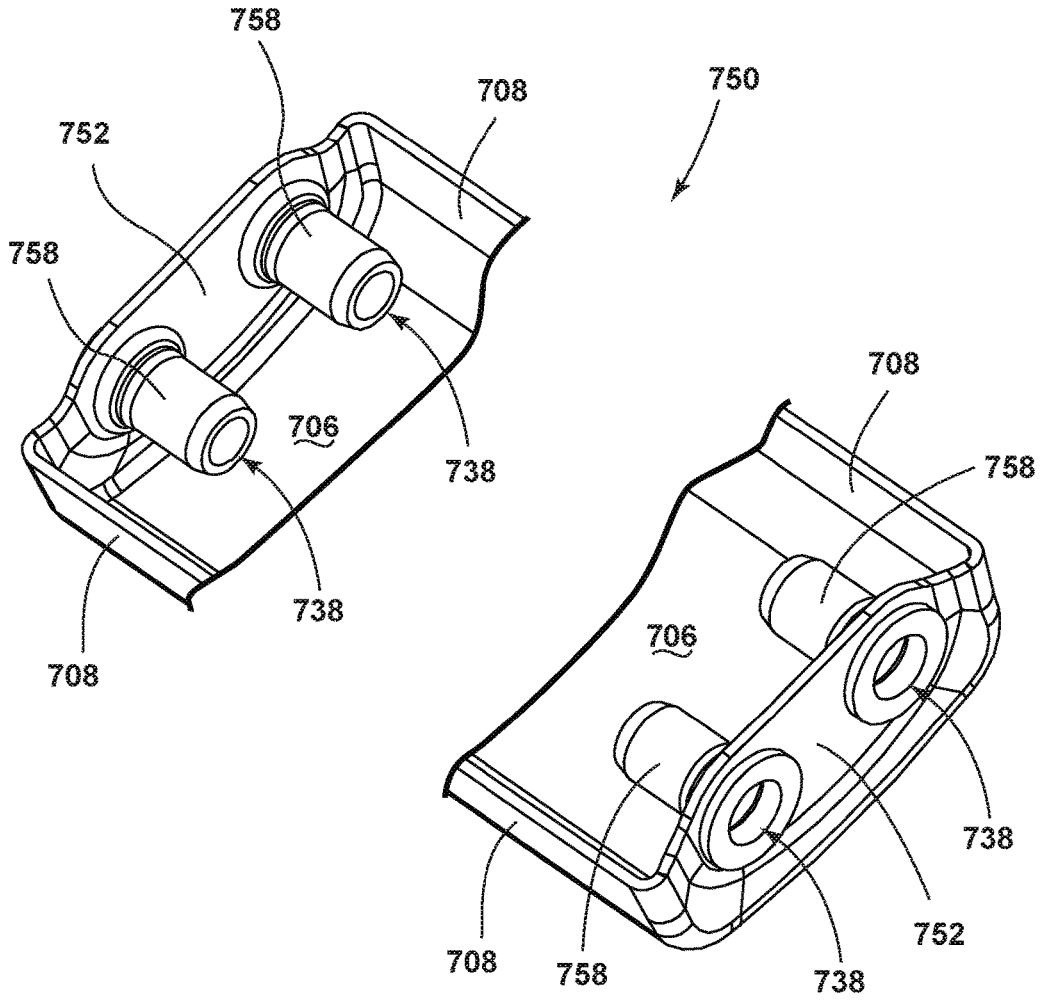
FIG. 17 is a close-up, perspective sectional view of the ends of the drawn brace of FIG. 15 with inserted fasteners.

Turning to FIG. 17, the end walls 752 of the drawn brace 750 further comprise a fastener aperture 738 further comprises an end fastener 758. The end fastener 758 can be a threaded insert or a rivnut known in the industry, used to accept fasteners such as screws or bolts and secure the fasteners within the apertures 738, which can otherwise require washers, welding, or other heavier or more expensive fastener securing elements. Furthermore, the drawn brace 750 comprises a continuous structure on all sides, creating a strong, rigid brace and ends are not required to be added to the brace for mounting.

Figure 18:
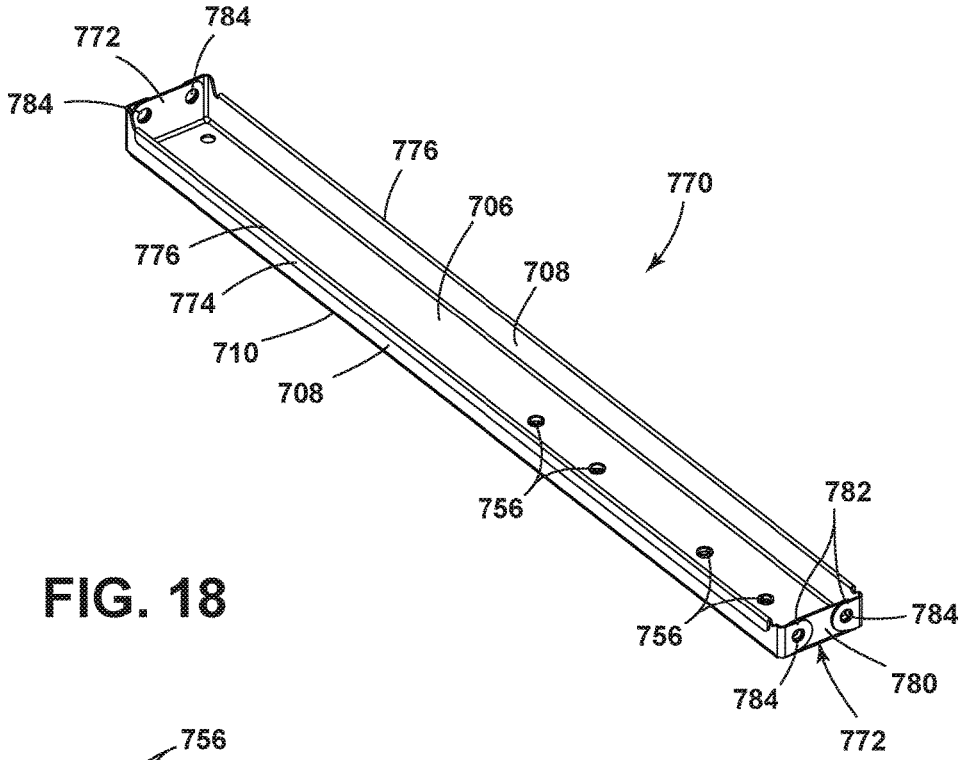
FIG. 18 is a top perspective view of a folded brace.

Turning now to FIGS. 18-21, a folded brace 770 is shown. In FIG. 18, the folded brace 770 comprises the bottom wall 706 and sidewalls 708, as well as a folded end 772. The bottom wall 706 extends into the sidewalls 708 at a curvilinear corner 710. The sidewalls 708 further extend into an outer sidewall 774, at a curvilinear upper corner 776, comprising a one-hundred-eighty degree turn, such that the outer sidewalls 774 are adjacent to the outside surface of the sidewalls 708. The outer sidewalls 774 have a height less than that of the sidewalls 708, extending only partially down the outside surface of the sidewalls 708. The bottom wall 706 can optionally comprise a plurality of apertures 756, which can be stamped into the bottom wall 706 as is desirable.

The folded end 772 comprises a central end 780 and two end flaps 782. The central end 780 is disposed with two end apertures 784 and each flap contains a single end aperture 784. The central end 780 is folded such that it is disposed perpendicular to both the bottom wall 706 and the sidewalls 708. The flaps 782 are folded to abut the outer surface of the central end 780 on opposing sides, such that the end apertures 784 of the central end 780 and the respective flaps 782 are aligned.

Figure 19:
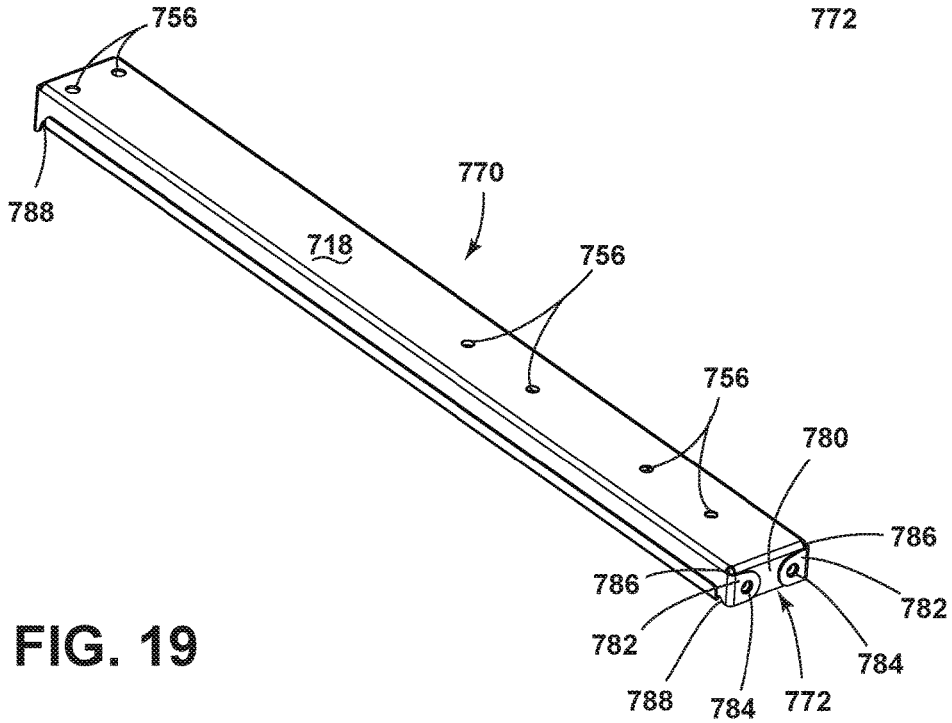
FIG. 19 is a bottom perspective view of the folded brace of FIG. 18.

In FIG. 19, the bottom surface 718 of the bottom wall 706 is shown, comprising channel apertures 756, which can be used to accept fasteners for mounting elements, such as the suspension 46, to the folded brace 770. A corner gap 786 is defined by the folded central end 780 and the folded flaps 782 between said elements and the bottom wall 706. Additionally, a dip 788 can optionally be disposed along the sidewalls 708 between the flaps 782 and the outer sidewalls 774.

Figure 20:
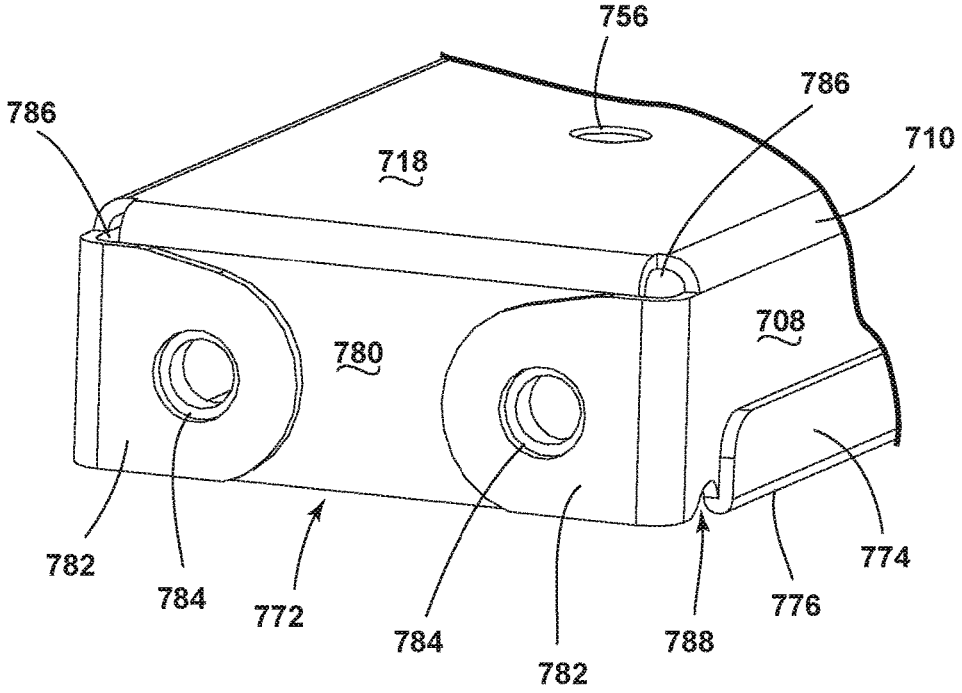
FIG. 20 is a front perspective view of the folded brace of FIG. 18.

In FIG. 20, a close-up view of the folded end 772 of FIG. 19 best illustrates the corner gaps 786 and the dips 788. The outer sidewall 774 folded over the sidewall 708 such that the two are adjacent to one another. Additionally, the corner gaps 786 are identifiable with the dips 788 in the sidewalls 708. One can appreciate the dual-thickness of the end apertures 784 comprising a combined aperture of the central end 780 and the flaps 782, providing additional structural support for an inserted fastener. The hemmed edges created at the flaps 782 further eliminates the sharp, machined edge for ease of handling and attachment.

Turning now to FIGS. 21A-21G, the steps comprising two methods of folding the folded brace are shown. First, in FIG. 21A, the unfolded form can be stamped using a standard stamping process. The elements comprising the folded brace 770 can be machine rolled or folded into the folded form of the folded brace 770. The folded brace 770 further comprises a folding gap 790 providing the required spacing necessary for folding the components, illustrated as the folding gap 790 disposed between the flaps 782 and the central end 780.

Figure 21A:
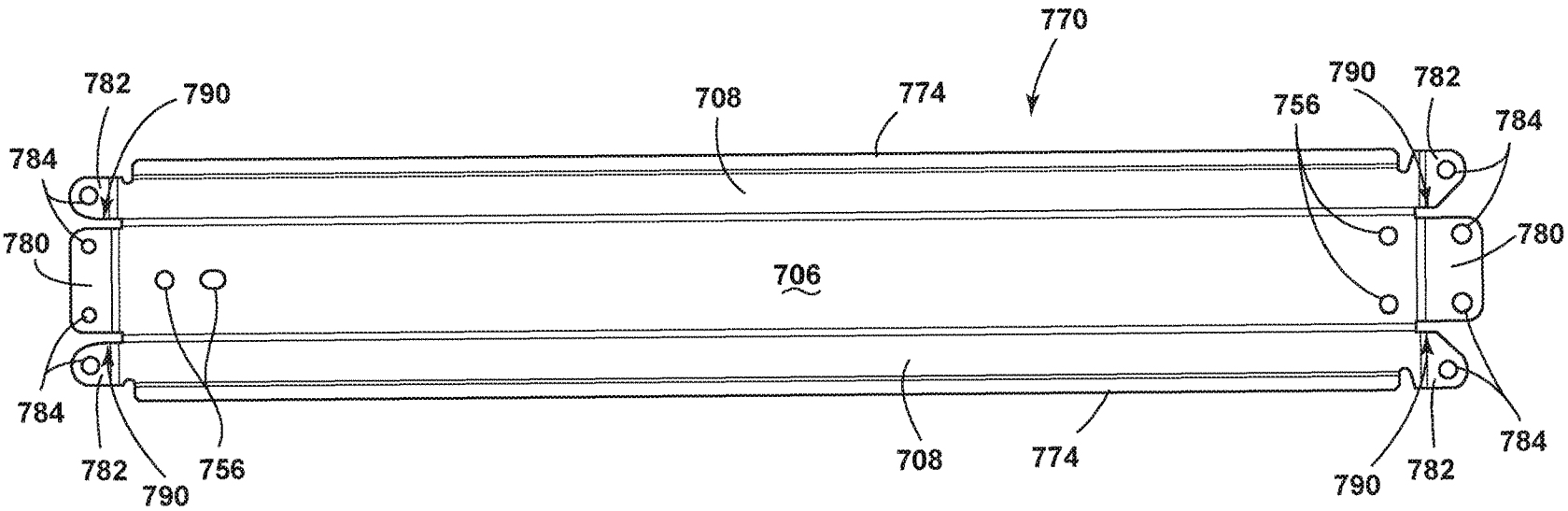
FIGS. 21A-21G are steps for two folding methods for forming of the folded brace of FIG. 18.
Figure 21B:
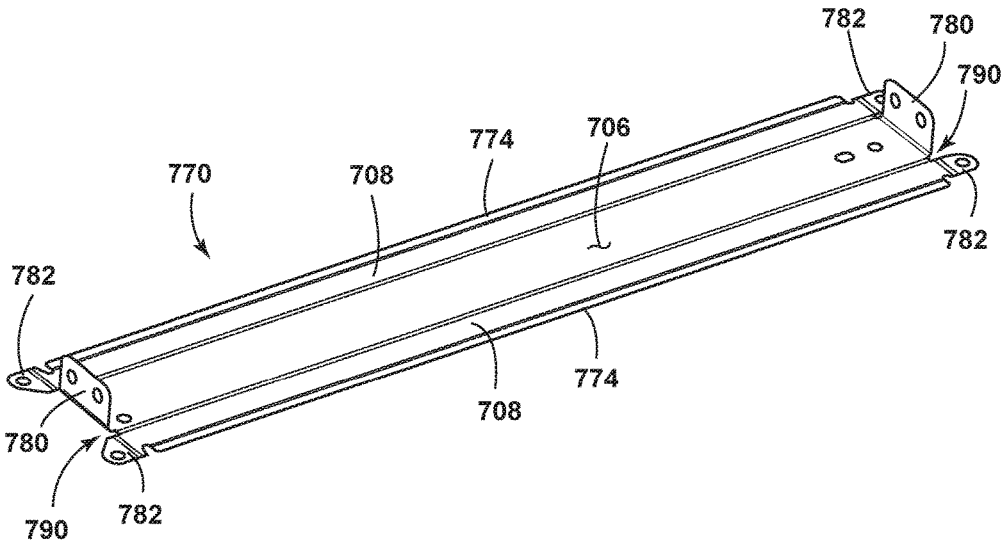
Figure 21C:
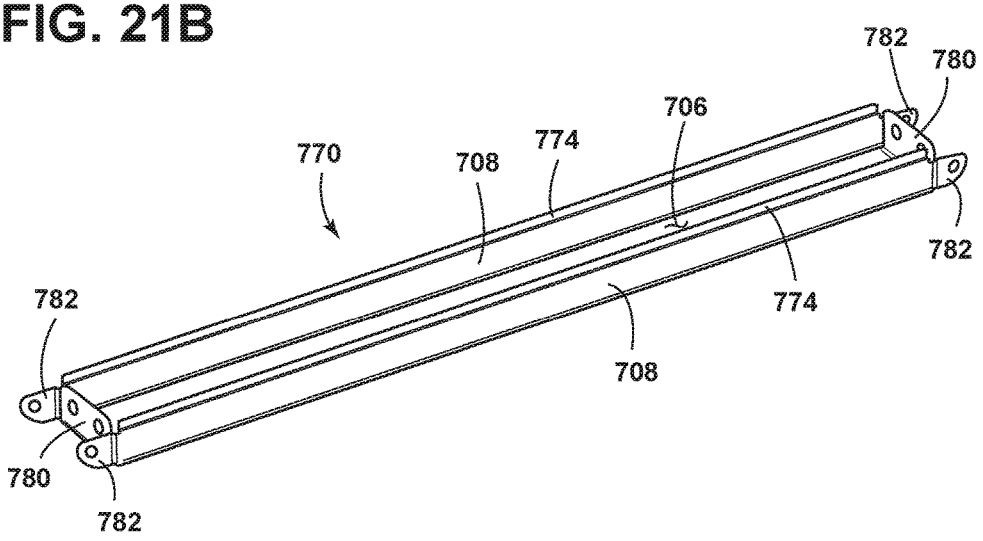
Figure 21D:
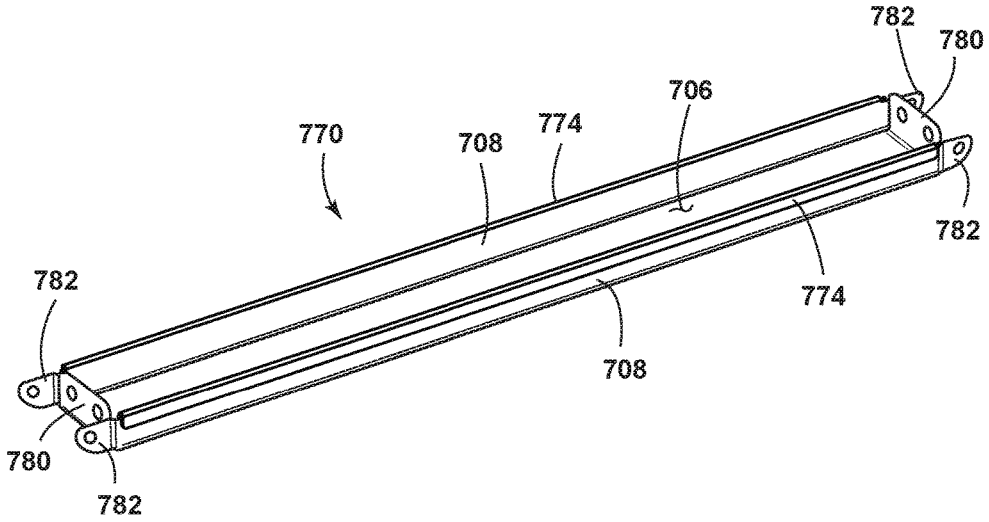
Figure 21E:
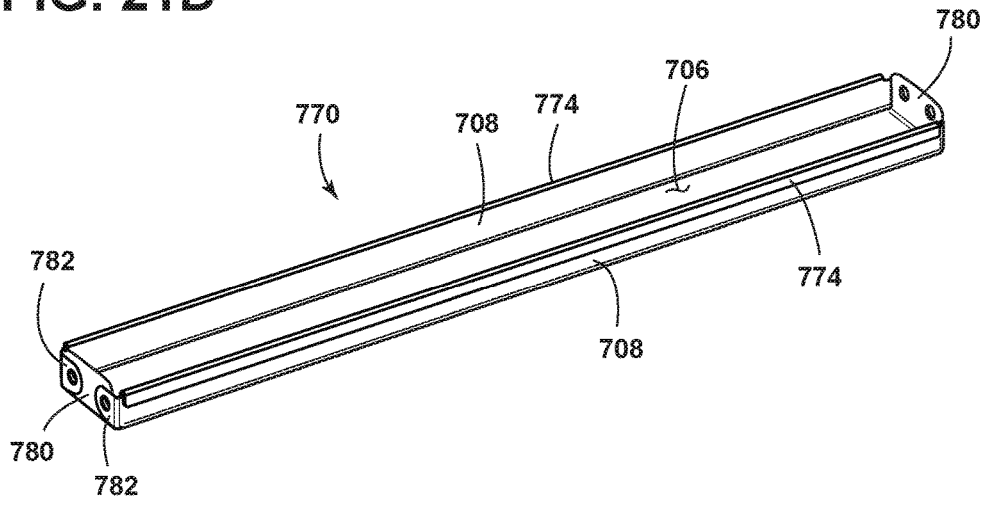

To continue creating the folded form, in FIG. 21B, the central ends 780 are folded up, perpendicular to the bottom wall 706. The central ends 780 are folded discretely from the flaps 782 utilizing the folding gap 790 between the two. Next, in FIG. 21C, the sidewalls 708 can be folded up, the same direction as the central ends 780, being perpendicular to the bottom wall 706. The sidewalls 708 with the flaps 782 now extend past the central end 780, defining the brace channel 714. Next, in FIG. 21D, the outer sidewalls 774 can be folded outwardly from the now defined brace channel 714, abutting the outer surface of the sidewalls 708. Finally, in FIG. 21E, the flaps 782 can be folded inwardly, abutting the outer surface of the central end 780 and aligning the end apertures 784 disposed on the flaps 782 and the central ends 780. Upon completing the rolling or folding of the folded brace 770, the abutting parts can be welded together, securing them in place and providing additional structural integrity to the brace 770. Alternatively, the aligned end apertures 784 in combination with the rigid machine structure provides a structural brace without the need for welding the brace 770. As can be appreciated, the process of folding or rolling the folded brace 770 can be completed in any order, such that a complete folded brace 770 results.

Figure 21F:
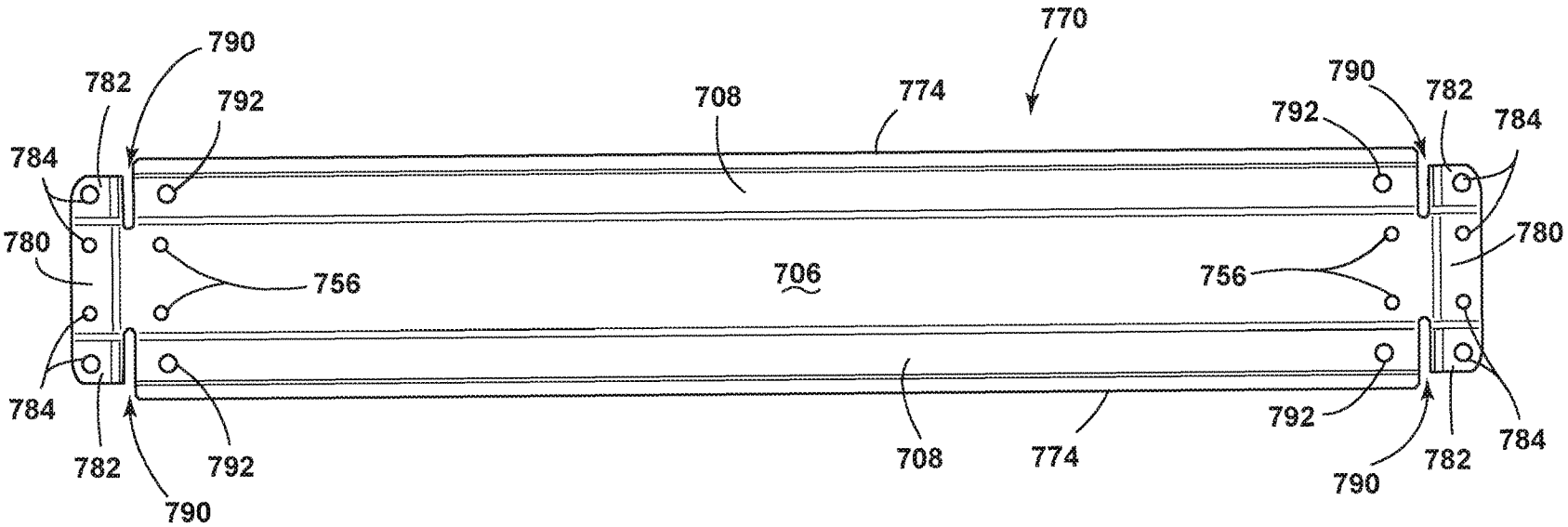
Figure 21G:
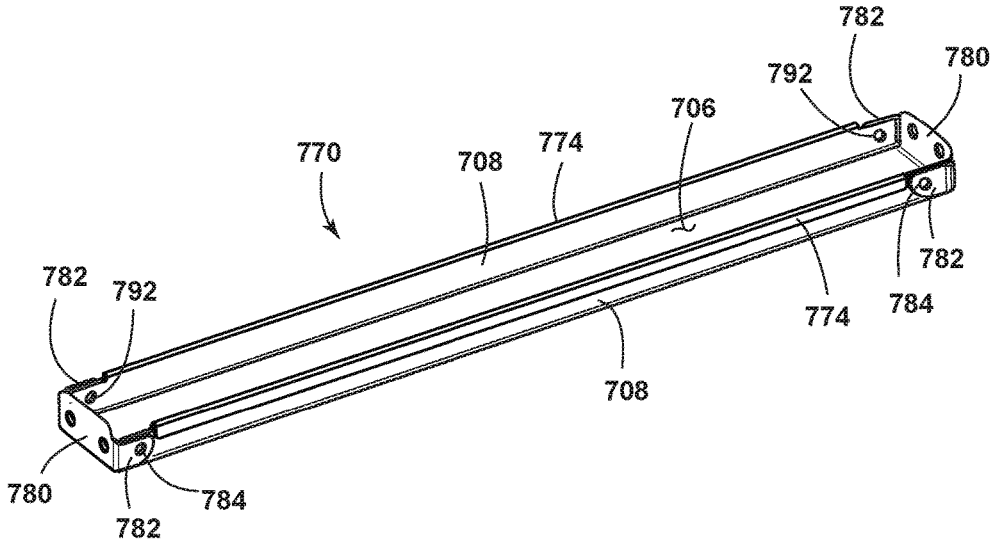

Alternatively, in FIG. 21F the brace 770 can have the folding gap 790 disposed between the flaps 782 and the sidewalls 708. As such, the flaps 782 can be folded last during a folding process to be disposed on the outer surface of the sidewalls 708 of the brace 770 as shown in FIG. 21G. For example, the central end 780 can be folded first, moving the flaps 782 with the central end 780. The sidewalls 708 and the outer sidewalls 774 can be folded next. Finally, the flaps 782 can be folded over the sidewalls 708, creating the brace 770 shown in FIG. 21G. Furthermore, the sidewalls 708 can have one or more sidewall apertures 792, such that the end apertures 784 of the flaps 782 will align with the sidewall apertures 792 for mounting thereto. Thus, it should be appreciated that multiple combinations of folded braces 770 can be achieved by varying the positions of folding gaps 790 and the folding process of completing the brace 770.

As can be appreciated, the folded brace 770 can be quickly and inexpensively formed by a stamping process. The brace can then be quickly constructed by machine rolling or folding of the components into the proper places. The folded brace 770 comprises a continuous structure, having resilient strength and rigidity. Furthermore, the flaps 782 folded over the central end 780 in FIG. 21E create a double-thick end, absorbing and supporting loads at the bolt attachments into the end apertures 784. Folding the flaps 782 and the central end 780 together, can complete the folded brace 770 by mounting the folded brace 770 to the exoskeleton 40 without the need for welding, as the fastener, such as a bolt, will secure the flaps 782 to the central end 780. Finally, the stamping process can be used to easily cut the folded braces 770 to a desired length, accommodating alternative washing machines.

Figure 22:
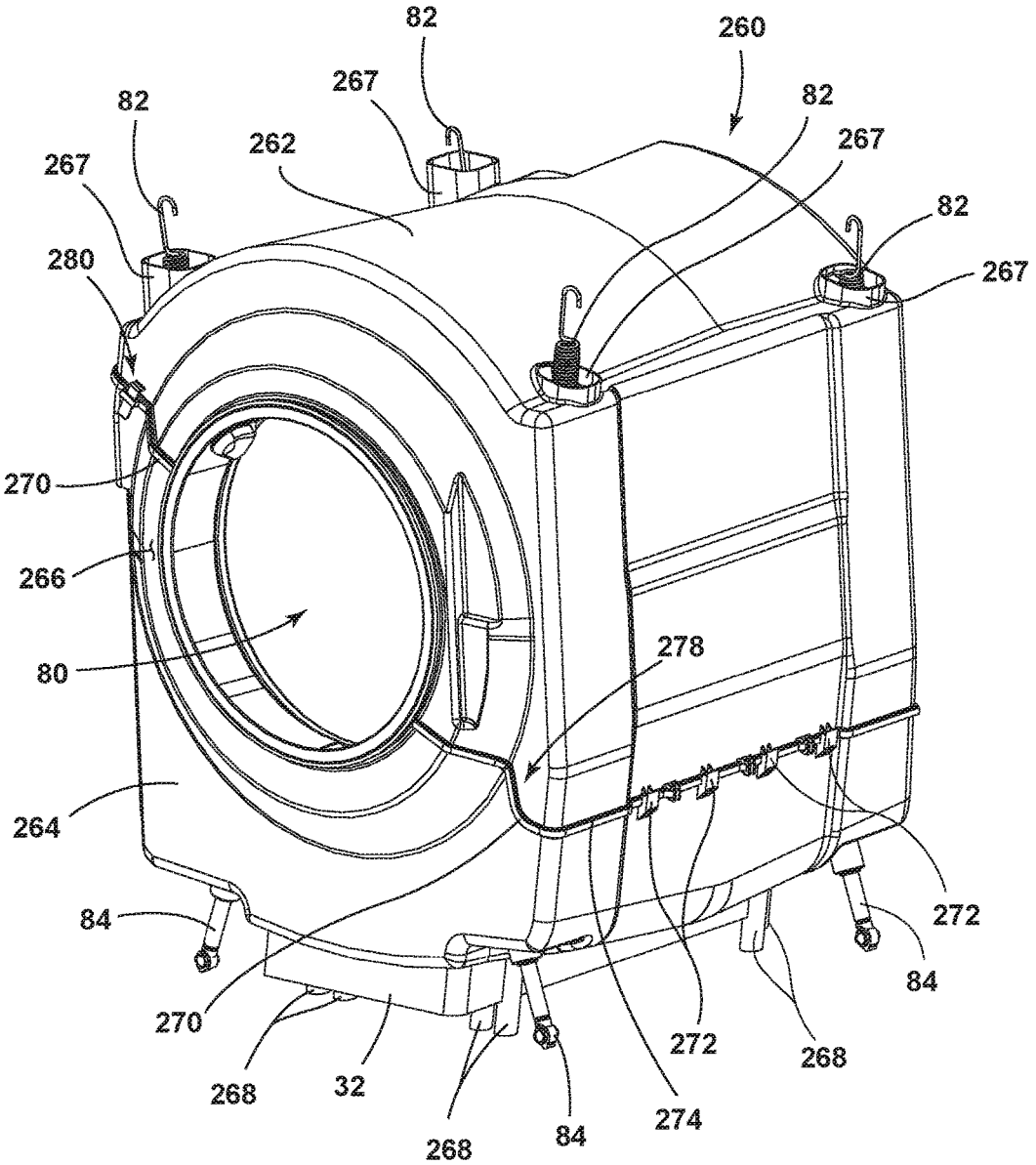
FIG. 22 is a front perspective view of a two-piece tub.

FIG. 22 shows a two-piece fixed tub 260, comprising a tub upper section 262 and a tub lower section 264, each section 262, 264 adapted to couple to the other section 262, 264. The two-piece tub 260 is a tub, which can be split diagonally, and can comprise any of the tubs described herein. Each section 262, 264 can comprise an opening plateau 266, the combination of which defines an annular protruded surface from the sections 262, 264 and further defines the central opening 80. The upper section 262 can further comprise a plurality of chimneys 267, further described herein at the discussion of FIGS. 38 and 39. The chimneys 267 can provide a space in the upper section 262 for the springs 82 to extend through the tub 260. As such, the exoskeleton structure 40 disposed within the tub 260 can mount to the chassis 12 through the tub 260. The tub lower section 264 can further comprise legs 268 to support the bottom of the fixed tub 260 on the chassis 12 or bottom wall 24. One or more dampers 84 can mount to an internal exoskeleton structure 40 through the bottom of the tub 260 through one or more apertures, for example, in the bottom of the tub 260. A tub seam 270 is defined where the sections 262, 264 couple to one another. The tub seam 270 can be a gasket, labyrinth seal, or any other method of sealing a tub known in the art, such as welding in one example. Non-limiting examples of welding can include hot plate welding, infra-red welding, or vibration welding. Additionally, fasteners 272 can be used to secure the sections 262, 264 to one another at the tub seam 270. Furthermore, adhesives can be utilized to secure the sections 262, at the seam 270.

The tub seam 270 can comprise an "L-shape" defined by the lower sides of the tub seam 270 and a seam lower edge 274. The seam lower edge 274 can be flattened such that a flat surface exists for bolting, welding, or otherwise securing the two sections 262, 264 together, or can provide a larger surface for which a larger watertight seal can be used to frustrate leaking from water escaping from the drum.

As can be appreciated, the tub seam 270 divides the tub 260 into the upper and lower sections 262, 264 substantially horizontally, comprising a diagonal orientation when viewed from a front view of the washing machine. The two-part tub 260 is described as having a horizontal seam as the sections are split into upper and lower sections 262, 264, as compared to a vertical seam which would split the tub into front and rear sections. The tub seam 270, however, does not define a horizontal axis being parallel to the plane on which the washing machine rests, such as the floor, having the tub seam 270 disposed near the 4:00 position 278 and the 10:00 position 280 relative to a clock-face positioned at the central opening 80 of the tub 260. As such, any additional width, which the tub seam 270 might add to the tub 260, will be offset from the chassis sidewalls and will not decrease the capacity of the tub 260, where a seam adjacent to the chassis sidewall could. The 4:00 position 278 is designed to be of a height high enough that a volume of liquid within the tub 260 will not rise to the level of the seam 270, eliminating a potential for spilling. Alternatively, the 4:00 and 10:00 positions 278, 280 can vary, such that a seam creates a two-piece tub defined by a substantially horizontal seam 270 without the seam 270 abutting the chassis 12 and that the volume of liquid within the tub 260 will not reach the seam lower edge 274.

Figure 23:
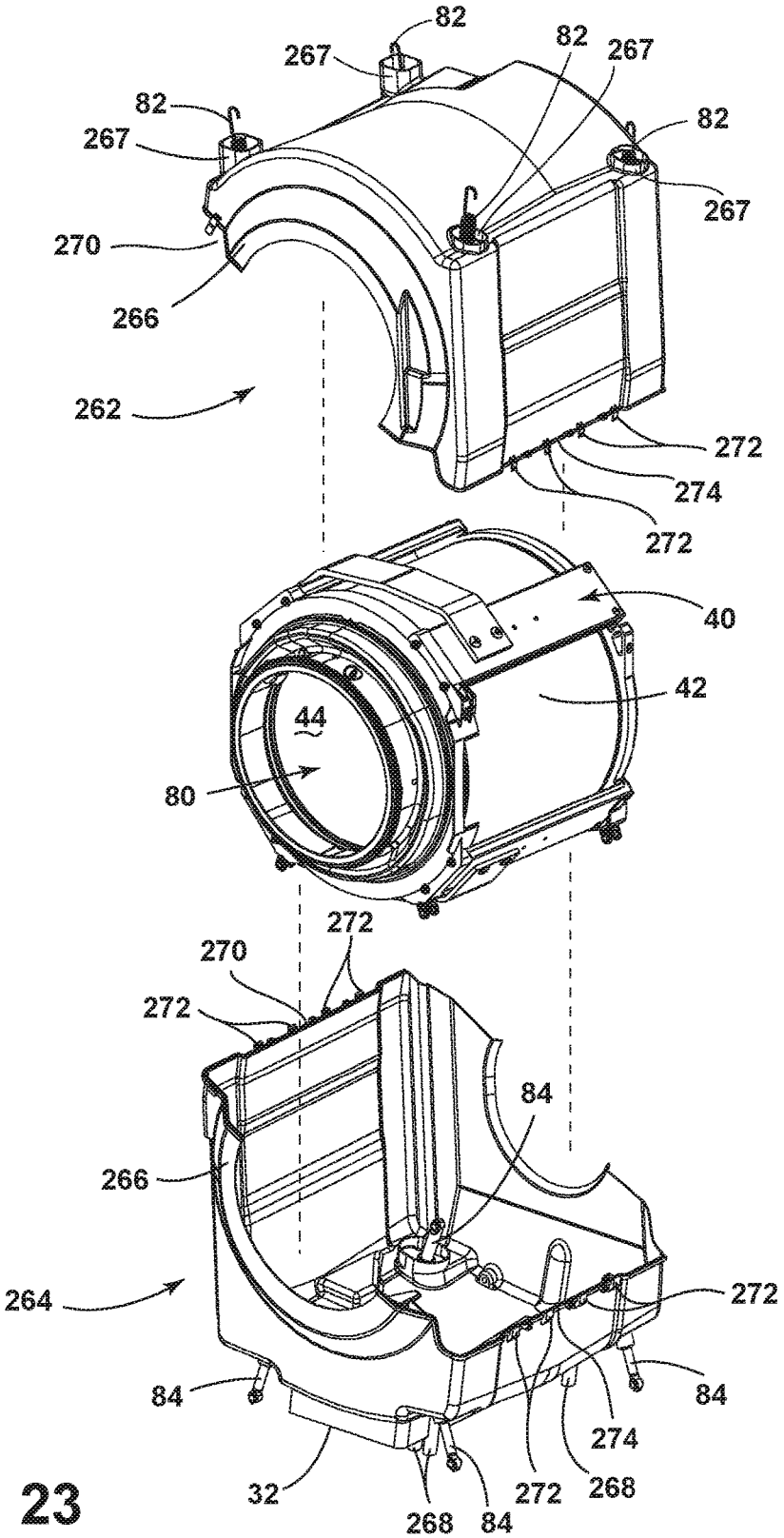
FIG. 23 is an exploded view of the two-piece tub of FIG. 22.

As is best seen in FIG. 23, the two-piece tub 260 encases the exoskeleton 40 and the drum 42. During installation, the tub lower section 264 can be placed within the chassis 12, and the exoskeleton 40 and the drum 42 place therein. The tub upper section 262 is placed on the tub lower section 264 and sealed at the seam 270. Fasteners 272 on either side of the tub 260, such as clamps or snaps, secure the two section 262, 264 together at the seam 270. The suspension elements such as the springs 82 and the dampers 84 can extend through tub apertures and mount to the exoskeleton 40 within the tub 260.

The two-piece tub 260 enables increased treating capacity by permitting easy installations of components, including the tub 260, exoskeleton 40, and drum 42, as well as additional component therein. Typical installation requires installation of a two-piece tub utilizing a vertical seam can facilitate installation of the drum, however, the vertical seam limits the capacity of the tub, requiring the tub weld flange and draft angles around the perimeter of the tub. Thus, a substantially horizontal or diagonal seam as described can gain a potential eight to fourteen mm of radial space, or more, which can be added to the radial capacity of the drum 42. Thus, the seam of the two-piece tub 260 disclosed herein can facilitate installation while gaining additional capacity potential. Further still, the "L-shaped" seam minimizes the potential for leaking which can occur at a lower edge of the seam 274. While the 4:00 position 278 can be above the anticipated maximum height of liquid within the tub 260, the "L-shaped" seam further creates a wider seam area, enabling the use of a larger, more effective seal at the seam 270, frustrating any potential leakage if the liquid does rise to the seam lower edge 274 without diminishing tub capacity.

Figure 24:
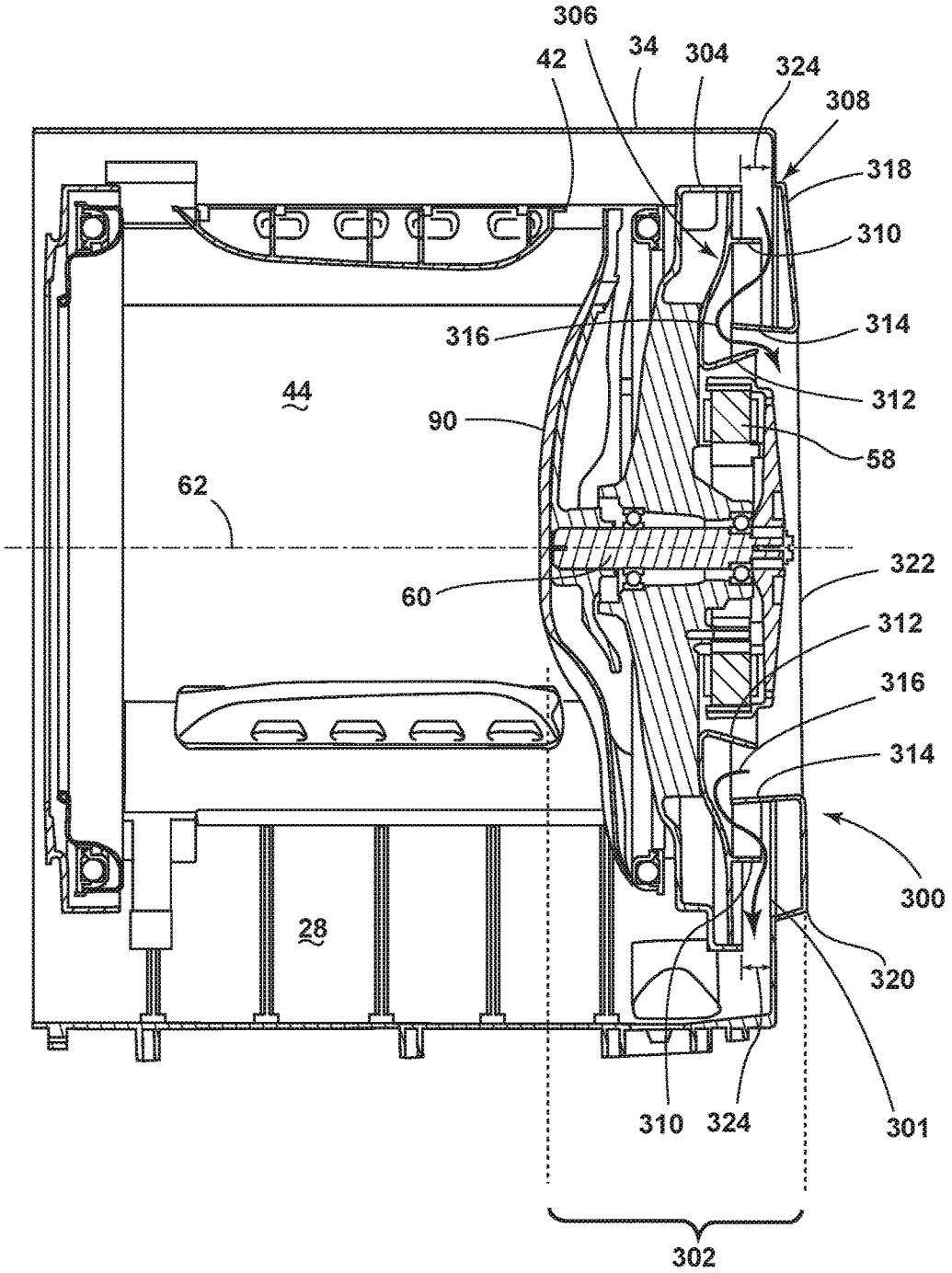
FIG. 24 is a schematic cross-sectional view of a washing machine having a labyrinth seal disposed between the tub and the rear drive plate.

Turning now to FIG. 24, the washing machine 10 can comprise a labyrinth seal 300. The tub 34, which can comprise any tub described herein, includes a rear opening 301 that surrounds a rear drive system 302 comprising the rear of the drum 42, and a rear drive plate 304, which can comprise the two-part drive plate of FIGS. 27-32 described herein, a front labyrinth plate 306, a rear labyrinth plate 308, the drive shaft 60, and the motor 58. The front labyrinth plate 306, which can couple to the rear drive plate 304, comprises an annular outer flange 310 and an annular inner flange 312, both flanges 310, 312 extending rearward of the drum 42. Alternatively, the front labyrinth plate 306 can be integral with the rear drive plate 304. The rear labyrinth plate 308 can mount to the rear of the tub 34, or be integral with the tub 34, and comprises a middle flange 314, extending forward toward the drum 42, being annularly disposed between the outer and inner flanges 310, 312 of the front labyrinth plate 306; all flanges 310, 312, 314 defining a labyrinth path 316 around the motor 58. The rear labyrinth plate 308 couples to the tub 34 at a top edge 318 and a bottom edge 320, having a back wall 322. The rear labyrinth plate 308 can taper outwardly, such that the bottom wall 320 can be wider than the top edge 318. The taper of the rear labyrinth plate 308 can be utilized to define a vertical back wall 322 when the longitudinal axis of rotation 62 is declined toward the rear of the tub, such that the longitudinal axis of rotation 62 is not parallel to the surface upon which the washing machine rests.

A gap 324 is defined between the labyrinth plates 306, 308, such that any sag or suspension travel of the exoskeleton 40 is permitted without damage to the labyrinth seal 300. The gap 324 can be 30 mm, or can be as small or great as 20-40 mm. Furthermore, the flanges 310, 312, 314 can be made of an elastomer material, such that the occurrence of any tub contact or rubbing is not damaging or detrimental to the labyrinth plates 306, 308 or to operation of the washing machine.

The inner flange 312 tapers radially outward in a rear direction from the drum 42 toward the motor 58, such as at a five-degree angle. The inner flange 312 taper of five-degrees is exemplary, and can taper at an angle from zero-degrees, to fifteen-degrees, or more. The middle flange 314 of the rear labyrinth plate 308, at the top, tapers radially inward toward the rear of the washing machine in the same direction as the inner flange 312. The outer flange 310 is disposed parallel to the axis of rotation 62, initially blocking liquid from entering the labyrinth seal 300 from the liquid chamber 28 in a splashing or turbulent manner.

It should be appreciated that the tapers of the inner flange 312 and the middle flange 314 frustrates any flow of liquid within the labyrinth seal from passing to the motor 58. The flowing liquid will move toward the respective plates 306, 308 rather than moving in a direction toward the motor 58.

In alternative implementations, the flanges 310, 312, 314 can be implemented at any angle, tapering in any direction, such that a labyrinth path 316 is defined and liquid is frustrated from reaching the motor 58. Furthermore, the labyrinth path 316 frustrates any flow of moist air toward the motor 58.

Figure 25:
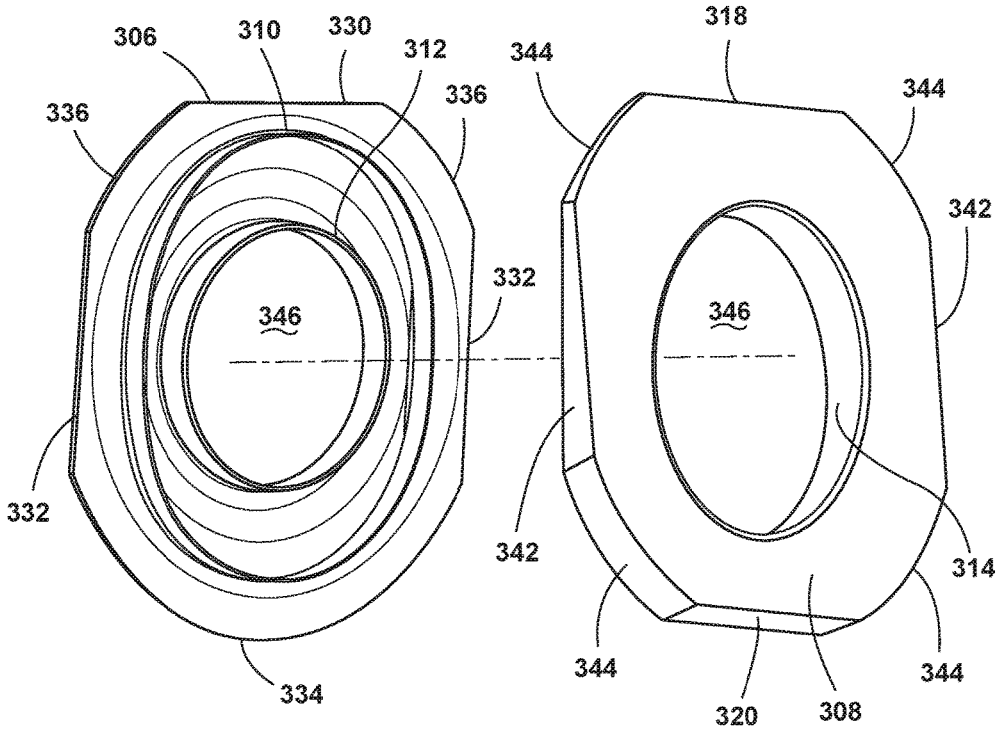
FIG. 25 is an exploded view of the labyrinth seal of FIG. 24.
Figure 26A:
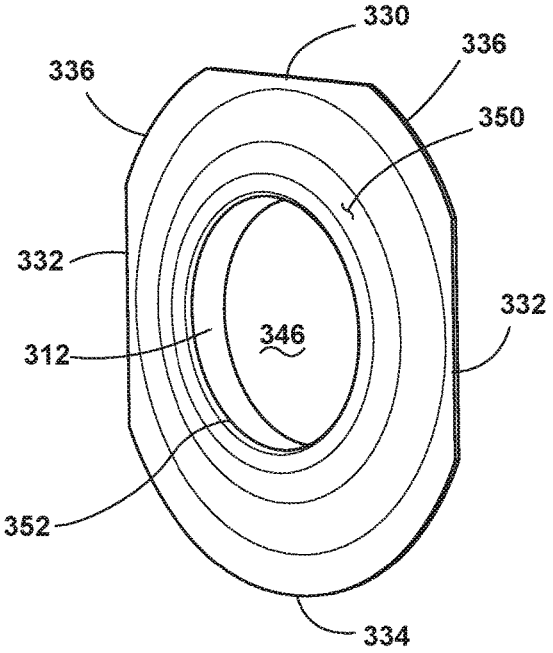
FIG. 26A is a front perspective view of a front labyrinth seal plate.
Figure 26B:
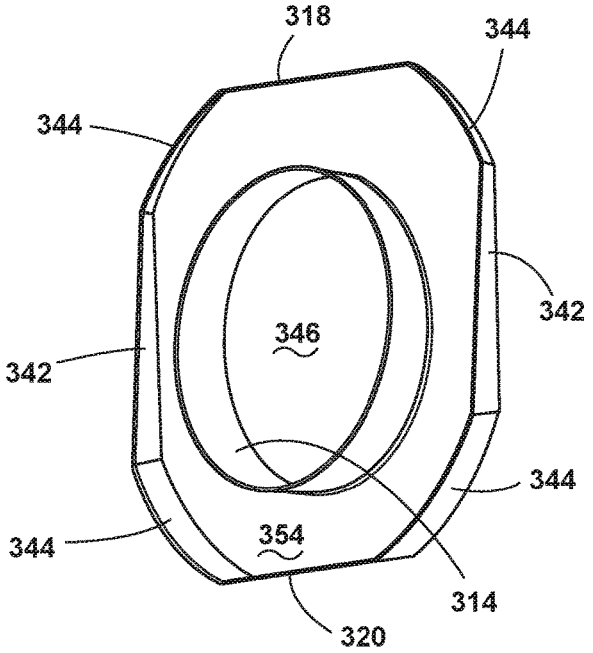
FIG. 26B is a front perspective view of a rear labyrinth seal plate.

Turning now to FIG. 25, an exploded view shows the front and rear labyrinth plates 306, 308, from a rear perspective. The front labyrinth plate 306 further comprises a top edge 330, two side edges 332, and a bottom edge 334. The top edge 330 couples to the side edges 332 by arcuate corners 336, while the bottom edge 334 comprises an arcuate shape connecting to both side edges 332. The rear labyrinth plate 308 further comprises the top edge 318, connected to two side edges 342 by arcuate corners 344. The bottom wall 320 of the rear labyrinth plate 308 is linear and connects to the side edges 342 at arcuate corners 344. The corners 344 and the side edges 342 of the rear labyrinth plate 308 taper with the angle of the back wall 322. As such, the corners 344 adjacent to the bottom wall 320 are wider than the corners 344 adjacent to the top edge 318. Each labyrinth plate 306, 308 further defines a motor aperture 346 adapted to surround the motor 58. Turning to FIG. 26A, a front perspective view of the front labyrinth plate 306 shows a curved front face 350. The front face 350 curves outwardly, defining an inner flange front edge 352, such that the inner flange 312 is wider than the outer flange 310. The wider inner flange 312 provides a sufficient width to cover the width of the motor 58 such that any liquid or moist air moving through the labyrinth seal 300 is separated from the motor 58 by the inner flange 312. In FIG. 26B a front perspective view of the rear labyrinth plate 308 shows the tapered elements comprising the middle flange 314 and the bottom wall 320. The bottom wall 320 is further angled downwardly such that any liquid contacting the bottom wall 320 can flow away from an inner surface 354 of the rear labyrinth plate 308.

Alternatively, some of the flanges, such as the outer flange 310, can be removed. Furthermore, the annular flanges could only partially extend around the rear of the washing machine, having a gap in the flanges near the bottom of the machine for allowing a flow of liquid through the labyrinth seal to drain to the bottom of the tub. It should be further appreciated that the geometry of the labyrinth plates 306, 308 as shown is exemplary, and can be adapted to fit the particular needs of the washing machine. Additionally, it is contemplated the labyrinth plates 306, 308 can be formed integrally as part of the tub or the rear drive plate.

As can be appreciated, the labyrinth seal 300 slows the flow of splashing liquid so it cannot escape from the liquid chamber 28 of the tub 34 into the interior 26 or onto the motor 58. The labyrinth seal 300 is easily mounted to the tub 34 and the rear drive plate 304, such as by welding, and can quickly and inexpensively seal the liquid chamber 28 from the interior 26 without the worry of seals or gaskets, which can fail or degrade. Additionally, the gap 324 between the plates 306, 308 minimizes damage where a rigid structural member used to seal the tub 34 can be damaged during the dynamic movement of the drum during operation.

Figure 27:
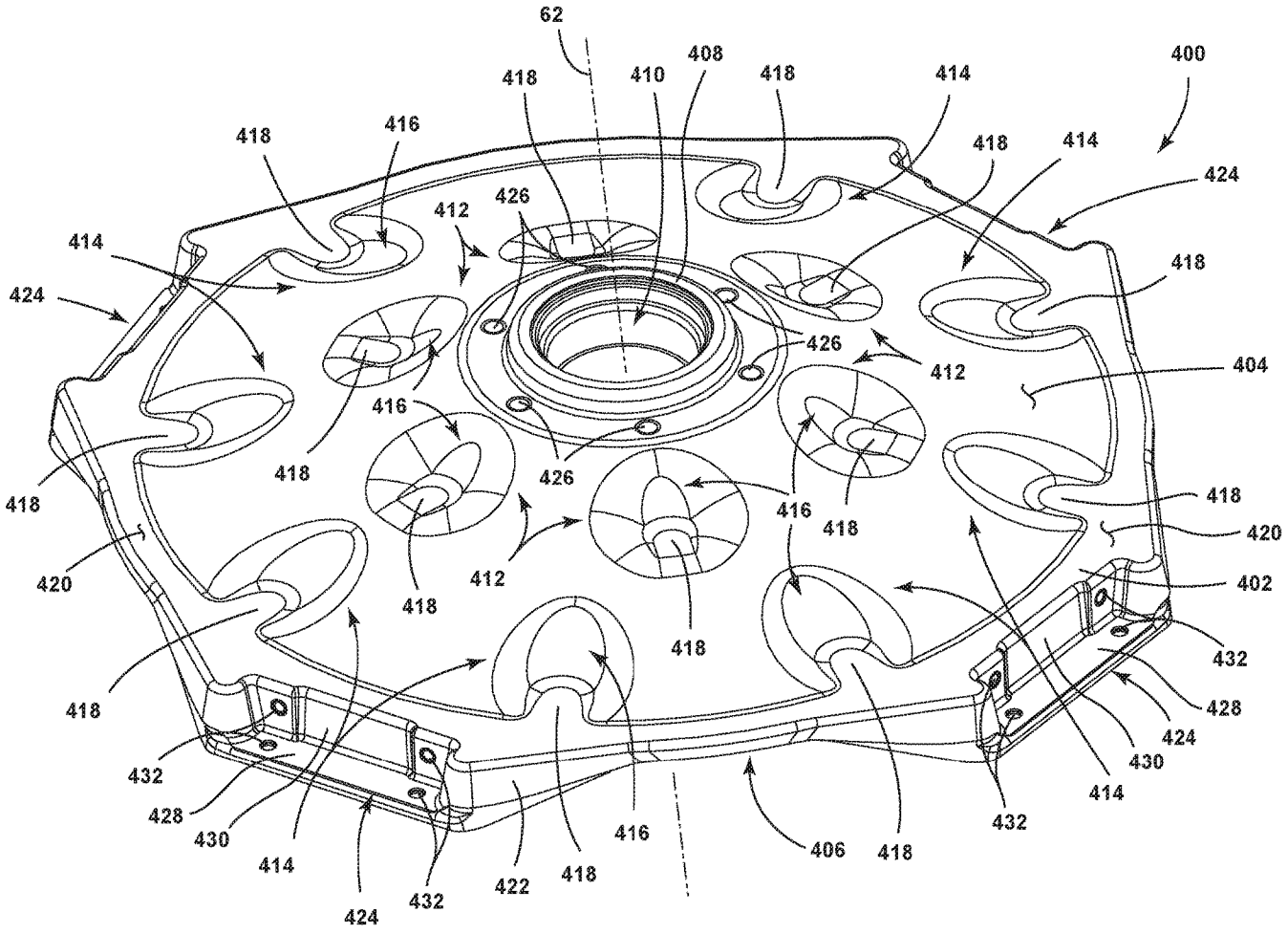
FIG. 27 is a perspective view of a two-part drive plate.

FIG. 27 shows a front perspective view of the rear drive plate 76 (FIGS. 1 and 2) or rear drive plate 304 (FIG. 24) as a two-part drive plate 400. The two-part drive plate 400 comprises a front plate 402 having a front surface 404 and a rear surface (not shown), and a rear plate 406 coupled to the front plate 402. The plates 402, 406, in non-limiting examples, can comprise sheet steel such as stainless steel. A bearing carrier 408 is disposed in the center of the plates 402, 406, defining a drive opening 410. The bearing carrier 408 can be made of cast iron including swaged malleable cast iron. The bearing carrier 408 mounts to the plates 402, 406 by welding, or can mount by a plurality of discrete inlets 426 where fasteners or swaging can be utilized. The plates 402, 406 are disposed with a plurality of discrete joints comprising inner joints 412 and outer joints 414, such that the inner joints 412 are closer to the bearing carrier 408. Each joint 412, 414 comprises a curved joint surface 416, while linear surfaces or otherwise are contemplated, connecting the front surface 404 to a joint mounting surface 418, adapted to provide a surface for mounting the plates 402, 406 together, for example by welding. The joint mounting surfaces 418 defined within the outer joints 414 are further defined within an outer mounting surface 420 disposed around the outer surfaces of the plates 402, 406, providing a surface for a continuous weld around the periphery of the two-part drive plate 400. An outer edge 422 further comprises a plurality of discrete mounting walls 424. The mounting walls 424 comprise a bottom wall 428 and a sidewall 430, disposed substantially normal to one another. Each wall 428, 430 can comprise two mounting apertures 432 for mounting structures to the two-part drive plate 400, such as the tub 34, the exoskeleton 40, the drum, or the braces 200 shown in FIGS. 11-21, in non-limiting examples.

Figure 28:
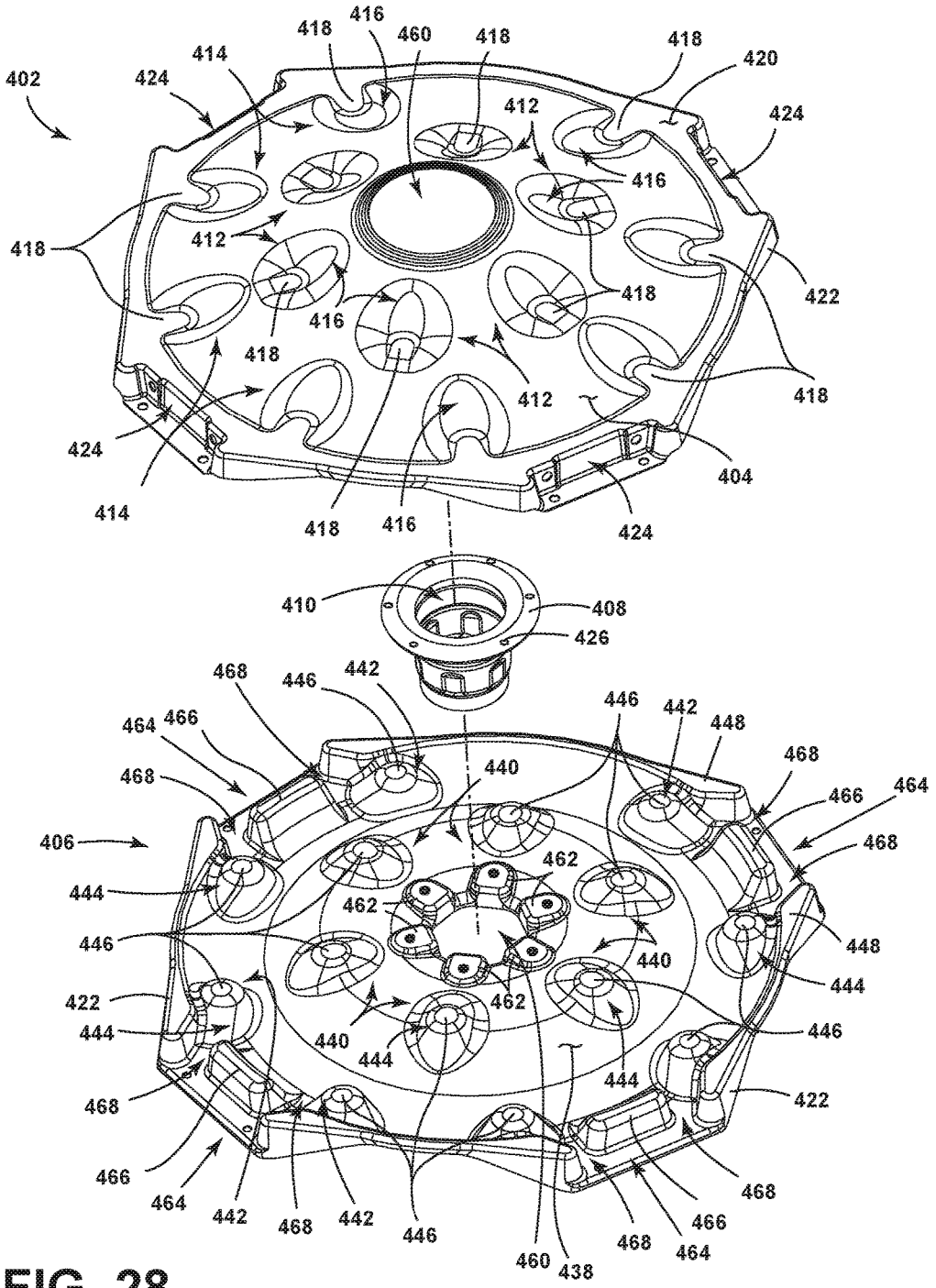
FIG. 28 is an exploded view of the two-part drive plate of FIG. 27.

Turning to FIG. 28, an exploded view best shows the internal structure, or front surface of the rear plate 406 as it mounts to the front plate 402. The rear plate 406 further comprises a plurality of rear elements, comprising a plurality of inner joints 440 and outer joints 442, each joint 440, 442 comprising a joint surface 444 and a joint mounting surface 446, each rear element being similar and complementary to that of the front plate 402 shown in FIG. 27. The rear elements are formed into the rear plate surface 438 such that the joint surface 444 connects the rear plate surface 438 to the joint mounting surface 446. The joints 440, 442 on the rear plate 406 are adapted to align complementary to the joints 412, 414 on the front plate 402. As such, the joint mounting surfaces 418, 446 on both plates 402, 406 align, permitting the plates 402, 406 to nest together. Furthermore, the rear plate 406 comprises an outer mounting surface 448, adapted to mount to the outer mounting surface 420 of the front plate 402 to seal the periphery of the two-part drive plate 400.

The rear plate 406 comprises a mount opening 464, defining a path from an area external of the rear plate 406 and internal of the rear plate 406, as separated by an outer edge 450 of the rear plate 406. A mount structure 466 is disposed within the mount opening 464, defining two pillar channels 468 on either side of the mount structure 466.

Each plate 402, 406 further comprises a bearing carrier opening 460 for accepting the bearing carrier 408. The rear plate 406 comprises a plurality of carrier mounts 462 providing a surface for which the bearing carrier 408 can couple.

Figure 29:
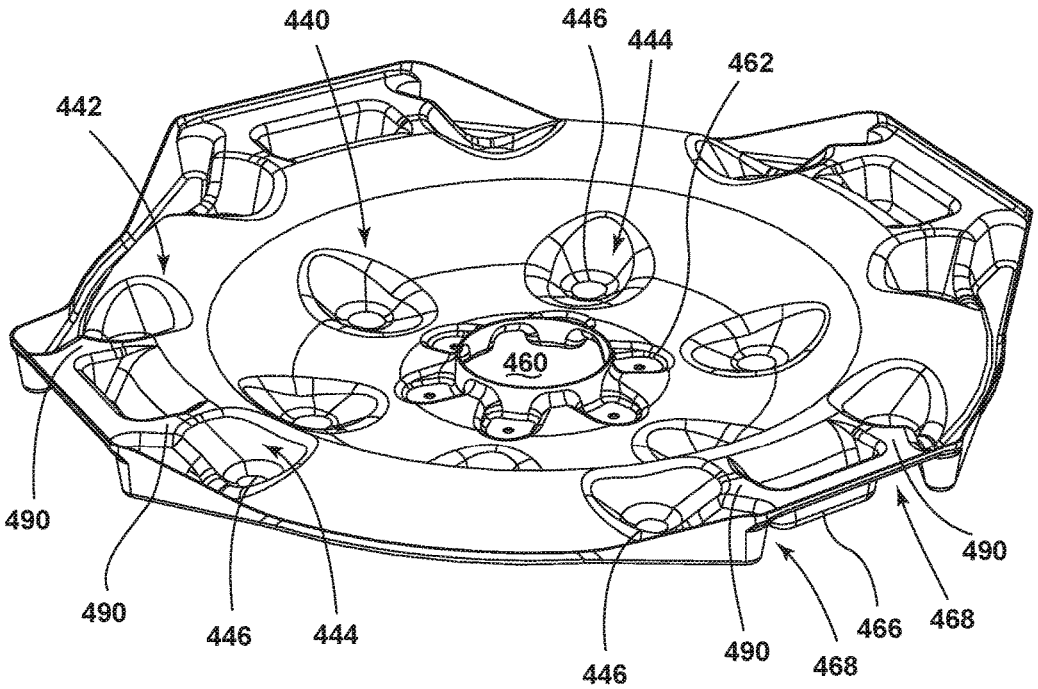
FIG. 29 is a rear view of a rear plate of the two-port drive plate of FIG. 28.

In FIG. 29, showing the rear view of the rear plate 406 of FIG. 28, a plurality of pillars 490 defining the pillar channels 468 can be seen. It should be appreciated that the pillars 490 define a structure for providing sufficient strength and stiffness for brace attachment to the mount structure 466. Additionally, the inlaid dimension of the pillars 490 and the pillar channels 468 provides increased torsional rigidity for supporting torsional forces of the rotating drum during operation of the washing machine.

Figure 30:
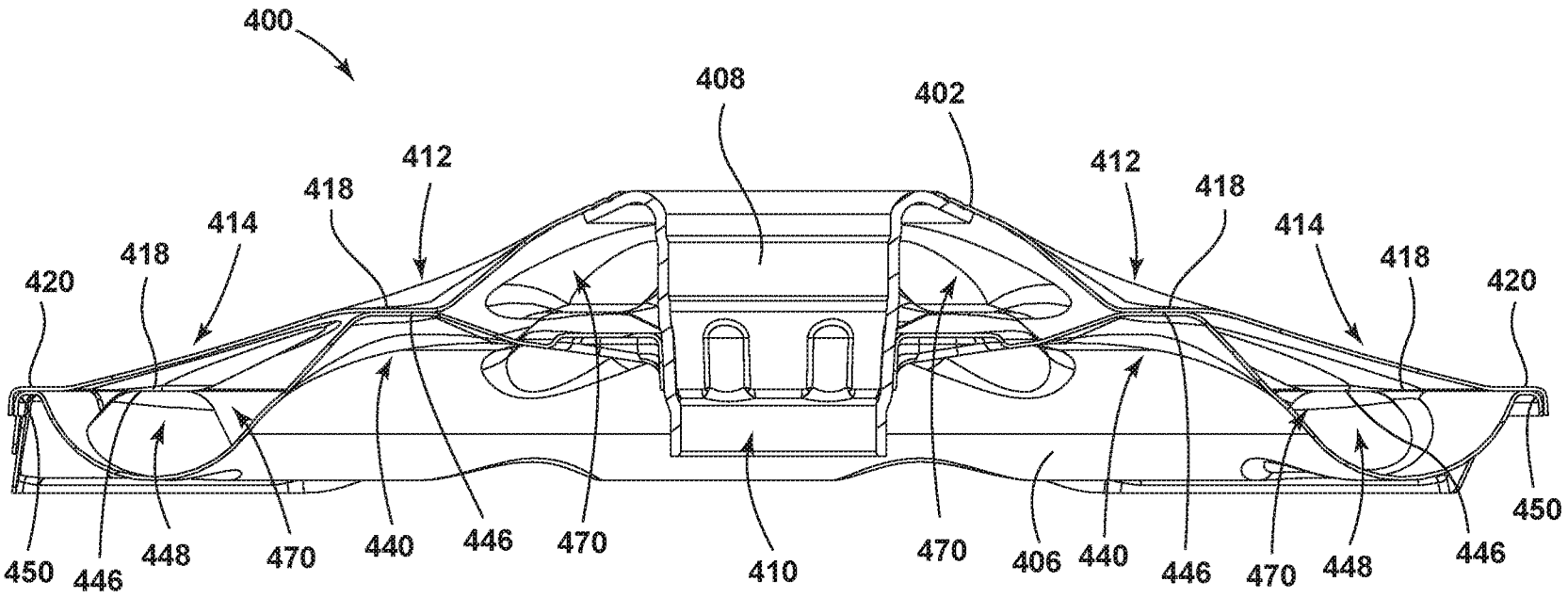
FIG. 30 is a side cross-sectional view of the two-part drive plate of FIG. 27.

In FIG. 30, a cross-sectional view illustrates the curved structure of the plates 402, 406, and illustrates the coupled mounting surfaces 418, 446. The curved structure of the plates 402, 406 defines an internal space 470 within the two-part drive plate 400. The dual-plate structure of the two-part drive plate 400 permits quick and inexpensive manufacturing of the front and rear plates 402, 406, while additionally comprising a drive plate that is structurally sound. Furthermore, the bearing carrier 408 can be easily installed within the two-part drive plate 400 when mounting the plates 402, 406 to one another.

Figure 31:
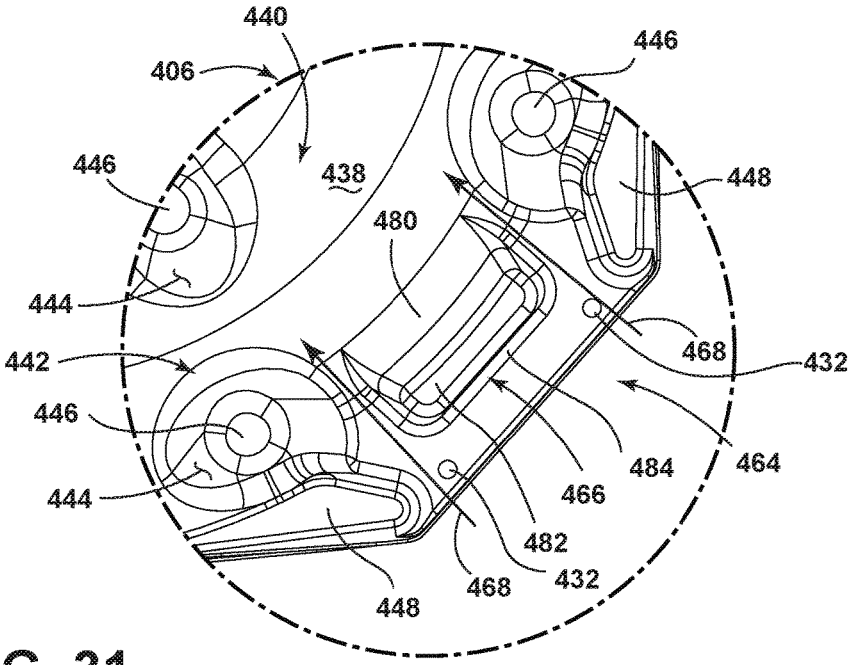
FIG. 31 is a front close-up view of a plurality of pillar channels through the rear plate of the two-part drive plate of FIG. 28.
Figure 32:
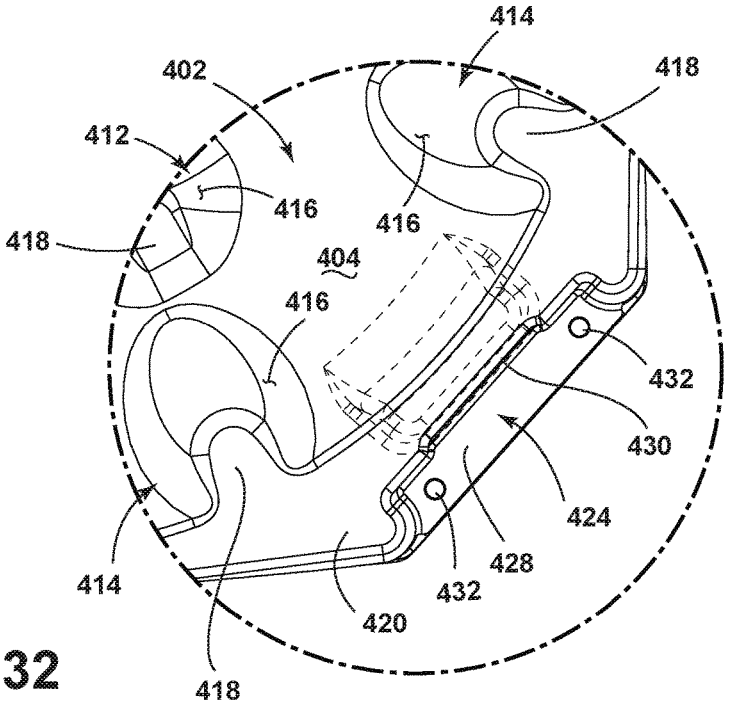
FIG. 32 is a front close-up view of the front-plate pillar structure of FIG. 27.

Turning now to FIG. 31, a close-up, front view of the mount opening 464 is shown. The mount structure 466 further comprises a ramp 480 inclined from the rear plate surface 438 to a step 482, defining a step face 484 disposed between and normal to the step 482 and the rear plate surface 438. The step face 484 provides a rigid surface defined within the structure of the rear plate 406, such that the mounting wall 424 of an attached front plate 402, best seen in FIG. 32, have a supporting structure for mounting braces or other elements to the mounting wall 424 and the two-part drive 400. Thus, the mounting walls 424 can be used with the exoskeleton 40 to provide structural integrity to the exoskeleton 40 by mounting a brace to the two-part drive 400. The brace in combination with a front support and the two-part drive plate 400 can comprise the exoskeleton 40, providing structural support for the motor 58 and drive 60 used to rotate the drum 42 within the exoskeleton 40. Additionally, the positioning of the pillars 490, being diagonal in reference to the outer edges 422, provides increased torsional rigidity as compared to a typical drive plate.

The two-part drive plate 400 is useful for mounting braces to maximize torsional and bending stiffness of the exoskeleton 40. The joints provide space for a semi-continuous weld around the assembly providing stiffness to the two-part drive plate 400. The two-part drive plate 400, in utilizing the two, coupled plates, can also be smaller and lighter than typical plates to decrease cost and system weight while maintaining sufficient rigidity. Furthermore, the mounting structures 466 provide integral surfaces for mounting braces 200, such as the braces of FIGS. 11-21. The frequency and location of the mounting structures 466 permit the mounting of braces 200 in order to obtain the required stiffness for the rear drive plate and the exoskeleton 40. Thus, the exoskeleton 40 can support the dynamic movement of the drum without sacrificing capacity and maintaining sufficient integrity.

Figure 33:
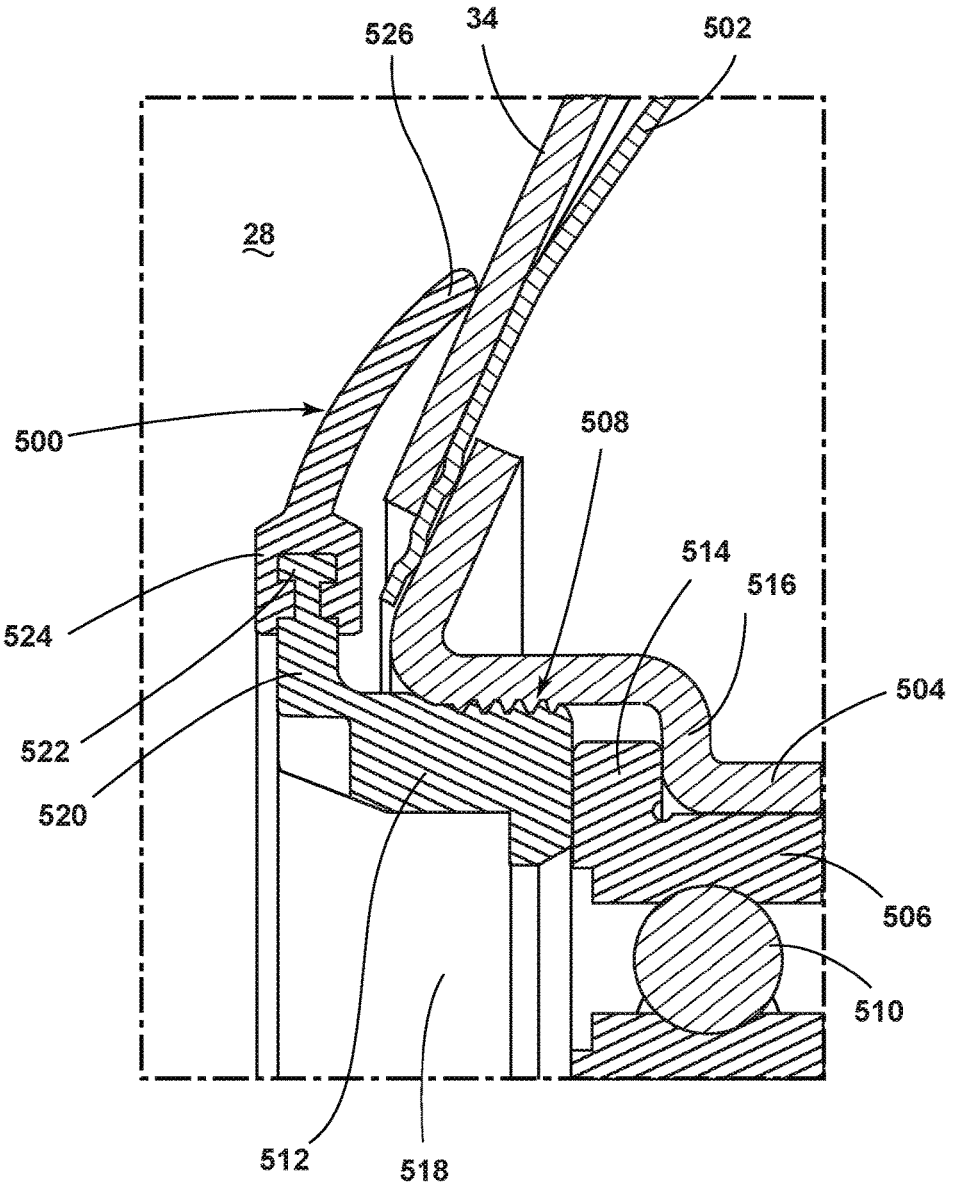
FIG. 33 is a close-up view of a wedged insert sealing a tub to a rear drive plate.

Turning now to FIG. 33, a seal 500 can be used to seal the tub 34, which can be the blow-molded tub 160 (FIG. 7) or any tub described herein, to a drive. The drive comprises a rear drive plate 502, which can be the two-part drive plate 400 (FIGS. 27-32) or any other rear drive plate described herein, and the bearing carrier 504. A bearing assembly 506 and a bearing 510 can be disposed within the bearing carrier 504 for supporting the drive shaft 60 from the motor 58 (FIG. 1). A seal assembly 512, positioned partially within the bearing carrier 504 and forward of the bearing assembly 506 relative to the front of the washing machine 10, 104, can extend partially within the liquid chamber 28 of the tub 34. The bearing assembly 506 can further comprise a drive flange 514 disposed between the bearing carrier 504 and the seal assembly 512, adjacent to the step-wise contour 516 of the bearing carrier 408. The seal assembly 512 comprises an annular body 518 with a mount 520 comprising a plug 522 extending within the liquid chamber of the tub 34 and radially from the longitudinal axis of rotation. The seal assembly 512 can couple to the bearing carrier 504 at a threaded connection 508 between the two. The mount 520 can be a plurality of discrete mounts 520 disposed on the body 518 or can be a continuous annular mount 520 with a continuous annular plug 522 extending therefrom.

The seal 500, comprising a receptacle 524, mounts onto the plug 522. A seal extension 526 extends from the receptacle 524 abutting the tub 34. The seal 500 seals the liquid chamber 28 of the tub 34 from the drive including the motor 58 as well as maintaining a water seal between the interior 26 and the liquid chamber 28 at the drive 60.

The seal 500 is useful with a one-piece tub, such as with the blow-molded tub 160 (FIG. 7). The seal 500 can be installed as part of the bearing assembly 506, sealing the tub 34 at the bearing carrier 408 and the drive plate 502. Thus, the motor 58 is protected from liquid, which can otherwise leak from the liquid chamber 28 into the interior 26 or to the motor 58 along a drive shaft 60.

Figure 34:
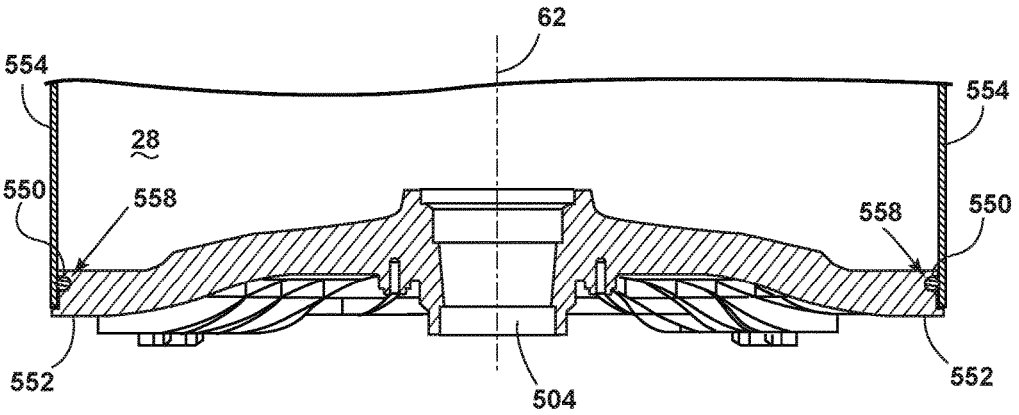
FIG. 34 is a schematic sectional view of a seal for sealing the tub to the drive plate.

Turning to FIG. 34, different ways to seal the tub to the rear drive plate are shown. A tub seal 550 for sealing a rear drive plate 552 to a one-piece tub 554, such as an extruded or blown tub, is shown. The one-piece tub 554, which can comprise any one-piece tub described herein, abuts the rear drive plate 552, such as the two-part drive plate 400 (FIGS. 27-32) or the rear drive plate 76 such that a small gap can exist or develop between the tub 34 and the rear drive plate 552. The rear drive plate 552 comprises an annular channel 558 with a seal 550 disposed in the channel 558. The seal 550 can comprise a removable seal 550 such as a rubber insert or gasket member, or can comprise a permanent seal 550 such as a weld or adhesive. Alternatively, the tub 554 can mount to a rear cap, overlapping and supporting the tub 554 within the chassis 12, as well as providing a watertight seal between the liquid chamber 28, the motor 58 and the interior 26.

Turning to FIGS. 35A-35D, multiple alternative seals 550 are shown for sealing the tub 554 to the rear drive plate 552. The seals as shown are exemplary and non-limiting, and should be understood as examples of seals 550, which can be used in sealing a tub 554 to a rear drive plate 552 or drive.

Figure 35A:
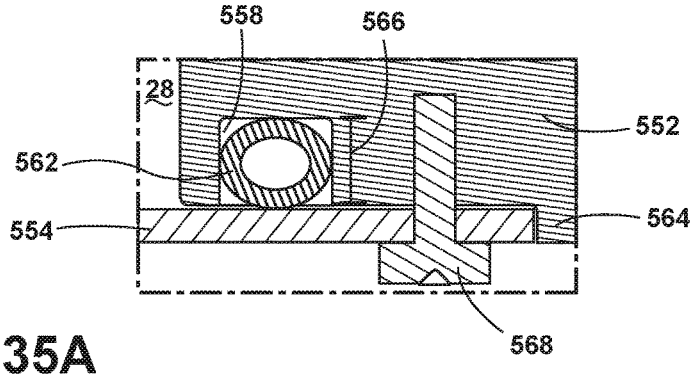
FIG. 35A is a schematic view of the drive seal of FIG. 34 comprising a hollow, circular seal.

Turning to FIG. 35A, a seal 550 is shown as an annular hollow seal 562 comprising a hollow circular profile. The seal 562 can comprise a flexible material such as rubber or plastic, in non-limiting examples, as well as a rigid material. The rear drive plate 552 can further comprise an end flange 564 of which the tub 554 can abut. The seal 562 is disposed within the channel 558, abutting the inside surface of the tub 554. The channel 558 is shaped to have a radial height 566, such that the seal 562 within the channel 558 extends out of the channel 558 and abuts the tub 554. Thus, the seal 562 within the channel 558 is slightly compressed between the rear drive plate 552 and the tub 554, creating a watertight seal. Additionally, a fastener 568, such as a screw or bolt in non-limiting examples, can be inserted through the tub 554 and into the rear drive plate 552, securing the tub 554 in place around the rear drive plate 552.

Figure 35B:
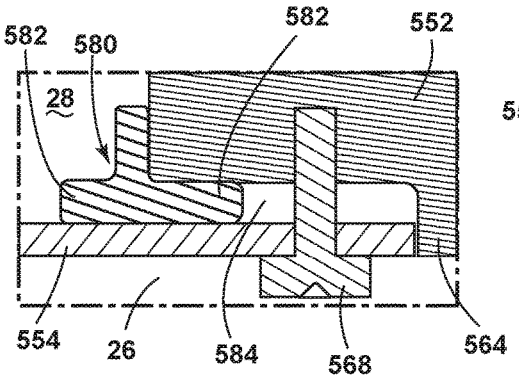
FIG. 35B is a schematic view of the drive seal of FIG. 34 comprising a "T-shaped" seal.

Turning now to FIG. 35B, the seal 550 is shown as a "T-shaped" seal 580. The seal 580 has a "T-shaped" profile, comprising two seal flanges 582 with one seal flange 582 disposed between the rear drive plate 552 and the tub 554, such that a seal recess 584 exists between the rear drive plate 552 and the tub 554 behind the seal 580. The fastener 568 can be inserted into the tub 554, through the seal recess 584, and into the rear drive plate 552, compressing the seal 580 to be watertight. Alternatively, the seal 580 can comprise an "L-shaped" profile, having only a single seal flange 582 disposed between the tub 554 and the rear drive plate 552.

Figure 35C:
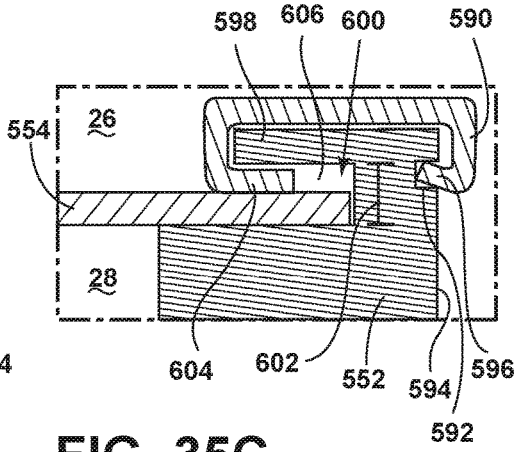
FIG. 35C is a schematic view of the drive seal of FIG. 34 comprising a clamp seal.

In FIG. 35C, the seal 550 is shown as a clamp 590 used in place of the screws of FIGS. 35A and 35B. The clamp 590 secures the tub 554 to the rear drive plate 552. The clamp 590 can comprise any compressible material such as plastic, metal, or rubber, or can comprise rigid materials such as aluminum or steel in non-limiting examples. The rear drive plate 552 comprises a groove 592 disposed on the rear side 594 of the rear drive plate 552 for accepting a clamp hook 596. The rear drive plate 552 further comprises an annular "L-shaped" flange 598 defining a channel 600 with a height 602 sufficient to receive the tub 554 and compress an elongated clamp hook 604, opposite of the initial clamp hook 596, between the tub 554 and the flange 598. The clamp 590 can be sized such that the elongated clamp hook 604 extending into the channel 600 leaves a channel space 606 within the channel 600 supporting dynamic movement of the tub 554 and the rear drive plate 552. Additionally, a gasket member (not shown) can be included to assist in sealing the tub to the rear drive plate 552.

Figure 35D:
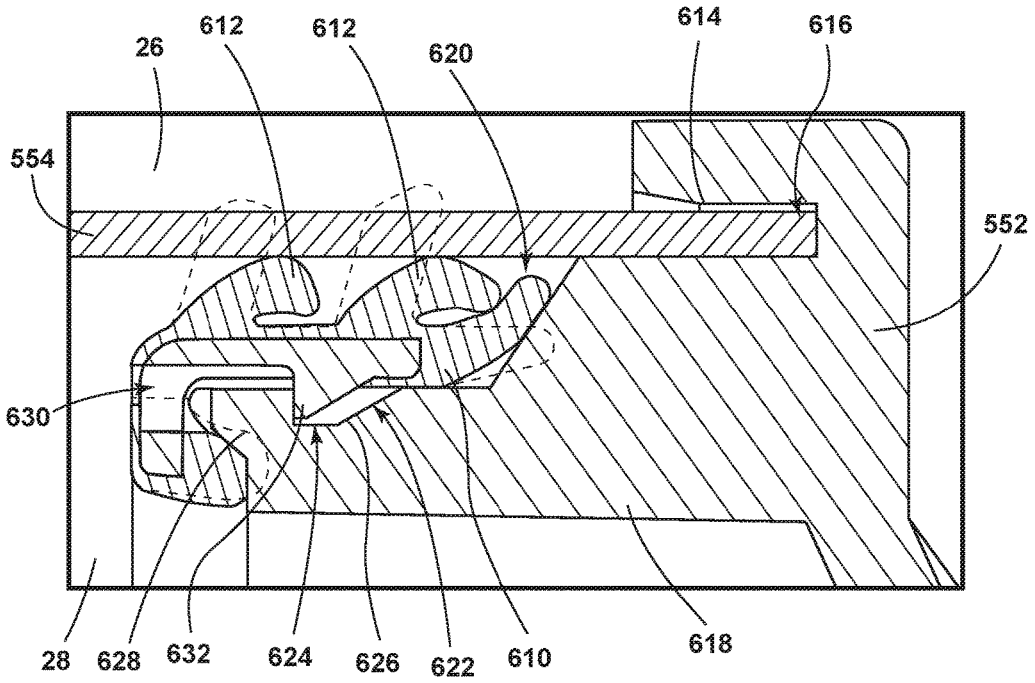
FIG. 35D is a schematic view of the drive seal of FIG. 34 comprising a plurality of fins with a locking protrusion.

In FIG. 35D, the seal 610 is shown comprising a plurality of fins 612. An upper flange 614 defines a first channel 616 for receiving the tub 554 at the rear drive plate 552. A lower flange 618 defines a second channel 620 between the lower flange 618 and the tub 554. The lower flange 618 comprises a contoured surface 622 has a profile comprising a step 624 extending into a ramp 626, which defines the inner surface of the annular second channel 620.

The seal 610 is shown having three fins 612 within the second channel 620, while any number of fins 612 is contemplated. Additionally, a fourth fin 612 is disposed outside of the second channel 620, sealing the tub 554 at a protruding edge 628 of the lower flange 618. The seal 610 further comprises a rigid internal member 630, having a protrusion 632 adapted to be received in the step 624.

During installation, the seal 610 can be inserted over the second flange 618, with the protrusion 632 extending into the step 624. The tub 554 is inserted into the first channel 616, compressing the fins 612 from an initial position shown in phantom, creating a watertight seal and creating a force that secures the tub 554 against the upper flange 614. The protrusion 632 secures the seal 610 within the step 624 such that any movement of the washing machine 10 cannot loosen the tub 554 as secured to the rear drive plate 552. The seals of FIGS. 34 and 35A-35D can increase tub 34 capacity by eliminating the need for a weld seam in the middle of the typical two-piece, vertical-seam tub by enabling effective sealing at the rear end of a one-piece tub 34. The first seal in FIG. 35A utilizes the seal 562 disposed within the channel 558, allowing a one-piece tub 554 mount seal to the rear drive plate 552, eliminating the need for the weld or seam of a two-piece tub, increasing capacity. The second seal in FIG. 35B, utilizes a T-shaped seal 580, eliminating the need for a weld or seam of a two-piece tub, similar to FIG. 35A. The clamp 590 utilized in FIG. 35C seals a one-piece tub to the rear drive plate 552, reducing the seam of a two-part tub. The clamp 590 is further disposed outside of the tub 554, utilizing space within the interior 26 without reducing capacity of the liquid chamber 28. The seal of FIG. 35D utilizes a seal 610, which can lock onto the drive, utilizing a press fit to hold the tub 554 in place, increasing capacity by removing the seam required for two-piece tubs. Furthermore, the tub 554 with any of the disclosed seals can be easily removed for ease of servicing the washing machine 10.

Figure 36:
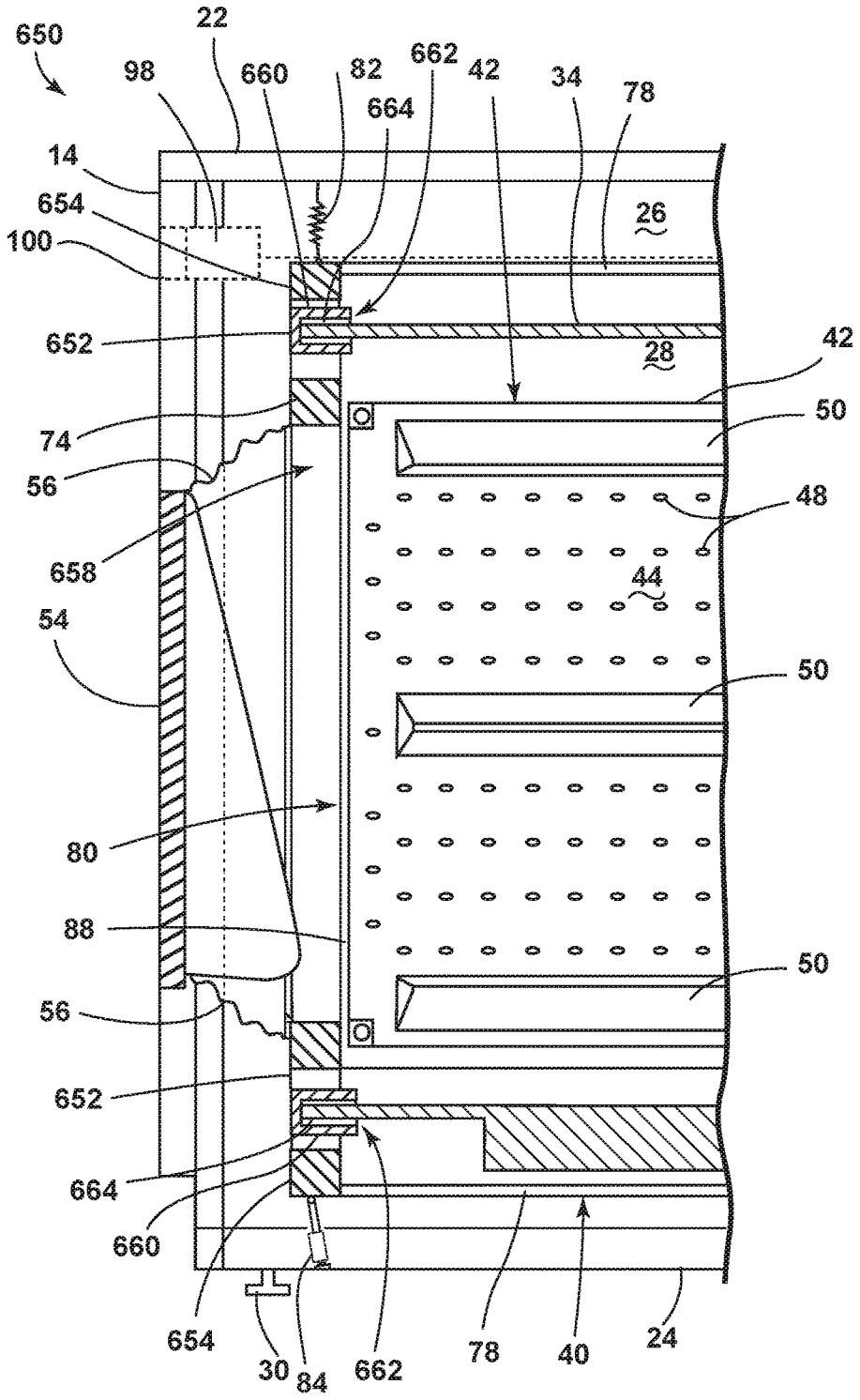
FIG. 36 is a schematic sectional view of the front support for a dynamic tub having an exoskeleton structure with a seal at the junction between the tub and the front support.

Turning now to FIG. 36, seals 664 can be used for sealing the tub 34 to the front of a washing machine 650. The washing machine 650 is substantially similar to the washing machine 10 of FIG. 2. As such, similar numerals will be used to identify similar elements.

The washing machine 650 comprises a front support 652 used to seal liquid chamber 28 of the tub 34 from the interior 26 of the chassis 12. The front support 652 can mount to the tub 34 to the chassis 12 with a mount 654; however, the tub 34 can be fixed to the chassis 12 by other means. The front support 652 is an annular shape, and defines an opening 658 surrounding the bellows 56 through which the central opening 80 is defined.

The front support 652 also comprises a seal flange 660 radially around the front support 652. The seal flange 660 further defines an annular channel 662 adjacent to the tub 34. A seal 664 can be disposed within the channel 662 for receiving the front end of the tub 34 and sealing the interior 26 from the liquid chamber 28 at the front of the washing machine 650. The seal 664 can be sized such that insertion of the tub 34 within the seal 664, and the seal 664 within the channel 662 compresses the seal 664, creating a watertight seal within the channel 662.

Turning now to FIGS. 37A-37D, alternative seals of the seal 664 of FIG. 36 are shown. The seals shown in FIGS. 37A-37D are exemplary and non-limiting, and should be understood as examples of seals that can be used in sealing the one-piece tub or any other tub described herein. For simplicity, similar elements will be described with similar numerals.

Figure 37A:
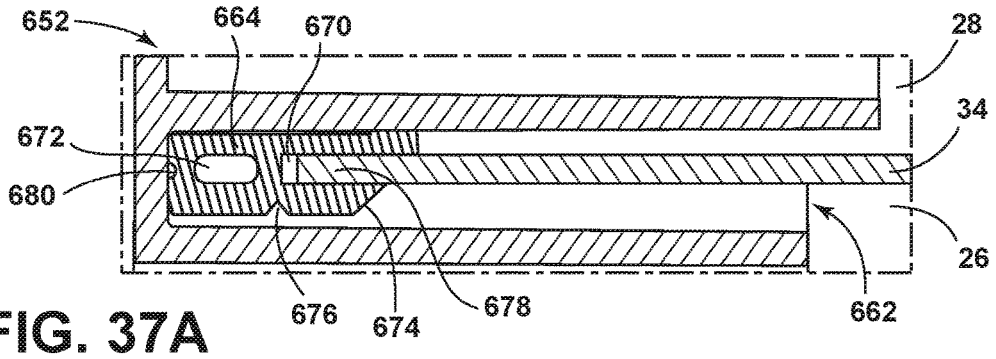
FIG. 37A is a schematic view of the front seal of FIG. 36 comprising a slot and a cavity.

In FIG. 37A, the seal 664 comprises a slot 670 for receiving the tub 34. The seal 664 further comprises a cavity 672 positioned behind the slot 670 relative to the direction of insertion of the tub 34 into the slot 670, and a recess 680 at the end of the seal 664. The seal 664 can further comprise a beveled edge 674 and one or more slits 676 facilitating the insertion of a tub end 678 into the slot 670. Additionally, the slit 676 and the cavity 672 can permit the seal 664 to flex during insertion such that the tub 34 is inserted without damaging the front support 652.

Figure 37B:
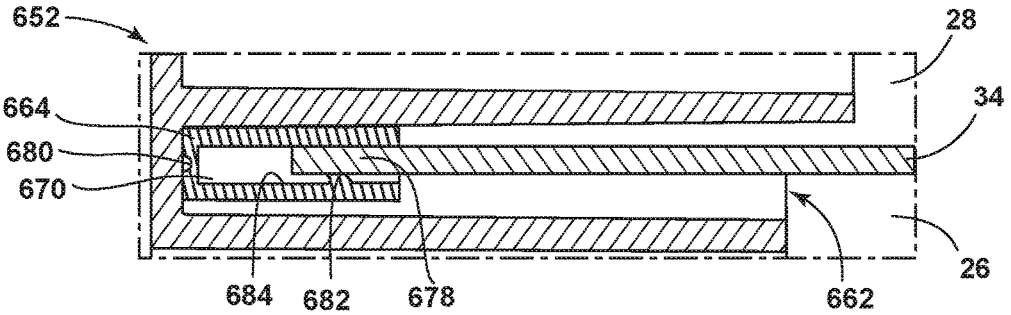
FIG. 37B is a schematic view of the front seal of FIG. 36 comprising a fin in the slot.

Turning to FIG. 37B, the seal 664 is shown comprising a fin 682 on an inner surface 684 of the seal 664 in the slot 670. The fin 682 is oriented such that it is angled inwardly in the direction the tub 34 in inserted, permitting the fin 682 to flex inwardly during insertion. As such, the fin 682 is sandwiched between the seal 664 and the tub 34, further securing the tub 34 in place while creating a watertight seal.

Figure 37C:
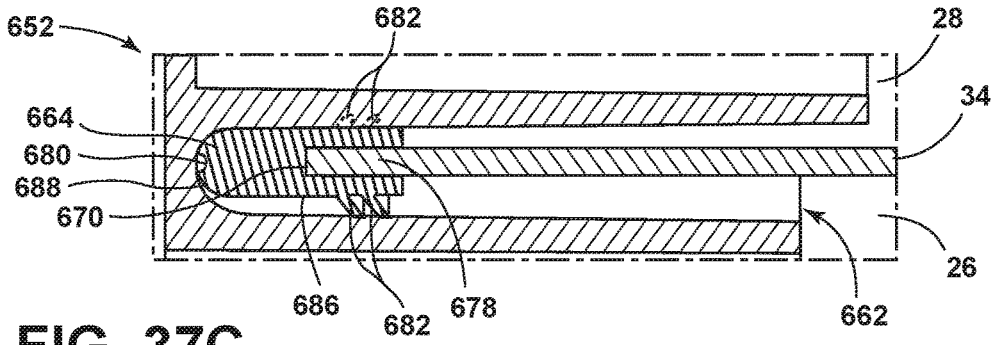
FIG. 37C is a schematic view of the front seal of FIG. 36 comprising a plurality of outer fins.

In FIG. 37C, the seal 664 comprises multiple fins 682 on an outer surface 686 of the seal 664. The seal 664 further comprises a curved end 688 adapted to be received in a curved space at the end of the channel 662. The seal 664 can be secured to the end of the tub 34 prior to insertion into the channel 662. The tub 34 can be inserted into the slot 670 and then the combination thereof can be inserted into the channel 662. The fins 682 are disposed at an angle such that they can compressibly flex against the seal 664. During insertion, the fins 682 will flex, permitting sliding movement into the channel 662. Additionally, the curved end 688 accepts the flexible material of the seal 664 and can flex such that insertion will not damage the front support 652. The angle of the fins 682 can resist any force, such as movement of the washing machine 650, which would normally tend to pull the tub 34 out of the channel 662. Additionally, the fins 682 will push radially outwardly, creating the watertight seal between the tub 34 and the front support 652.

Figure 37D:
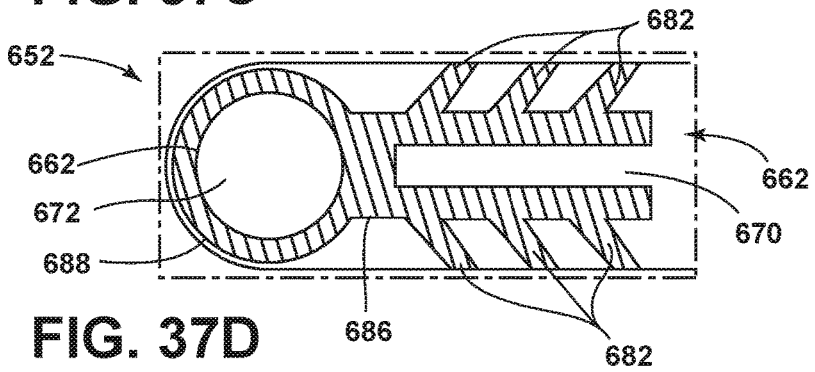
FIG. 37D is a schematic view of the front seal of FIG. 36 comprising the plurality of outer fins and the cavity.

Turning now to FIG. 37D, the seal 664 is shown combining elements of FIGS. 36A and 36C. The end 688 comprises a curved shape, defining the cavity 672 within the end 688 of the seal 664. Additionally, six fins 682 are disposed on the outer surface 686 of the seal. During insertion, the cavity 672 permits flexion of the seal 664, minimizing any damage and providing a restoring force against the insertion force of the tub 34 as it is inserted.

The seals 664 of FIGS. 36 and 37A-37D can increase tub 34 capacity by eliminating the need for a weld seam at the front of the tub 34 by enabling appropriate sealing at the front end of a one-piece tub 34. Furthermore, the tub 34 can be removable for ease of servicing the washing machine 650. Additionally, the use of the fins 682 provides a press-fit, which secures the tub 34 within the channel 662.

Figure 38:
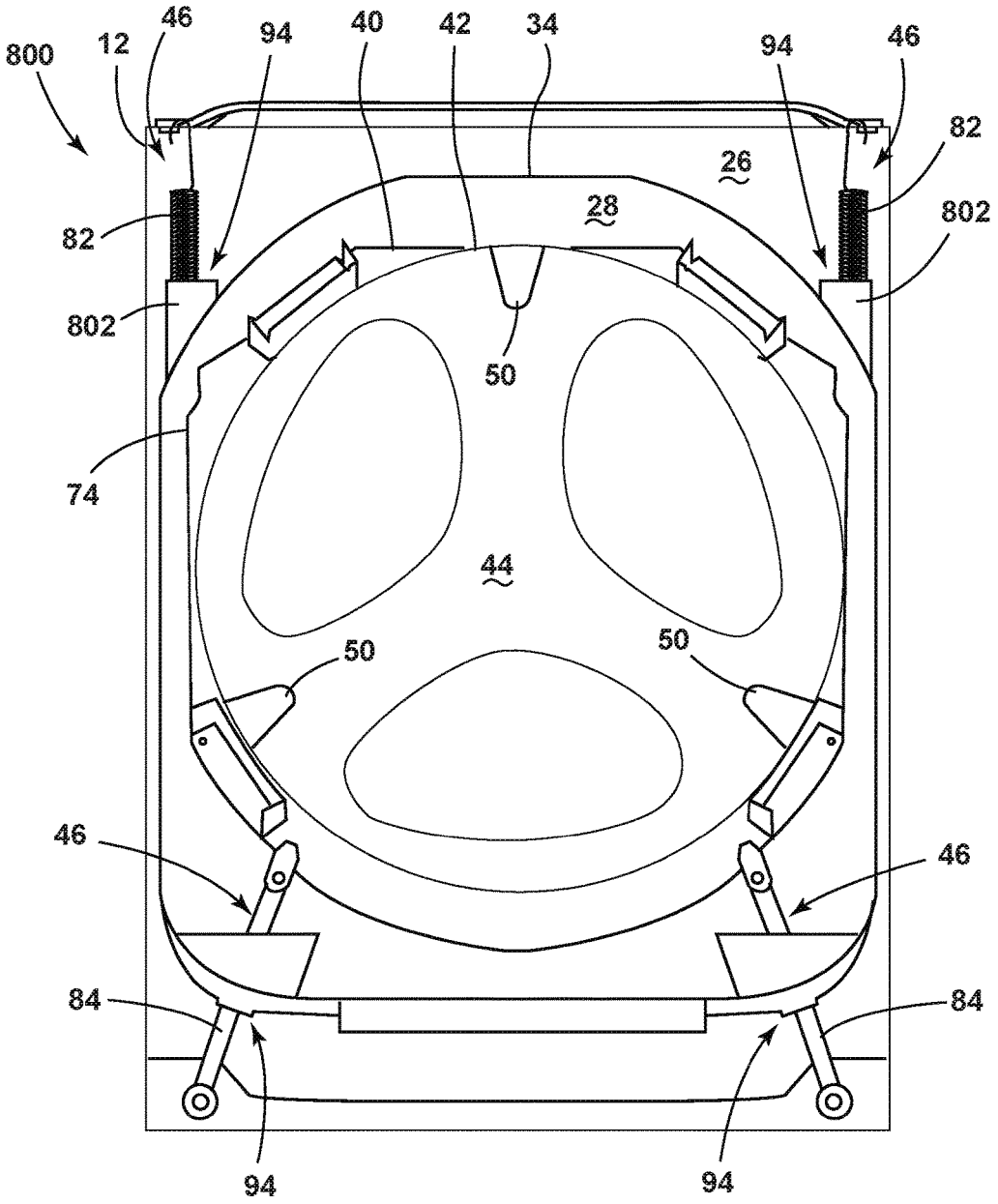
FIG. 38 is a schematic, front view of the laundry treating appliance with a chimney formed in the tub.

FIG. 38 shows a schematic front view of a washing machine 800 comprising one or more chimneys 802. The washing machine 800 comprises similar elements to that of FIG. 1 and similar numerals will be used to identify like elements. The suspension openings 94 further comprise one or more chimneys 802 disposed along the top area of the tub 34. The chimney 802 can be formed as part of the tub 34 or can be mounted to the tub 34. The springs 82 comprising the suspension 46 extend through the chimneys 802, mounting the exoskeleton 40, the front support 74, or the rear drive plate 76, or any other suitable mounting structure, to the chassis 12.

Figure 39:
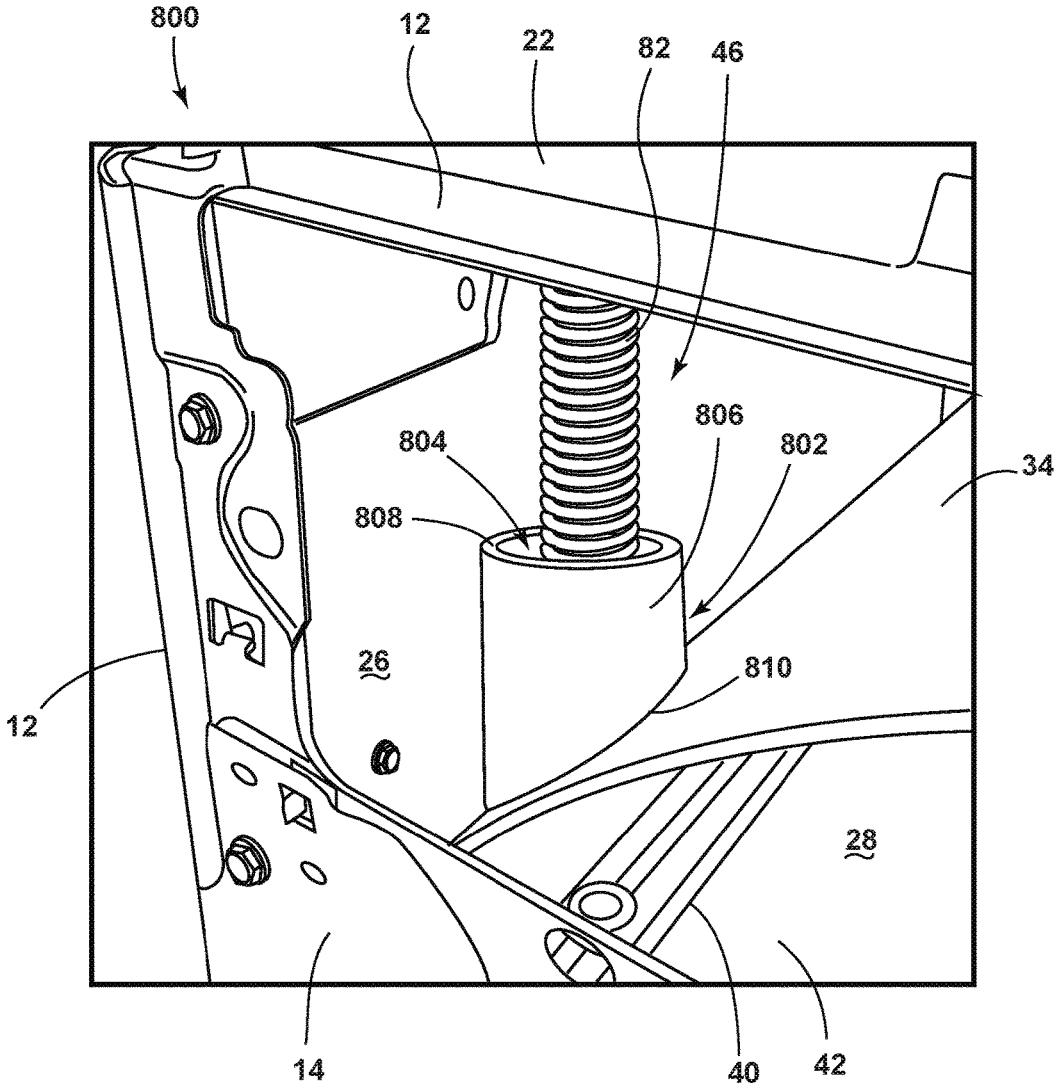
FIG. 39 is a close-up, perspective view of the chimney of FIG. 38 with a suspension extending through the chimney.

Turning to FIG. 39, a close-up view of the chimney 802 best shows a chimney channel 804. The chimney 802 comprises a cylindrical chimney wall 806 defining the chimney channel 804 extending longitudinally from the tub 34. The chimney wall 806 terminates at a terminal end 808 opposite of a junction 810 between the chimney wall 806 and the tub 34. The suspension 46, shown as a spring 82, extends through the chimney channel 804, mounting the exoskeleton 40 to the chassis 12 or the upper wall 22 of the washing machine 800. As shown, the chimney 802 extends approximately one-third of the way up the spring 82 from the tub 34, however, the chimney 802 can be shorter or taller, or extend fully from the tub 34 to the chassis 12, fully enclosing the spring 82.

The chimney 802 frustrates liquid within the liquid chamber 28 from splashing up through the suspension openings 94 and into the interior 26 where liquid can damage internal components or spill out onto the floor from the chassis 12. As the drum creates splashing liquid 42 during a cycle of operation, that splashing liquid can splash toward the suspension opening 94 where it can exit from the liquid chamber 28 to the interior 26. The height of the chimney walls 806 provide a blocking or catching area, which the splashing liquid or humid air can contact. The splashing liquid or any condensate from humid air can run back down the chimney 802 and back into the liquid chamber 28. Thus, liquid is frustrated from escaping into the interior 26 without the need for an expensive rubber gasket or boot to seal the suspension opening 94.

Figure 40:
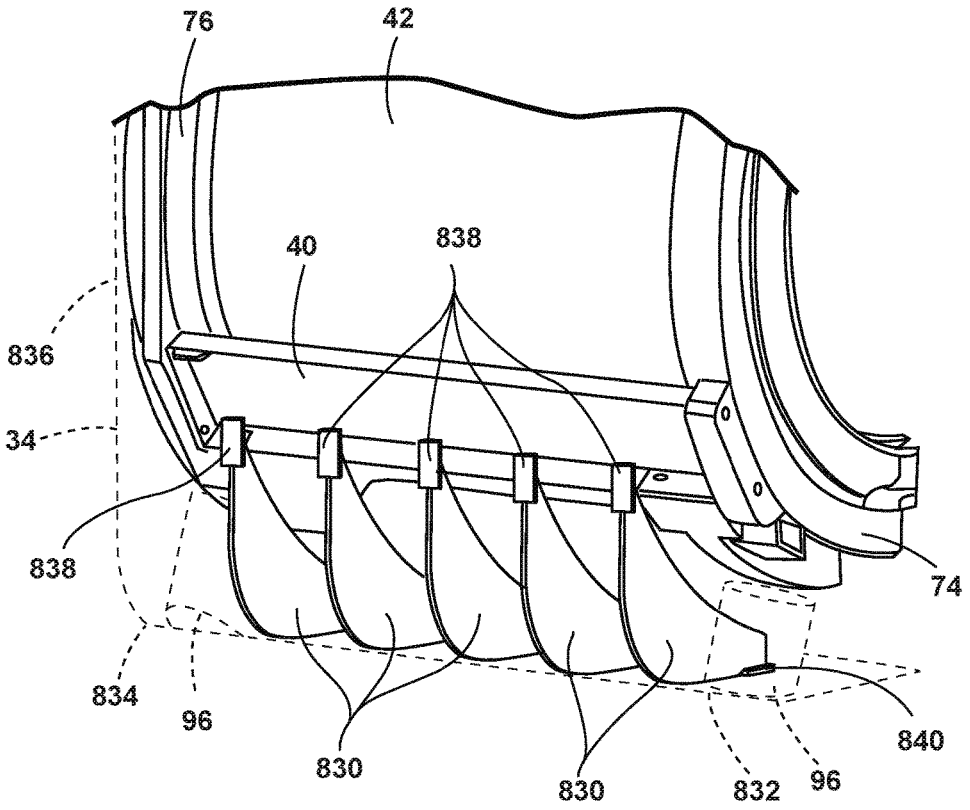
FIG. 40 is a schematic perspective view of the laundry treating appliance with a plurality of baffles disposed within the bottom of the tub.

Turning to FIG. 40, a tub 34 is shown having a plurality of baffles 830 at a bottom wall 832 of the tub 34. The baffles 830 comprise a somewhat curved triangular shape, following a curved transition 834 from a tub sidewall 836 to the tub bottom wall 832. The baffles 830 abut the tub sidewall 836 and the tub bottom wall 832, as well as the contact the entire surface of the transition curve 834 therebetween. The baffles 830 further comprise a wall mount 838 and a bottom mount 840, each mount 838, 840 defining having a flat surface for mounting the baffles 830 to the tub 34, such as by welding or adhesives in non-limiting examples.

Figure 41A:
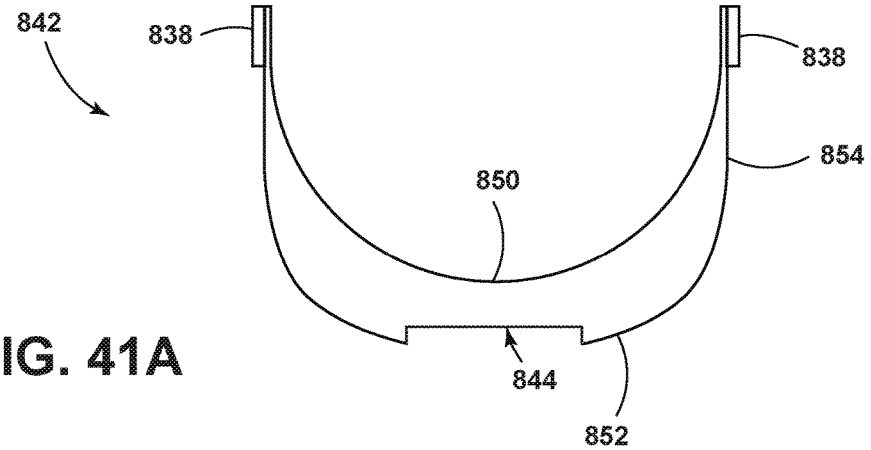
FIG. 41A is a front view of one baffle of FIG. 40 with an opening in the bottom of the baffle.
Figure 41B:
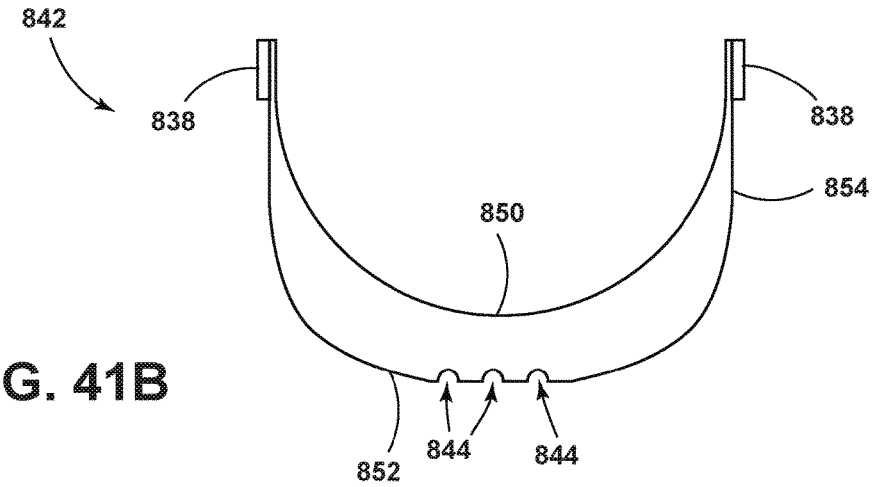
FIG. 41B is a front view of one baffle of FIG. 40 with multiple openings in the bottom of the baffle.
Figure 41C:
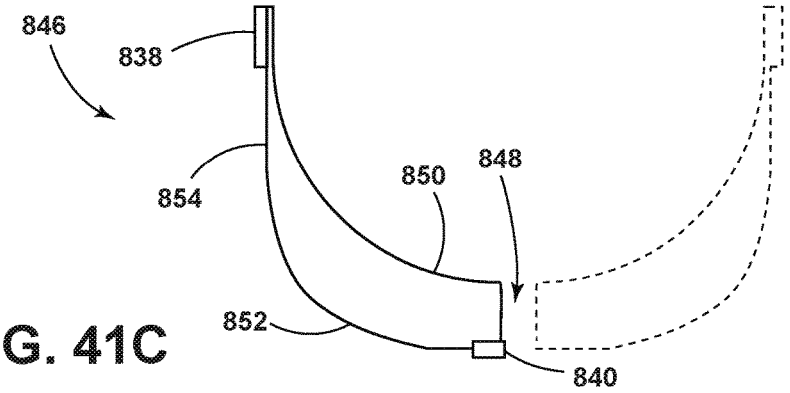
FIG. 41C is a front view of one baffle of FIG. 40 comprising a two-piece baffle with a baffle channel between the baffles.

Turning now to FIGS. 41A-41C, three different examples of the baffles 830 are shown. It should be understood that these baffles are exemplary and non-limiting, and the baffles 830 utilized within the tub 34 can comprise various shapes, quantities, functionalities, or otherwise such that liquid flow within the liquid chamber below the tub 34 can be at least partially retarded.

In FIG. 41A, a full baffle 842 is shown wherein a full baffle 842 is a baffle 830 that extends fully along the bottom wall 832 connecting opposing sidewalls 836. The full baffle 842 comprises a top edge 850 and a bottom edge 852, the edges 850, 852 having an arcuate shape extending from a vertical or near vertical edge against the tub sidewall 836 to a horizontal or near horizontal bottom edge 852 near the tub bottom 832. The full baffle 842 can further comprise an opening 844 along the bottom wall 83. While a quadrilateral shaped opening 844 is shown, any shaped opening is contemplated. The opening 844 provides fluid communication between areas of the tub 34, which might otherwise be separated by the baffles 830. The fluid communication through the openings 844 in the baffles 830 permits liquid within the tub 34 to move along the bottom 832 of the tub 34, such that the liquid can flow to a drainage area, such as the sump assembly 32 (FIG. 1), which might not be disposed along the entirety of the tub bottom wall 832.

Turning now to FIG. 41B, a full baffle 842 is shown having multiple openings 844 disposed within the baffle 830 along the bottom wall 832 of the tub 34. As can be appreciated, the size, shape, amount, or placement of openings 844 within the baffles 830 can be altered to control the flow of liquid between the baffles 830 in order to promote optimal flow within the tub 34 while minimizing unwanted waves or splashing, which might otherwise escape into the interior 26, such as through the suspension openings 94, for example.

In FIG. 41C, a partial baffle 846 is shown such that the partial baffle 846 will only extend partially along the tub bottom wall 832, only connecting between one tub sidewall 836 and the tub bottom wall 832. Additionally, a baffle sidewall 854 exists on the inner edge of the baffle. Two partial baffles 846 can be disposed complementary to one another, mounted to opposing tub sidewalls 836. Thus, a baffle channel 848 is created between the baffles 846, permitting fluid communication along the entire bottom wall 832, such that fluid can flow to the sump assembly 32 which might be located only toward one end of the tub 34. This type of structure permits increased liquid flow along the bottom of the tub 832 while sufficiently retarding any turbulent liquid flow that can otherwise escape through a suspension opening 94.

As can be appreciated, the baffles 830 are advantageous in minimizing turbulent liquid movement within the tub 34, such as splashing or churning. Splashed liquid can splash, for example, into a suspension opening 94 and flow into the interior 26 of the chassis 12, potentially damaging internal components or spilling out onto the floor surrounding the washing machine 10. The baffles 830 operate to slow the turbulent flow of liquid, minimizing unwanted splashing and protecting the suspension openings 94, without sacrificing the suspension 46 mounting the exoskeleton 40 to the chassis 12 through the bottom of the tub 34.

Figure 42:
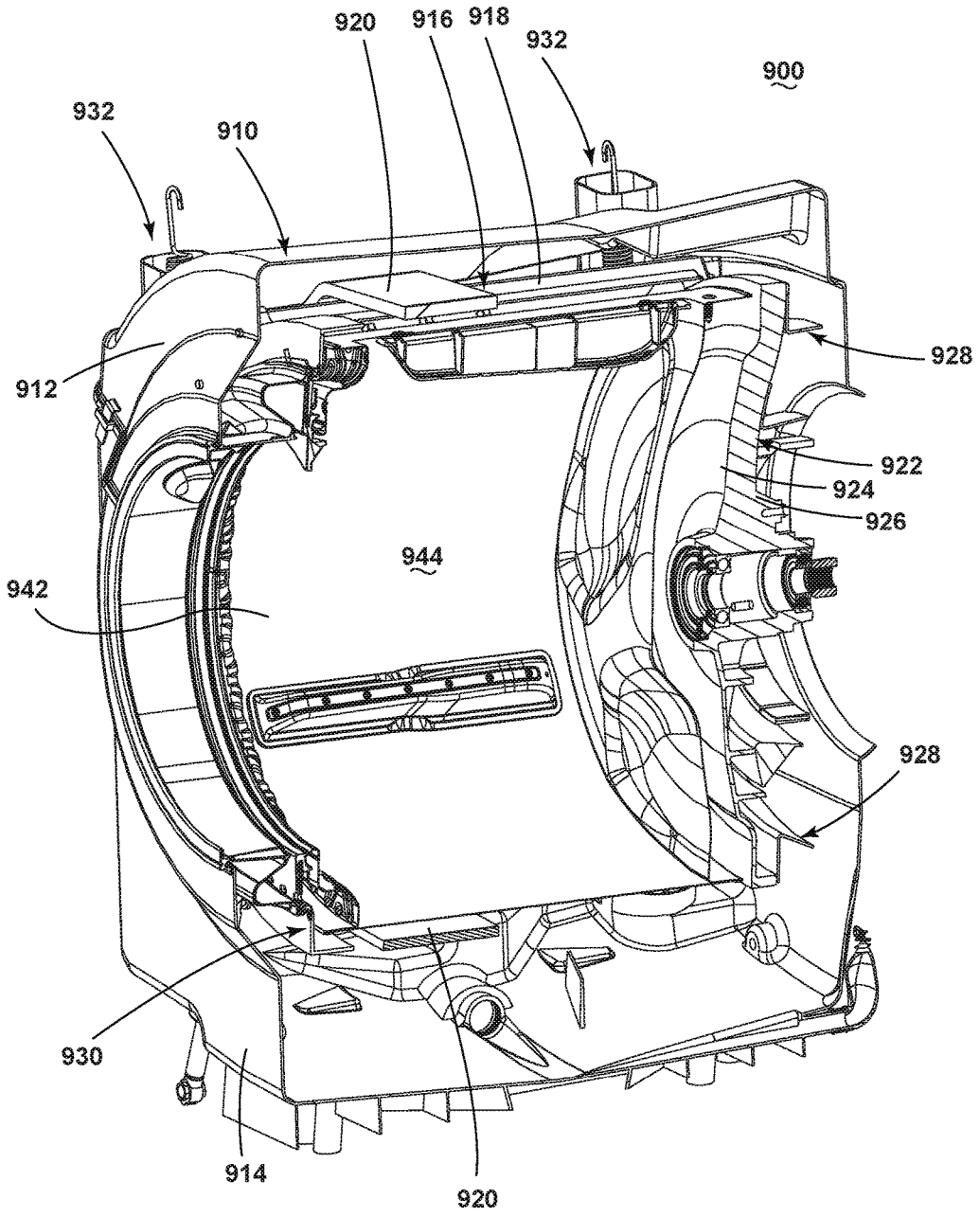
FIG. 42 is a perspective cross-sectional view of the combined washing machine having the fixed tub embodiment.

In FIG. 42 a perspective, cross-sectional view of a washing machine 900 illustrates the assembled fixed, two-part tub 910, the exoskeleton structure 916, the rear drive plate 922, the labyrinth seal 928, and the chimneys 932 on the tub. The fixed, two-part tub of FIGS. 22 and 23 comprises an upper portion 912 and a lower portion 914 and houses the exoskeleton structure 916. The exoskeleton structure 916 comprises one or more braces 918 mounted between the rear drive plate 922 and the front support 930. The exoskeleton structure 916 surrounds the drum 942 defining an interior chamber 944, such that dynamic movement of the drum 942 during operation of the washing machine 900 can be supported by the exoskeleton structure 916 at the front support 930 and the rear drive plate 922. The braces 918 can comprise any of the braces described herein, such as the braces or implementations thereof in FIGS. 9A-21G. A counterweight 920 can mount between adjacent braces 918. Toward the rear of the washing machine 900, the braces 918 mount to the rear drive plate 922, which can comprise the rear drive plate of FIGS. 27-32. Behind the rear drive plate 922 is the labyrinth seal 928, which can comprise the labyrinth seal of FIGS. 24-26B. The chimney 932 are disposed in and extend from the upper portion 912 of the fixed tub 910, such that a suspension can extend through the chimney 932 to mount the exoskeleton structure 916 to the washing machine housing such as the chassis 12 of FIGS. 1 and 2.

Figure 43:
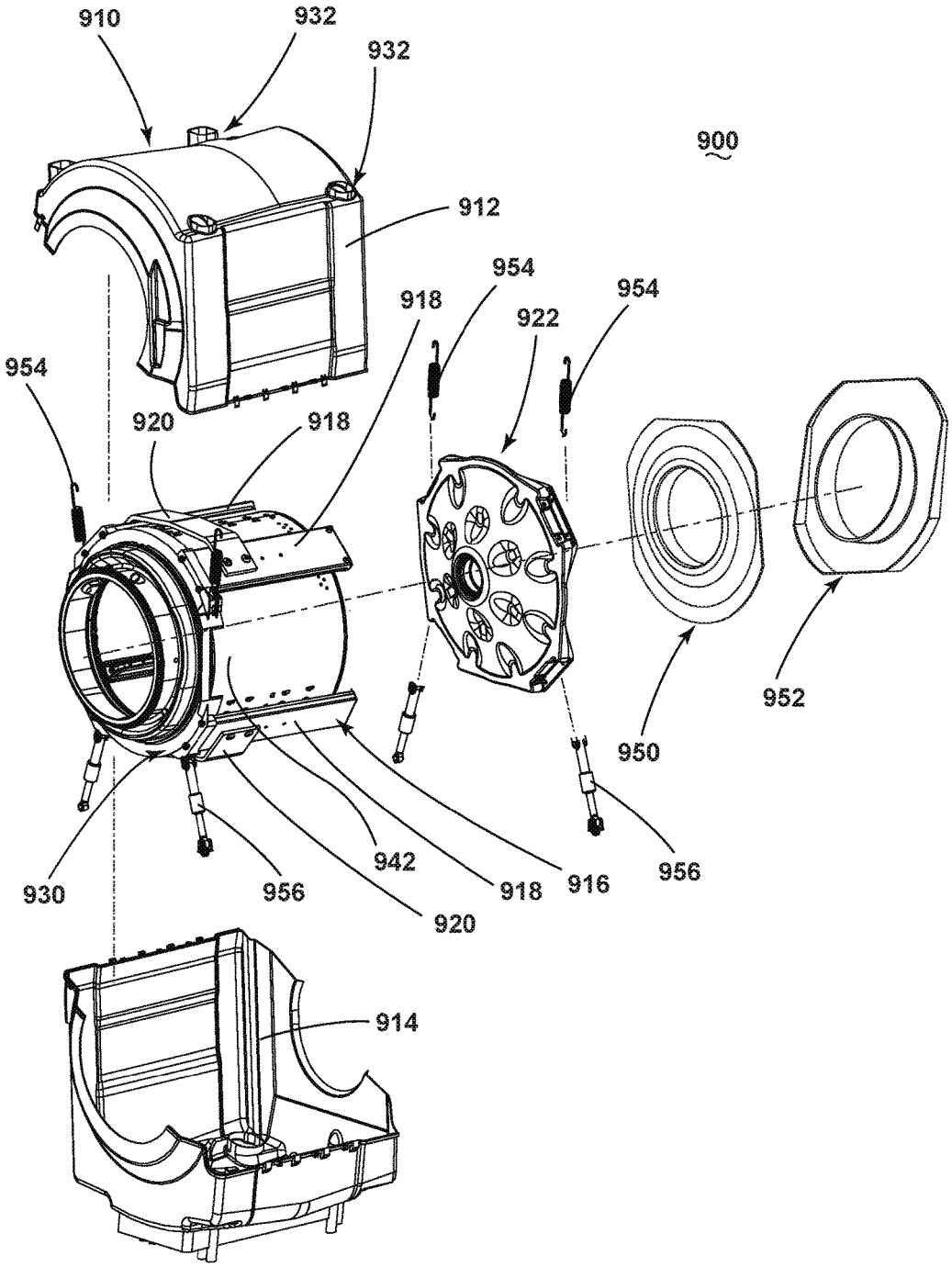
FIG. 43 is an exploded view illustrating the inventive concepts included in the fixed tub embodiment

Turning to FIG. 43, an exploded view illustrates the combination of the associated elements comprising the washing machine 900 of FIG. 42. The upper portion 912 and the lower portion 914 of the fixed tub 910 couple together to house the exoskeleton structure 916 and the drum 942. A plurality of springs 954 can couple to the exoskeleton structure 916 to the chassis through the chimneys 932. The rear drive plate 922 mounts at the rear of the drum 942 and can comprise at least part of the exoskeleton structure 916, coupling to the braces 918. The rear braces 954 and a set of rear dampers 956 can mount to the rear drive plate 922 for dynamically mounting the exoskeleton system 916 at the rear drive plate 922. The labyrinth seal 928 comprises a front plate 950 and a rear plate 952, the combination of which can define a labyrinth path. The front plate 950 can mount to the rear of the rear drive plate 922 and the rear plate 952 can mount to the rear of the tub 910, such that the labyrinth path is defined. The labyrinth seal frustrates any liquid disposed within the tub 910 from reaching the motor or drive system.

As can be further appreciated, the aforementioned aspects are useful in increasing the capacity of the treating chamber, permitting a greater volume of laundry to be treated in a cycle. The aspects comprise a fixed tub having a suspended exoskeleton therein; a suspended tub with a fixed exoskeleton therein; an extruded sheet which can be utilized to form a tub; an extruded cylinder which can be utilized to form a tub; a tub formed by blow molding; mounting braces to a tub utilizing fasteners, fins, or channel members; a plurality of braces which can be rolled U-channel braces, rolled U-channel braces with an end cap, a drawn brace, or a folded braces which can be used as the structural members to increase integrity of the tub or the exoskeleton; a two-piece tub with a substantially horizontal seam; a labyrinth seal disposed between the tub and the rear drive plate; a two-part drive plate; a wedged insert for sealing a tub to a rear drive plate; a seal disposed around the radial periphery of the rear drive plate sealing the tub to the rear drive plate; a seal disposed around the radial periphery of the front cover sealing the tub to the front cover; one or more chimneys comprising a suspension opening in the top of the tub; and one or more baffles disposed within the bottom of the tub. These aspects all lead to a larger laundry treating capacity by increasing tub capacity, or solving problems with typical laundry treating appliances or problems, which can otherwise arise when utilizing the aspects to increase laundry treating capacity.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention, which is defined in the appended claims.

What is claimed is:

1. A drive hub assembly for a fabric treating appliance comprising:

a front plate having a first central opening and including a rear face;

a rear plate including a front face in confronting relationship with and coupled to the front plate and defining a space between the rear face and the front face, the rear plate having a second central opening aligned with and spaced from the first central opening; and a bearing carrier provided in each of the first and second central openings to collectively form a drive opening, and enclosing the space at the first and second central openings to define an internal cavity.

2. The drive hub assembly of claim 1 wherein the front plate and the rear plate each have an outer mounting surface and the front and rear plates couple to one another at the outer mounting surface.

3. The drive hub assembly of claim 2 wherein the front and rear plates have confronting concave shapes to define the internal cavity.

4. The drive hub assembly of claim 1 wherein at least one of the front plate and the rear plate include joints for coupling the rear plate to the front plate.

5. The drive hub assembly of claim 4 wherein the joints are organized complementary between the rear plate and the front plate to couple the rear plate to the front plate at the joints.

6. The drive hub assembly of claim 5 wherein the front and rear plates include inner joints and outer joints, with the outer joints positioned radially outside of the inner joints relative to the bearing carrier.

7. The drive hub assembly of claim 5 wherein the front and rear plates couple to one another by welding the joints.

8. The drive hub assembly of claim 1 further comprising at least one pillar formed on one of the front plate or the rear plate.

9. The drive hub assembly of claim 8 further comprising channels disposed along opposing sides of the at least one pillar.

10. The drive hub assembly of claim 9 wherein the front plate or rear plate without the pillar further includes at least one mounting wall complementary to the at least one pillar.

11. The drive hub assembly of claim 1 wherein the front plate and the rear plate form a rear wall of a tub or a drum for the fabric treating appliance.

12. The drive hub assembly of claim 1 wherein the front and rear plates are made of at least one of cast iron, cast aluminum, cast steel, or formed steel.

13. A fabric treating appliance for treating a laundry article according to a cycle of operation, the fabric treating appliance comprising:

a chassis defining an interior;

a tub located within the interior and mounted to the chassis, with the tub defining a liquid chamber;

a rotatable drum having a back wall disposed within the tub and at least partially defining a treating chamber;

a non-rotating drive hub assembly located between the tub and the back wall and including a front plate coupled in spaced relationship to a rear plate to define an interior cavity, and having a bearing carrier including bearings and provided on each of the front and rear plates to provide a drive opening in the center of the drive hub assembly; and a drive shaft extending through the drive opening, rotatable along the bearings, and coupled to the drum to rotate the drum according to the cycle of operation.

14. The fabric treating appliance of claim 13 wherein the front plate and the rear plate include a plurality of joints for coupling the front and rear plates.

15. The fabric treating appliance of claim 13 further comprising at least one mount on the rear plate including at least one pillar on the rear plate and a mounting wall on the front plate.

16. The fabric treating appliance of claim 15 further comprising at least one brace coupled to at least one mount.

17. The fabric treating appliance of claim 16 further comprising a front support plate coupled to the brace opposite of the rear plate to at least partially form an exoskeleton.

18. The fabric treating appliance of claim 15 wherein the mount is adapted to maximize torsional and bending stiffness.

19. A method of forming a drive hub assembly for a fabric treating appliance, the method comprising:

coupling a first plate having a rear face and a first central opening to a second plate having a front face and a second central opening, and defining a space between the rear face and the front face; and mounting a bearing carrier in the first and second central openings in the first and second plates enclosing the space.

20. The method of claim 19 wherein coupling the first plate to the second plate includes coupling a plurality of joints on the first plate to a plurality of joints on the second plate.

21. The method of claim 20 wherein coupling the first plate to the second plate includes aligning a set of pillars on the second plate with a set of mounting walls on the first plate.

* * * * *